US011691143B2

(12) United States Patent
Cottier

(10) Patent No.: US 11,691,143 B2
(45) Date of Patent: Jul. 4, 2023

(54) ASSEMBLIES AND METHODS FOR SCREENING SAMPLE FLUIDS

(71) Applicant: Creoptix AG, Wädenswil (CH)

(72) Inventor: Kaspar Cottier, Wädenswil (CH)

(73) Assignee: Creoptix AG, Wädenswil (CH)

( * ) Notice: Subject to any disclaimer, the term of this patent is extended or adjusted under 35 U.S.C. 154(b) by 380 days.

(21) Appl. No.: 16/772,185

(22) PCT Filed: Dec. 13, 2018

(86) PCT No.: PCT/IB2018/060000
§ 371 (c)(1),
(2) Date: Jun. 12, 2020

(87) PCT Pub. No.: WO2019/116295
PCT Pub. Date: Jun. 20, 2019

(65) Prior Publication Data

US 2021/0069694 A1 Mar. 11, 2021

(30) Foreign Application Priority Data

Dec. 15, 2017 (CH) ..... 01541/17

(51) Int. Cl.
*B01L 3/00* (2006.01)
*B01L 3/02* (2006.01)

(52) U.S. Cl.
CPC ..... *B01L 3/502715* (2013.01); *B01L 3/0293* (2013.01); *B01L 3/50273* (2013.01);
(Continued)

(58) Field of Classification Search
CPC ..... B01L 3/0293; B01L 3/502715; B01L 3/50273
See application file for complete search history.

(56) References Cited

U.S. PATENT DOCUMENTS 4,108,602 A 8/1978 Hanson et al.
5,695,720 A 12/1997 Wade et al.
(Continued)

FOREIGN PATENT DOCUMENTS

WO WO-2014/081840 A1 5/2014
WO WO-2017/187325 A1 11/2017

OTHER PUBLICATIONS

International Search Report and Written Opinion for PCT/IB2018/060000 dated Mar. 18, 2019, 12 pages.
(Continued)

*Primary Examiner* — Sharon Pregler
(74) *Attorney, Agent, or Firm* — Blank Rome LLP

(57) ABSTRACT

According to the present invention there is provided an assembly comprising, a needle unit comprising n hollow needles wherein n is greater than one, and wherein each hollow needle can receive a respective sample fluid; a flow cell unit comprising m flow cells wherein m is greater than one, each flow cell having an input and an output, and a test surface on which ligands can be provided located between the input, and output; a means for consecutively moving sample fluids, from each of said n hollow needles respectively, into all said m flow cells, so that said sample fluids flow consecutively through the same flow cells. There is further provided a corresponding method of screening a sample fluid for molecules which can bind to predefined ligands.

31 Claims, 7 Drawing Sheets

(52) U.S. Cl.
CPC . *B01L 2200/143* (2013.01); *B01L 2300/0829* (2013.01); *B01L 2300/0877* (2013.01); *B01L 2400/049* (2013.01); *B01L 2400/0633* (2013.01)

(56) References Cited

U.S. PATENT DOCUMENTS

| | | | | |
|---|---|---|---|---|
| 2007/0134808 | A1 | 6/2007 | Sullivan | |
| 2011/0092376 | A1* | 4/2011 | Colston, Jr. ..... | B01L 3/0241 506/37 |
| 2012/0154818 | A1 | 6/2012 | Kim et al. | |
| 2013/0260372 | A1 | 10/2013 | Buermann et al. | |
| 2015/0192574 | A1 | 7/2015 | Cottier | |

OTHER PUBLICATIONS

J. B. Murray, et al., "Off-Rate Screening (ORS) by Surface Plasmon Resonance. An Efficient Method to Kinetically Sample Hit to Lead Chemical Space from Unpurified Reaction Products", Journal of Medicinal Chemistry, vol. 57, 2014, pp. 2845-2850.

* cited by examiner

ASSEMBLIES AND METHODS FOR SCREENING SAMPLE FLUIDS

RELATED APPLICATIONS

This application is a national phase of PCT/IB2018/060000, filed on Dec. 13, 2018, which claims the benefit of Swiss Application No. CH015411/17, filed on Dec. 15, 2017. The entire contents of these applications are hereby incorporated by reference.

FIELD OF THE INVENTION

The present invention concerns assemblies and methods for screening sample fluids at increased throughput; specifically, the assemblies and methods allow a plurality of sample fluids to be consecutively flowed through flow cells in rapid succession, thereby allowing screening of said plurality of sample fluids in rapid succession.

DESCRIPTION OF RELATED ART

In many applications, such as drug discovery and development, environmental testing, and diagnostics, there is a need to analyse a large number of liquid samples in a short amount of time. Devices for delivering the liquid samples are generally called autosamplers or auto-injectors and are interfaced to all manner of analysis systems including, but not limited to, optical or acoustic biosensors, mass spectrometers, chromatography systems, and spectrophotometric detectors.

Recently, the high throughput screening of molecular interactions has gained increased interest, in particular in pharmaceutical companies where drug to drug-target interactions are studied in drug discovery. During high throughput screening, typically a large number of candidate molecules are prepared at a single concentration such as 100 micromolar, and successively evaluated for binding to a drug target. If a binding event is detected, the candidate molecule is marked as a hit and further investigated. False positives are a common issue in high throughput screening, i.e. too many compounds are detected as "hits" which appear to bind, but need to be excluded during the further investigations, which is generating high additional costs. Murray et al., J Med Chem. 2014 Apr. 10; 57(7):2845-50, describes the concept of "off-rate screening", which has the potential to overcome some current limitations, since the evaluation of a binding signal does not occur during a sample injection which can be affected by non-specific effects such as aggregation or refractive index mismatches, but during the dissociation phase which is less affected by these issues. However, current instruments lack the time resolution to resolve the fast off-rates in the order of 10 s−1 which are exhibited by the weak bindings observed in primary screens. It is therefore of great interest to provide devices for the measurement of fast off-rates.

A method for parallel sample pickup for mass spectrometers, which operates by parallel pickup of eight samples, followed by the serial injection of the samples into the analysis chamber, are known in the art. However this method cannot be readily adapted to biosensors, since the measurement channels first need to be addressed individually during sample loading in order to allow for effective referencing, and subsequently, the measurement channels need to be addressed simultaneously during the actual measurement. In addition, the time needed to complete a measurement cycle per sample is typically in the order of minutes, due to the fact that also slow kinetics need to be measured, necessitating an extended amount of time to record a meaningful change in signal in order to fit the data.

Therefore, current systems aiming at higher throughput, typically achieve this by straightforward parallelization. For example systems based on the effect of Surface Plasmon Resonance (SPR) are known in the art. However, the throughput obtained by these systems is still not sufficient to conduct a large-scale screen, and therefore these devices are restricted to secondary screening laboratory tasks. In addition, the systems suffer from several limitations which make manual intervention necessary. In particular, sensor surfaces can fail, e.g. due to compounds binding irreversibly to the surface, which needs to be detected and the chip manually exchanged. In addition, since the throughput increase is obtained by simple parallelization on these devices, parallel injections pass over different sensor surfaces which might present different characteristics, e.g. different target immobilization levels, and thus the results can become difficult to compare. Furthermore, due to the use of one syringe pump per needle, manufacturing costs are high, the instrument size is large, the risk of trapping air in a pump due to incomplete syringe pump priming is multiplied, and the buffer consumption for operating these devices is very high, requiring large buffer tanks and or frequent buffer change. Here, priming stands for filling an inner volume of a fluidic component or assembly with buffer liquid and evacuating air trapped in the fluidic component or assembly.

It is an aim of the present invention to obviate, or at least mitigate, one or more of the above-mentioned disadvantages.

BRIEF SUMMARY OF THE INVENTION

According to the invention, these aims are achieved by means of an assembly and/or method having the features recited in the independent claims; wherein the dependent claims recite optional features of preferred embodiments.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
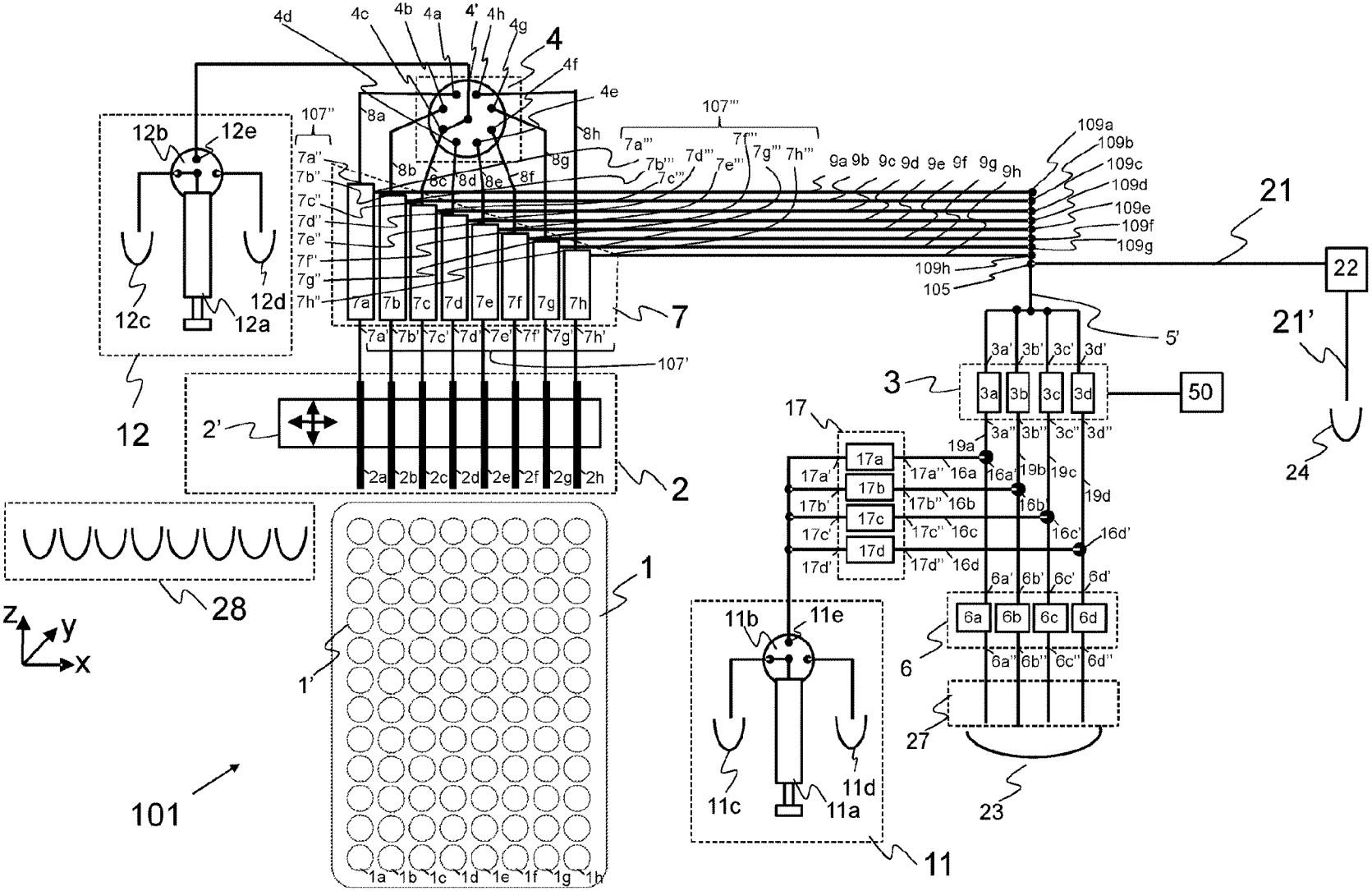
FIG. 1 shows an assembly according to an embodiment of the present invention.

FIG. 1 illustrates an assembly 101 according to one embodiment of the present invention.

The assembly 101 comprises, a needle unit 2, a flow cell unit 3, a first selector valve unit 4, a pumping means 12, and a switching valve unit 7.

The needle unit 2 comprises n hollow needles 2*a-h*, wherein n is greater than one. In this particular example n is equal to eight so needle unit 2 comprises eight hollow needles 2*a-h*. However it should be understood that n may have any value greater than one.

The flow cell unit 3 comprises m flow cells 3*a-d*, wherein m is greater than one. In this example m is equal to four so that flow cell unit 3 comprises four flow cells 3*a*-3*d*, namely a first flow cell 3*a*, a second flow cell 3, a third flow cell 3*c* and a fourth flow cell 3*d*. However it should be understood that m many have any value greater than one. Each flow cell 3*a-d* has a respective input 3*a*'-3*d*' and a respective output 3*a*"-3*d*", and a test surface on which ligands can be provided located between its respective input 3*a*'-3*d*' and output 3*a*"-3*d*".

Preferably the assembly 101 further comprises a sensor 50 which can detect if molecules of a sample fluid which has flowed through one or more of the m flow cells 3*a-d*, have become bound to ligands on the test surface(s) of said one or more flow cells 3*a-d*. Preferably the sensor 50 can generate time-resolved signals for recording or monitoring binding of molecules to ligands on the test surface(s) of said one or more flow cells 3*a-d*, over time. The sensor 50 may take any suitable form, for example the sensor 50 may comprise a Surface Plasmon Resonance sensor, or, Waveguide interferometry sensor, or, surface acoustic sensor) which is configured to measure if molecules have become bound to the ligands on the test surface of a flow cell 3*a-d* of the flow cell unit 3. The sensor 50 is preferably operably connected to the flow cell unit 3 so that it can perform such measurements. In a typical drug discovery application, the aim is to identify samples which have molecules (which in this case are drug candidates) which can bind to predefined ligands (which in this case are drug targets), said predefined ligands preferably being a known type of protein which can be found in a human body; said predefined ligands are provided on the test surface of the flow cells 3*a-d*. Therefore if a flow cell has said specific ligand on its test surface, and if after a sample fluid has flowed through the flow cell the sensor 50 indicates that the molecules of that sample fluid have become bound to said predefined ligands in the flow cell, this indicates that the molecules of that sample fluid has the potential to bind to equivalent ligands found in the human body; in other words the sample fluid is thus identified as being a drug candidate which can bind to equivalent ligands (drug targets) found within the human body. If in addition several different concentrations of the drug candidate are flown through the flow cell, the time-resolved signal of the sensor 50 allows characterization of the binding, such as the determination of affinity and the kinetic on-rate and off-rate.

In a typical detection or concentration measurement application, molecules of a sample fluid bind to predefined ligands; therefore if a flow cell has a predefined ligand on its test surface, if after a sample fluid has flowed through the flow cell the sensor 50 indicates that the molecules of that sample fluid have become bound to said ligands, this indicates that the sample fluid contained molecules which can bind to the predefined ligands and can thus be used to bind to ligands within the human body, which are equivalent to said predefined ligands. In this way the presence (or absence) of molecules in a sample fluid which can bind to predefined ligands can be determined. Furthermore, the signal or time-resolved signal of the sensor 50 may allow to determine the concentration of the molecules in a sample fluid. It should be understood that in the present application, if a fluid is said to flow through a flow cell, this means that said fluid has flowed over the test surface of said flow cell.

In this embodiment there is provided a single pumping means 12. The single pumping means 12 can be selectively configured to provide positive pressure (e.g. positive fluid pressure) or negative pressure (e.g. negative fluid pressure). The single pumping means 12 may have any suitable configuration. In this example, the single pumping means 12 comprises a syringe 12*a*, a switching valve 12*b*, a buffer reservoir 12*c* which contains a buffer fluid, a waste reservoir 12*d* and an output 12*e*. Preferably, before providing positive pressure, the single pumping means 12 is typically primed by configuring the switching valve 12*b* to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. In order to provide positive pressure, the switching valve 12*b* is configured to fluidly connect the syringe 12*a* to the output 12*e*; the buffer fluid contained in the syringe 12*a* is then dispensed from the syringe; the dispense buffer fluid creates the positive pressure. Similarly, preferably, before providing negative pressure, the syringe 12*a* is typically at least partially emptied (and most preferably is fully emptied); the switching valve 12*b* is configured to fluidly connect the syringe 12*a* to the waste reservoir 12*d* so as to allow fluid to pass from the syringe 12*a* to the waste reservoir 12*d*; the fluid contents of the syringe 12*a* is then at least partially emptied into the waste reservoir 12*d*. In order to provide negative pressure, the switching valve 12*b* is configured to fluidly connect the syringe 12*a* to the output 12*e*; then fluid 12*e* present in the output is aspirated into the syringe; aspirating fluid from the output 12*e* into the syringe 12*a* creates the negative pressure.

The first selector valve unit 4 has a single input 4' which is fluidly connected to the single pumping means 12 (specifically to the output 12*e* of the single pumping mean 12), and n outputs 4*a-h*. As mentioned in this example n is equal to eight therefore the first selector valve unit 4 has eight outputs 4*a-h* (namely a first output 4*a*, second output 4*b*, third output 4*c*, fourth output 4*d*, fifth output 4*e*, sixth output 4*f*, seventh output 4*g*, eighth output 4*h*). Most preferably the number of outputs 4*a-h* which the first selector valve unit 4 has corresponds to the number of hollow needles in the needle unit 2.

The first selector valve unit 4 is configured such that it can selectively fluidly connect its single input 4' with any one or more of its n outputs 4*a-h*; accordingly the first selector valve unit 4 is configured such that it can selectively fluidly connect the single pumping means 12 (which is fluidly connected to the single input 4' of the first selector valve unit 4) with any one or more n outputs 4*a-h* of the first selector valve unit 4. Specifically in this embodiment the first selector valve unit 4 can be selectively configured into any one of n+1 different configurations (wherein n is the number of hollow needles 2*a-h* in the needle unit 2): when the first selector valve unit 4 is in a first configuration the single input 4' is fluidly connected to the first output 4*a* only; when the first selector valve unit 4 is in a second configuration the single input 4' is fluidly connected to the second output 4*b* only; when the first selector valve unit 4 is in a third configuration the single input 4' is fluidly connected to the third output 4*c* only; when the first selector valve unit 4 is in a fourth configuration the single input 4' is fluidly connected to the fourth output 4*d* only; when the first selector valve unit 4 is in a fifth configuration the single input 4' is fluidly connected to the fifth output 4*e* only; when the first selector valve unit 4 is in a sixth configuration the single input 4' is fluidly connected to the sixth output 4*f* only; when the first selector valve unit 4 is in a seventh configuration the single input 4' is fluidly connected to the seventh output 4*g* only; when the first selector valve unit 4 is in an eighth configuration the single input 4' is fluidly connected to the eighth output 4*h* only; when the first selector valve unit 4 is in a ninth configuration the single input 4' is simultaneously fluidly connected to all of the first, second, third, fourth, fifth, sixth, seventh, and eighth outputs 4*a-h*.

It should be understood that the first selector valve unit 4 is not an essential feature of the invention. However in this embodiment the first selector valve unit 4 advantageously allows to minimize the number of pumping means 12 required in the assembly 101. Specifically, in this embodiment the first selector valve unit 4 advantageously allows to use only one single pumping means 12 only in order to aspirate sample fluid(s) into the hollow needles 2*a-h* of the needle unit 2.

The switching valve unit 7 has a first set 107' of inputs comprising n inputs 7*a'*-7*h'* which are fluidly connected to respective n hollow needles 2*a-h*, and a second set 107" of inputs comprising n inputs 7*a"*-7*h"* which are fluidly connected to respective n outputs 4*a-h* of the first selector valve unit 4, and a set of outputs 107'" comprising n outputs 7*a'"*-7*h'"*.

A first input 7*a'* of the first set 107' is fluidly connected to a first hollow needle 2*a* of the needle unit 2; a second input 7*b'* of the first set 107' is fluidly connected to a second hollow needle 2*b* of the needle unit 2; a third input 7*c'* of the first set 107' is fluidly connected to a third hollow needle 2*c* of the needle unit 2; a fourth input 7*d'* of the first set 107' is fluidly connected to a fourth hollow needle 2*d* of the needle unit 2; a fifth input 7*e'* of the first set 107' is fluidly connected to a fifth hollow needle 2*e* of the needle unit 2; a sixth input 7*f'* of the first set 107' is fluidly connected to a sixth hollow needle 2*f* of the needle unit 2; a seventh input 7*g'* of the first set 107' is fluidly connected to a seventh hollow needle 2*g* of the needle unit 2; an eighth input 7*h'* of the first set 107' is fluidly connected to an eighth hollow needle 2*h* of the needle unit 2.

In this example each respective output 4*a-h* of the first selector valve unit 4 is fluidly connected to a respective input 7*a"*-7*h"* of the second set 107" of inputs of the switching valve unit 7, via a respective conduit (8*a*-8*h*), referred to hear after as buffer conduits (8*a*-8*h*). Specifically, in this example the assembly 101 comprises: a first buffer conduit 8*a* which fluidly connects the first output 4*a* of the first selector valve unit 4 to a first input 7*a"* of the second set 107" of inputs of the switching valve unit 7; a second buffer conduit 8*b* which fluidly connects the second output 4*b* of the first selector valve unit 4 to a second input 7*b"* of the second set 107" of inputs of the switching valve unit 7; a third buffer conduit 8*c* which fluidly connects the third output 4*c* of the first selector valve unit 4 to a third input 7*c"* of the second set 107" of inputs of the switching valve unit 7; a fourth buffer conduit 8*d* which fluidly connects the fourth output 4*d* of the first selector valve unit 4 to a fourth input 7*d"* of the second set 107" of inputs of the switching valve unit 7; a fifth buffer conduit 8*e* which fluidly connects the fifth output 4*e* of the first selector valve unit 4 to a fifth input 7*e"* of the second set 107" of inputs of the switching valve unit 7; a sixth buffer conduit 8*f* which fluidly connects the sixth output 4*f* of the first selector valve unit 4 to a sixth input 7*f"* of the second set 107" of inputs of the switching valve unit 7; a seventh buffer conduit 8*g* which fluidly connects the seventh output 4*g* of the first selector valve unit 4 to a seventh input 7*g"* of the second set 107" of inputs of the switching valve unit 7; and an eighth buffer conduit 8*h* which fluidly connects an eighth output 4*h* of the first selector valve unit 4 to an eighth input 7*h"* of the second set 107" of inputs of the switching valve unit 7.

The switching valve unit 7 can be selectively arranged in a first configuration or a second configuration, wherein in said first configuration the switching valve unit 7 fluidly connects the n inputs 7*a'*-7*h'* of the first set 107' of inputs with said n inputs 7*a"*-7*h"* of the second set 107" of inputs, and in said second configuration the switching valve unit 7 blocks the flow of fluid between the n inputs 7*a'*-7*h'* of the first set 107' of inputs and said n inputs 7*a"*-7*h"* of the second set 107" of inputs.

In this exemplary embodiment each of said n outputs 7*a'"*-7*h'"* of said switching valve unit 7 is fluidly connected to a single conduit 5'. Specifically each of said n outputs 7*a'"*-7*h'"* of said switching valve unit 7 is fluidly connected to a single conduit 5' via a respective conduit 9*a-h* (referred to hereafter as a respective injection conduits 9*a-h*). Specifically a first injection conduit 9*a* fluidly connects a first output 7*a'"* of the switching valve unit 7 to the single conduit 5'; a second injection conduit 9*b* fluidly connects a second output 7*b'"* of the switching valve unit 7 to the single conduit 5'; a third injection conduit 9*c* fluidly connects a third output 7*c'"* of the switching valve unit 7 to the single conduit 5'; a fourth injection conduit 9*d* fluidly connects a fourth output 7*d'"* of the switching valve unit 7 to the single conduit 5'; a fifth injection conduit 9*e* fluidly connects a fifth output 7*e'"* of the switching valve unit 7 to the single conduit 5'; a sixth injection conduit 9*f* fluidly connects a sixth output 7*f'"* of the switching valve unit 7 to the single conduit 5'; a seventh injection conduit 9*g* fluidly connects a seventh output 7*g'"* of the switching valve unit 7 to the single conduit 5'; and an eighth injection conduit 9*h* fluidly connects an eighth output 7*h'"* of the switching valve unit 7 to the single conduit 5'.

Each of the respective injection conduits 9*a-h* may be connected to the single conduit 5' using any suitable means; for example each of the respective injection conduits 9*a-h* can be connected to the single conduit 5' by means of a valveless junction such as a simple T-junction, or the injection conduits 9*a-h* can be connected to the single conduit 5' by means of a star junction; or each of the respective injection conduits 9*a-h* can be connected to the single conduit 5' by means of a respective valve. In this example shown in FIG. 1, each of the respective injection conduits 9*a-h* are fluidly connected to the single conduit 5' by means of a respective valveless T-junction 109*a-h*.

The single conduit 5' is fluidly connected to the respective m inputs of said m flow cells 3*a-d* in said flow cell unit 3. Specifically the single conduit 5' is fluidly connected to all of the inputs 3*a'*-3*d'* of the flow cells 3*a-d* in the flow cell unit 3. Preferably the volume of the single conduit 5', between any one of said valveless T-junctions 109*a-h*, and any one of said inputs 3*a'*-3*d'* of the flow cells 3*a-d* is less than 10 microliters. Most preferably the volume of the single conduit 5', between any one of said valveless T-junctions 109*a-h*, and any one of said inputs 3*a'*-3*d'* of the flow cells 3*a-d* is less than 1 microliter.

It should be understood that it is not essential for the n outputs 7*a*'''-7*h*''' of said switching valve unit 7 to be fluidly connected to a single conduit 5'; in an alternative embodiment, the assembly 101 does not comprise any single conduit 5' any rather the n outputs 7*a*'''-7*h*''' of said switching valve unit 7 to be fluidly connected to a single junction (such as a star junction). The single junction is fluidly connected to the respective m inputs of said m flow cells 3*a-d* in said flow cell unit 3.

The assembly 101 further comprises the following optional features: a second selector valve unit 6; a third selector valve unit 17; a first waste reservoir 23; a first valve 22; a second waste reservoir 24; a second pumping means 11.

Specifically, the first valve 22 is fluidly connected between said second waste reservoir 24 and a second junction 105, wherein said second junction 105 is located between where the n outputs of said switching valve unit are fluidly connected to said single conduit 5' and the m inputs 3 of said m flow cells in said flow cell unit. In other words said second junction 105 is located between the valveless junctions 109*a-h* and the m inputs 3*a*'-3*d*' of said m flow cells 3*a-d* in said flow cell unit 3. The first valve 22 can be selectively configured to be in an open configuration or closed configuration. When the first valve 22 is configured to be in an open configuration fluid can flow from the second junction 105 through the first valve 22 and into the second waste reservoir 24; when the first valve 22 is configured to be in an closed configuration the first valve 22 blocks the flow of fluid from the second junction 105 into the second waste reservoir 24. It should be understood that the first valve 22 may take any suitable form; for example the first valve 22 may comprise a solenoid valve or a rotary valve.

The second selector valve unit 6 is fluidly connected between respective m outputs 3*a*"-3*d*" of the m flow cells 3*a-d* in said flow cell unit 3 and said first waste reservoir 23. The second selector valve unit 6 is configured to selectively fluidly connect one or more of said m outputs 3*a*"-3*d*" of the m flow cells 3*a-d* with said first waste reservoir 23.

Specifically, the second selector valve unit 6 comprises m valves, each of the respective m valves is connected between a respective one of said m outputs 3*a*"-3*d*" of the m flow cells 3*a-d* and the first waste reservoir 23. Most preferably the number of valves provided in the second selector valve unit 6 corresponds to the number of flow cells 3*a-d* in the flow cell unit 3. In this example since m is equal to four, the second selector valve unit 6 comprises a first valve 6*a* which has an input 6*a*' and an output 6*a*"; a second valve 6*b* which has an input 6*b*' and an output 6*b*"; a third valve 6*c* which has an input 6*c*' and an output 6*c*"; and a fourth valve 6*d* which has an input 6*d*' and an output 6*d*". Most preferably each of said m valves is a solenoid valve. The input 6*a*' of the first valve 6*a* is fluidly connected to the output 3*a*" of the first flow cell 3*a*; specifically a first subsidiary conduit 19*a* fluidly connects the output 3*a*" of the first flow cell 3*a* to the input 6*a*' of the first valve 6*a* of the second selector valve unit 6. The input 6*b*' of the second valve 6*b* is fluidly connected to the output 3*b*" of the second flow cell 3*b*; specifically a second subsidiary conduit 19*b* fluidly connects the output 3*b*" of the second flow cell 3*b* to the input 6*b*' of the second valve 6*b* of the second selector valve unit 6. The input 6*c*' of the third valve 6*c* is fluidly connected to the output 3*c*" of the third flow cell 3*c*; specifically a third subsidiary conduit 19*c* fluidly connects the output 3*c*" of the third flow cell 3*c* to the input 6*c*' of the third valve 6*c* of the second selector valve unit 6. The input 6*d*' of the fourth valve 17*d* is fluidly connected to the output 3*d*" of the fourth flow cell 3*d*; specifically a fourth subsidiary conduit 19*b* fluidly connects the output 3*d*" of the fourth flow cell 3*d* to the input 6*d*' of the fourth valve 6*d* of the second selector valve unit 6.

The output 6*a*" of the first valve 6*a* is fluidly connected to the first waste reservoir 23; the output 6*b*" of the second valve 6*b* is fluidly connected to the first waste reservoir 23; the output 6*c*" of the third valve 6*c* is fluidly connected to the first waste reservoir 23; the output 6*d*" of the fourth valve 17*d* is fluidly connected to the first waste reservoir 23.

Optionally, the fluidic assembly 101 may further comprise a waste outlet 27 which fluidly connects the second selector valve unit 6 with the first waste reservoir 23. The waste outlet 27 may comprise one or more conduits which fluidly connects the second selector valve unit 6 with the first waste reservoir 23. In the assembly 101 the waste outlet 27 comprises a m conduits (wherein m is the number of flow cells 3*a-d* in the flow cell unit 3); the waste outlet 27 comprises a first, second, third and fourth conduit; a first end of the first conduit is connected to the output 6*a*" of the first valve 6*a*, and the second opposite end of the first conduit is fluidly connected to the first waste reservoir 23; a first end of the second conduit is connected to the output 6*b*" of the second valve 6*b*, and the second opposite end of the second conduit is fluidly connected to the first waste reservoir 23; a first end of the third conduit is connected to the output 6*c*" of the third valve 6*c*, and the second opposite end of the third conduit is fluidly connected to the first waste reservoir 23; a first end of the fourth conduit is connected to the output 6*d*" of the fourth valve 6*d*, and the second opposite end of the fourth conduit is fluidly connected to the first waste reservoir 23. It should be understood that the first waste reservoir may take any suitable form. For example the first waste reservoir 23 may comprise a bottle or other container adapted to receive waste liquid.

Accordingly, when the first valve 6*a* is opened it will fluidly connect the output 3*a*" of the first flow cell 3*a* with the first waste reservoir 23, thereby allowing fluid which is flowing out of the first flow cell 3*a* to flow into the first waste reservoir 23; when the second valve 6*b* is opened it will fluidly connect the output 3*b*" of the second flow cell 3*b* with the first waste reservoir 23, thereby allowing fluid which is flowing out of the second flow cell 3*b* to flow into the first waste reservoir 23; when the third valve 6*c* is opened it will fluidly connect the output 3*c*" of the third flow cell 3*c* with the first waste reservoir 23, thereby allowing fluid which is flowing out of the third flow cell 3*c* to flow into the first waste reservoir 23; when the fourth valve 6*d* is opened it will fluidly connect the output 3*d*" of the fourth flow cell 3*d* with the first waste reservoir 23, thereby allowing fluid which is flowing out of the fourth flow cell 3*d* to flow into the first waste reservoir 23. Each of the first, second, third and fourth valves 6*a-d* of the second selector valve unit 6 can be selectively opened or closed.

The second selector valve unit 6 is moveable between at least m+2 positions, where m is the number of flow cells 3*a-d* in the flow cell unit 3. Accordingly, in the embodiment the second selector valve unit 6 is moveable between at least six positions: When the second selector valve unit 6 is in a first position, the first valve 6*a* is opened and the second, third, fourth valves 6*b-d* are closed thereby fluidly connecting the output 3*a*" of the first flow cell 3*a* only with the first waste reservoir 23; thus when the second selector valve 6 is in its first position fluid arriving at the flow cell unit 3 from the single conduit 5', will flow through the first flow cell 3*a* only (not through the second, third or fourth flow cells 3*b-d*) and into the first waste reservoir 23. When the second selector valve unit 6 is in a second position, the second valve 6*b* is opened and the first, third, fourth valves 6*a,c,d* are closed thereby fluidly connecting the output 3*b*" of the second flow cell 3*b* only with the first waste reservoir 23; thus when the second selector valve 6 is in its second position fluid arriving at the flow cell unit 3 from the single conduit 5', will flow through the second flow cell 3*b* only (not through the first, third or fourth flow cells 3*a,c,d*) and into the first waste reservoir 23. When the second selector valve unit 6 is in a third position, the third valve 6*c* is opened and the first, second, and fourth valves 6*a,b,d* are closed thereby fluidly connecting the output 3*c*" of the third flow cell 3*c* only with the first waste reservoir 23; thus when the second selector valve 6 is in its third position fluid arriving at the flow cell unit 3 from the single conduit 5', will flow through the third flow cell 3*c* only (not through the first, second or fourth flow cells 3*a,b,d*) and into the first waste reservoir 23. When the second selector valve unit 6 is in a fourth position, the fourth valve 6*c* is opened and the first, second, and third valves 6*a,b,c* are closed thereby fluidly connecting the output 3*d*" of the fourth flow cell 3*d* only with the first waste reservoir 23; thus when the second selector valve 6 is in its fourth position fluid arriving at the flow cell unit 3 from the single conduit 5', will flow through the fourth flow cell 3*d* only (not through the first, second or third flow cells 3*a,b,c*) and into the first waste reservoir 23. When the second selector valve unit 6 is in a fifth position, all of the first, second, third and fourth valves 6*a-d* are opened thereby fluidly connecting all of the outputs 3*a*"-3*d*" of all of the flow cells 3*a-d* in the flow cell unit 3 with the first waste reservoir 23; thus fluid arriving at the flow cell unit 3 from the single conduit 5', will flow through all of the flow cell 3*a-d* and into the first waste reservoir 23. Finally, when the second selector valve unit 6 is in a sixth position, all of the first, second, third and fourth valves 6*a-d* are closed; thus when the second selector valve unit 6 is in its sixth position fluid arriving at the flow cell unit 3 from the single conduit 5', will not flow through any of the flow cells 3*a-d*.

In a variation of this embodiment instead of a second selector valve unit 6 comprising m solenoid valves 6*a-d*, the second selector valve unit 6 comprises a rotary valve which can be arranged in at least five configurations: a first configuration wherein the second selector valve unit 6 fluidly connects the output 3*a*" of the first flow cell 3*a* only with the first waste reservoir 23; a second configuration wherein the second selector valve unit 6 fluidly connects the output 3*b*" of the second flow cell 3*b* only with the first waste reservoir 23; a third configuration wherein the second selector valve unit 6 fluidly connects the output 3*c*" of the third flow cell 3*c* only with the first waste reservoir 23; a fourth configuration wherein the second selector valve unit 6 fluidly connects the output 3*d*" of the fourth flow cell 3*a* only with the first waste reservoir 23; and a fifth configuration wherein the second selector valve unit 6 fluidly connects the all of the outputs 3*a*"-*d*" of all of the flow cells 3*a-d* in the flow cell unit 3 with the first waste reservoir 23.

The second pumping means 11 can be selectively configured to provide positive pressure (e.g. positive fluid pressure) or negative pressure (e.g. negative fluid pressure). The second pumping means 11 may have any suitable configuration. In this example, the second pumping means 11 comprises a syringe 11*a*, a switching valve 11*b*, a buffer reservoir 11*c* which contains a buffer fluid, a waste reservoir 11*d* and an output 11*e*. Preferably, before providing positive pressure, the second pumping means 11 is typically primed by configuring the switching valve 11*b* to fluidly connect the syringe 11*a* to the waste reservoir 11*d*, so as to allow buffer fluid to pass from the syringe 11*a* to the waste reservoir 11*d*; then the buffer fluid contents of the syringe 11*a* are dispensed into the waste reservoir 11*d*. Then the switching valve 11*b* is configured to fluidly connect the syringe 11*a* to the buffer reservoir 11*c*, so as to allow buffer fluid to pass from the buffer reservoir 11*c* to the syringe 11*a*. The syringe 11*a* is then filled with buffer fluid from the buffer reservoir 11*c* by aspirating buffer fluid from the buffer reservoir 11*c*. In order to provide positive pressure, the switching valve 11*b* is configured to fluidly connect the syringe 11*a* to the output 11*e*; the buffer fluid contained in the syringe 11*a* is then dispensed from the syringe; the dispense buffer fluid creates the positive pressure. Similarly, preferably, before providing negative pressure, the syringe 11*a* is typically at least partially emptied (and most preferably is fully emptied); the switching valve 11*b* is configured to fluidly connect the syringe 11*a* to the waste reservoir 11*d* so as to allow buffer fluid to pass from the syringe 11*a* to the waste reservoir 11*d*; the buffer fluid contents of the syringe 11*a* is then at least partially emptied into the waste reservoir 11*d*. In order to provide negative pressure, the switching valve 11*b* is configured to fluidly connect the syringe 11*a* to the output 11*e*; then fluid present in the output 11*e* is aspirated into the syringe; aspirating fluid from the output 11*e* into the syringe 11*a* creates the negative pressure.

The third selector valve unit 17 is arranged between the second pumping means 11 and respective m outputs 3*a*"-3*d*" of the m flow cells 3*a-d*. The third selector valve unit 17 is configured to selectively fluidly connect the second pumping means 11 (specifically the output 11*e* of the second pumping means 11) with one or more of said m outputs 3*a*"-3*d*" of the m flow cells 3*a-d*. Specifically, the third selector valve unit 17 comprises at least m valves (wherein m is the number of flow cells 3*a-d* in the flow cell unit 3), each of the respective m valve is connected between a respective one of said m outputs 3*a*"-3*d*" of the m flow cells 3*a-d* and the second pumping means 11. Most preferably the number of valves provided in the third selector valve unit 17 corresponds to the number of flow cells 3*a-d* in the flow cell unit 3. In this example since m is equal to four, the third selector valve unit 17 comprises a first valve 17*a* which has an input 17*a*' and an output 17*a*"; a second valve 17*b* which has an input 17*b*' and an output 17*b*"; a third valve 17*c* which has an input 17*c*' and an output 17*c*"; and a fourth valve 17*d* which has an input 17*d*' and an output 17*d*". In this example the first, second, third, and fourth valves 17*a-d* are each defined by a respective switching valve; for example the first, second, third, and fourth valves 17*a-d* may each be a respective solenoid valve; however it should be understood that the valves 17*a-d* may take any suitable form.

Conduits 16*a-d* (referred to hereafter as buffer inlet conduits 16*a-d*) fluidly connect the respective outputs 17*a*"-17*d*" of the first, second, third and fourth, valves 17*a-d* to the respective subsidiary conduits 19*a-d*; specifically a first buffer inlet conduit 16*a* fluidly connects the output 17*a*" of the first valve 17*a* to the first subsidiary conduit 19*a* (which is fluidly connected to the output 3*a*" of the first flow cell 3*a*); a second buffer inlet conduit 16*b* fluidly connects the output 17*b*" of the second valve 17*b* to the second subsidiary conduit 19*b* (which is fluidly connected to the output 3*b*" of the second flow cell 3*b*); a third buffer inlet conduit 16*c* fluidly connects the output 17*c*" of the third valve 17*c* to the third subsidiary conduit 19*c* (which is fluidly connected to the output 3*c*" of the third flow cell 3*c*); a fourth buffer inlet conduit 16*d* fluidly connects the output 17*d*" of the fourth valve 17*d* to the fourth subsidiary conduit 19*d* (which is fluidly connected to the output 3*d*" of the fourth flow cell 3*d*). In this embodiment the first, second, third and fourth buffer inlet conduits 16*a-d* are connected to the respective first, second, third and fourth subsidiary conduit 19*a-d* at a respective junction 16*a*'-16*d*'; in this example each of said junctions 16*a*'-16*d*' is a valveless junction 16*a*'-16*d*' (and more specifically is a valveless T-junction); however it should be understood that the respective junctions 16*a*'-16*d*' may take any suitable form, for example the respective junctions 16*a*'-16*d*' may each comprise a valve.

It should be understood that in a variation of this embodiment the first, second, third and fourth buffer inlet conduits 16*a-d* could, instead, be arranged to connect the respective outputs 17*a*"-*d*" of the respective valves 17*a-d* directly to the respective outputs 3*a*"-*d*" of the respective flow cells 3*a-d*. In other words one end of the first inlet conduit 16*a* could be connect to the output 17*a*" of the first valve 17*a* and the opposite end of the first inlet conduit 16*a* could be directly connected to the output 3*a*" of the first flow cell 3*a*; one end of the second inlet conduit 16*d* could be connect to the output 17*b*" of the second valve 17*b* and the opposite end of the second inlet conduit 16*d* could be directly connected to the output 3*b*" of the second flow cell 3*b*; one end of the third inlet conduit 16*c* could be connect to the output 17*c*" of the third valve 17*c* and the opposite end of the third inlet conduit 16*c* could be directly connected to the output 3*c*" of the third flow cell 3*c*; one end of the fourth inlet conduit 16*d* could be connect to the output 17*d*" of the fourth valve 17*d* and the opposite end of the fourth inlet conduit 16*d* could be directly connected to the output 3*d*" of the first flow cell 3*d*.

Referring back to the assembly 101 shown in FIG. 1, the input 17*a*' of the first valve 17*a* is fluidly connected to the second pumping means 11 and the output 17*a*" of the first valve 17*a* is fluidly connected to the output 3*a*" of the first flow cell 3*a*; the input 17*b*' of the second valve 17*b* is fluidly connected to the second pumping means 11 and the output 17*b*" of the second valve 17*b* is fluidly connected to the output 3*b*" of the second flow cell 3*b*; the input 17*c*' of the third valve 17*c* is fluidly connected to the second pumping means 11 and the output 17*c*" of the third valve 17*c* is fluidly connected to the output 3*c*" of the third flow cell 3*c*; the input 17*d*' of the fourth valve 17*d* is fluidly connected to the second pumping means 11 and the output 17*d*" of the fourth valve 17*d* is fluidly connected to the output 3*d*" of the fourth flow cell 3*d*.

The third selector valve unit 17 is configured such that it can be selectively arranged in at least m+1 configuration, where m is the number of flow cells 3*a-d* within the flow cell unit 3. Therefore, in the assembly 101 the third selector valve unit 17 is configured such that it can be selectively arranged into at least five configurations. When the third selector valve unit 17 is in a first configuration, the first valve 17*a* is opened and the second, third, and fourth valves 17*b-d* are closed; thus when the third selector valve unit 17 is in its first configuration the second pumping means 11 is fluidly connected to the first flow cell 3*a* only. When the third selector valve unit 17 is in a second configuration, the second valve 17*d* is opened and the first, third, and fourth valves 17*a,c,d* are closed; thus when the third selector valve unit 17 is in its second configuration the second pumping means 11 is fluidly connected to the second flow cell 3*a* only. When the third selector valve unit 17 is in a third configuration, the third valve 17*c* is opened and the first, second, and fourth valves 17*a,b,d* are closed; thus when the third selector valve unit 17 is in its third configuration the second pumping means 11 is fluidly connected to the third flow cell 3*c* only. When the third selector valve unit 17 is in a fourth configuration, the fourth valve 17*d* is opened and the first, second, and third valves 17*a,b,c* are closed; thus when the third selector valve unit 17 is in its fourth configuration the second pumping means 11 is fluidly connected to the fourth flow cell 3*d* only. When the third selector valve unit 17 is in a fifth configuration, the all of the first, second, third and fourth valves 17*a-d* are opened; thus when the third selector valve unit 17 is in its fifth configuration the second pumping means 11 is fluidly connected to all of the flow cells 3*a-d*.

In a further variation of this embodiment the third selector valve unit 17, instead of providing first, second, third and fourth switching valves 17*a-d*, the third selector valve unit 17 may comprise a rotary valve with customized stator and rotor layout for achieving the same fluid connections as those achieved by the above-mentioned five configurations.

The assembly 101 further comprises the following optional features: a moveable stage 2'; a sample holder tray 1; and a wash station 28.

The sample holder tray 1 comprises a plurality of reservoirs 1', each of which can hold a fluid. In this example the sample holder tray 1 comprises a series of rows of reservoirs 1'; each row comprises n reservoirs 1'. In other words the number of reservoirs 1' in a row correspond to the number of hollow needles 2*a-h* in the needle unit 2. Accordingly, each row comprises eight reservoirs 1*a-h*. Each reservoir 1*a-d* of each row is configured (in particular is dimensioned) such that each of hollow needles 2*a-h* in the needle unit 2 can be inserted into the a respective reservoir 1*a-h* in a row, so that fluid in each respective reservoir 1*a-h* in a row can be aspirated into a respective hollow needles 2*a-h* of the needle unit 2.

The wash station 28 is configured to such that it can wash the hollow needles 2*a-h* of the needle unit 2. The wash station 28 may comprise any suitable configuration. Suitable constructions of wash stations are also known in the art. The wash station 28 may comprise m wells each comprising drains for removing excess liquid which is contained in the hollow needles 2*a-h*; and/or may comprise inputs means which can provide clearing liquids into said hollow needles 2*a-h*. Optionally, the wash station 28 may comprise several sections, such as a first section for washing the hollow needles 2*a-h* with a cleaning liquid such as a detergent, and a second section for rinsing hollow needles 2*a-h* with a buffer.

The moveable stage 2' is operable selectively move the needle unit 2 between a first position wherein the needle unit 2 is arranged over the sample holder tray 1 so that each of hollow needles 2*a-h* in the needle unit 2 can be inserted into the a respective reservoir 1*a-h* in a row, so that fluid in each respective reservoir 1*a-h* in a row can be aspirated into a respective hollow needles 2*a-h* of the needle unit 2; and a second position, where the needle unit 2 is located at the wash station 28 where the needles 2*a-h* can be washed. The moveable stage 2' may have any suitable configuration. For example the moveable stage 2' may be defined by a robotic arm which can hold and can move the needle unit 2 between said first and second positions; and/or the moveable stage 2' may be defined by xyz table on which the needle unit 2 is mounted and which can move the needle unit 2 between said first and second positions. In the above example the sample holder tray 1 and wash station 28 have a fixed position and the needle unit 2 is moved (by the moveably stage 2') with respect to the sample holder tray 1 and wash station 28; in a variation of this embodiment the needle unit 2 has a fixed position, and the sample holder tray 1 and wash station 28 are moved with respect to the needle unit 2.

It is understood that in the assembly 101 each of the conduits in the assembly 101 may comprise tubing, such as PEEK or PFA or stainless steel tubings. For example the buffer conduits 8*a*-8*h* may each comprise tubing with an internal volume between 10 microliters and 1000 microliters.

The assembly 101 can be used to perform a method of screening a plurality of sample fluids to identify if any one or more of said sample fluids contain molecules which can bind to predefined ligands (said predefined ligands being of the type provided on the test surfaces of one or more of the flow cells 3*a*-*d*) according to an embodiment of the present invention:

During use a sample holder tray 1 which comprises a plurality of reservoirs 1' is provided; sample fluids are provided in at least some of the reservoirs 1'. In the example shown in FIG. 1, the sample holder tray 1 comprises a series of rows of reservoirs 1'; in at least one of the rows all of the reservoirs 1' in that row are provided with sample fluids which are to undergo screening. Preferably in at least two of the rows all of the reservoirs 1' in those two rows are provided with sample fluids which are to undergo screening. Most preferably sample fluids are provided in all of the reservoirs 1' of said sample holder tray 1.

Different sample fluids may be provided in each respective reservoir 1'; in other words the sample fluids provided in said different reservoirs 1' may have different compositions (however this is not essential; it could be that some of the sample fluids in different reservoirs 1' have the same composition). In this example the different sample fluids having different compositions are provided in said respective reservoirs 1': In a first row of reservoirs, a first sample fluid is provided in a first reservoir 1*a*' of that row; a second sample fluid is provided in a second reservoir 1*b*' of said row; a third sample fluid is provided in a third reservoir 1*c*' of said row; a fourth sample fluid is provided in a fourth reservoir 1*d*' of said row; a fifth sample fluid is provided in a fifth reservoir 1*e*' of said row; a sixth sample fluid is provided in a sixth reservoir 1*f*' of said row; a seventh sample fluid is provided in a seventh reservoir 1*g*' of said row; an eighth sample fluid is provided in an eighth reservoir 1*h*' of said row.

The needle unit 2 is then arranged so that each of the respective n hollow needles 2 is simultaneously inserted into a respective reservoir 1*a*-*h*; specifically the needle unit 2 is arranged so that, the first hollow needle 2*a* is inserted into said first reservoir 1*a*', the second hollow needle 2*b* is inserted into said second reservoir 1*b*', the third hollow needle 2*c* is inserted into said third reservoir 1*c*', the fourth hollow needle 2*d* is inserted into said fourth reservoir 1*d*', the fifth hollow needle 2*e* is inserted into said fifth reservoir 1*e*', the sixth hollow needle 2*f* is inserted into said sixth reservoir 1*f*, the seventh hollow needle 2*g* is inserted into said seventh reservoir 1*g*', the eighth hollow needle 2*h* is inserted into said eighth reservoir 1*h*'. At least the tip of each hollow needle 2*a*-*h* is submerged in the respective sample fluids contained in the respective reservoirs 1*a*'-*h*'. It should be noted that the moveable stage 2' may move the needle unit 2 into a position wherein each of the respective n hollow needles 2 are simultaneously inserted into a respective reservoir 1*a*-*h*.

Preferably the second selector valve unit 6 is then moved into its sixth position wherein all of the first, second, third and fourth valves 6*a*-*d* of the second selector valve unit 6 are closed. The second valve 22 is also configured to be closed, so that the first valve 22 can block the flow of fluid from the second junction 105 into the second waste reservoir 24. When the second selector valve unit 6 is in its sixth position and the second valve 22 is closed, the flow of fluids along the n injection conduits 9*a*-*h* is restricted; accordingly fluids flowing from the hollow needles 2*a*-*h* into the n inputs 7*a*'-7*h*' of the first set 107' of inputs of the switching valve unit 7, will flow into the respective buffer conduits 8*a*-*h* via the n inputs 7*a*"-7*h*" of the second set 107" of inputs of the switching valve unit 7.

The switching valve unit 7 is arranged in its first configuration (if the switching valve unit 7 is not already arranged in its first configuration) so that the switching valve unit 7 simultaneously fluidly connects each of the n inputs 7*a*'-7*h*' of the first set 107' of inputs with a respective n output 7*a*'''-7*h*''' (specifically the switching valve unit 7 simultaneously fluidly connects all of the first, second, third, fourth, fifth, sixth, seventh and eight inputs 7*a*'-7*h*' of the first set 107' of inputs with the respective first, second, third, fourth, fifth, sixth, seventh and eighth outputs 7*a*'''-7*h*''').

The first selector valve unit 4 is then arranged into its ninth configuration, such that the first selector valve unit 4 fluidly connect its single input 4' with all of its n outputs; specifically the first selector valve unit 4 is arranged so that all of its first, second, third, fourth, fifth, sixth, seventh and eighth outputs 4*a*-*h* are simultaneously fluidly connected to the single input 4'. When the first selector valve unit 4 is in its ninth configuration, the single pumping means 12 is simultaneously fluidly connected to each of said first, second, third, fourth, fifth, sixth, seventh and eighth outputs 4*a*-*h* of the first selector valve unit 4.

The single pumping means 12 is then configured to provide a negative pressure (e.g. negative fluid pressure) so that the respective sample fluids in each of said respective reservoirs 1*a*'-*h* in said row are aspirated, simultaneously, into said respective hollow needles 2*a*-*h*; and said respective sample fluids are forced to simultaneously flow out of the respective hollow needles 2*a*-*h* and through the switching valve unit 7. In this example the respective sample fluids in each of said respective reservoirs 1*a*'-*h* in said row are aspirated, simultaneously, into said respective hollow needles 2*a*-*h*; and said respective sample fluids are forced to simultaneously flow out of the respective hollow needles 2*a*-*h* and through the switching valve unit 7, and out of the switching valve unit 7 via the n inputs 7*a*"-7*h*" of the second set 107" of inputs of the switching valve unit 7, into the respective buffer conduits 8*a*-*h*.

Specifically, the first sample fluid present in the first reservoir 1*a* is aspirated into the first hollow needle 2*a* of said needle unit 2, and from there the negative pressure forces the first immobilization reagent to flow through the first hollow needle 2*a*, through the switching valve unit 7, and into the first buffer conduit 8*a*; the second sample fluid present in the second reservoir 1*b* is aspirated into the second hollow needle 2*b* and from there the negative pressure forces the second sample fluid to flow through the second hollow needle 2*b*, through the switching valve unit 7, and into the second buffer conduit 8*b*; the third sample fluid present in the third reservoir 1*c* is aspirated into the third hollow needle 2*c* and from there the negative pressure forces the third sample fluid to flow through the third hollow needle 2*c*, through the switching valve unit 7, and into the third buffer conduit 8*c*; the fourth sample fluid present in the fourth reservoir 1*d* is aspirated into the fourth hollow needle 2*d* and from there the negative pressure forces the fourth sample fluid to flow through the fourth hollow needle 2*d*, through the switching valve unit 7, and into the fourth buffer conduit 8*d*; the fifth sample fluid present in the fifth reservoir 1*e* is aspirated into the fifth hollow needle 2*e* and from there the negative pressure forces the fifth sample fluid to flow through the fifth hollow needle 2*e*, through the switching valve unit 7, and into the fifth buffer conduit 8*e*; the sixth sample fluid present in the sixth reservoir if is aspirated into the sixth hollow needle 2*f* and from there the negative pressure forces the sixth sample fluid to flow through the sixth hollow needle 2*f*, through the switching valve unit 7, and into the sixth buffer conduit 8*f*; the seventh sample fluid present in the seventh reservoir 1*g* is aspirated into the seventh needle 2*g*, and from there the negative pressure forces the seventh sample fluid to flow through the seventh hollow needle 2*g*, through the switching valve unit 7, and into the seventh buffer conduit 8*g*; the eighth sample fluid present in the eighth reservoir 1*h*' is aspirated into the eighth hollow needle 2*h* and from there the negative pressure forces the eighth sample fluid to flow through the eighth hollow needle 2*h*, through the switching valve unit 7, and into the eighth buffer conduit 8*h*.

Accordingly after this step has been performed the first, second, third, fourth, fifth, sixth, seventh, and eighth sample fluids are present in the respective first, second, third, fourth, fifth, sixth, seventh, and eighth buffer conduits 8*a-f*.

The switching valve unit 7 then arranged in its second configuration so that the switching valve unit 7 blocks the flow of fluid between said n inputs 7*a*'-7*h*' of the first set 107' of inputs and the n outputs 7*a*'''-7*h*'''. In this second configuration the switching valve unit 7 prevents fluid, which is present at any of the n outputs 7*a*'''-7*h*''' or which is present in any of the n buffer conduits 8*a-f*, from flowing back into the hollow needles 2*a-h*.

The first selector valve unit 4 it then arranged into its first configuration, so that the first selector valve unit 4 fluidly connect its single input 4' with the first output 4*a* only of the first selector valve unit 4. When the first selector valve unit 4 is in its first configuration, the single pumping means 12 is fluidly connected to said first output 4*a* only of the first selector valve unit 4.

Preferably the second selector valve unit 6 is also moved into its fifth position, so that all of the first, second, third and fourth valves 6*a-d* of the second selector valve unit 6 are opened, thereby fluidly connecting all of the outputs 3*a*"-3*d*" of all of the flow cells 3*a-d* in the flow cell unit 3 with the first waste reservoir 23.

The single pumping means 12 is then configured to provide a positive pressure; the positive pressure forces the first sample fluid present in the first buffer conduit 8*a*, to flow through all of the m flow cells 3*a-d*. Specifically the positive pressure provided by the single pumping means 12 flows through the single input 4' of the first selector valve unit 4, and then into the first output 4*a* first selector valve unit 4, and from the first output 4*a* of the first selector valve unit 4 into the first buffer conduit 8*a* where the positive pressure pushes the first sample fluid along the first buffer conduit 8*a*, into the first input 7*a*" of the second set 107" of inputs of the switching valve unit 7, and then into the first injection conduit 9*a* via the first output 7*a*''' of the switching valve unit 7, along the first injection conduit 9*a*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the first sample fluid will contact the test surfaces of each of the first, second, third and fourth flow cells 3*a-d*; and more specifically will contact ligands which are present on said respective test surfaces. If the first sample fluid contains molecules which can bind to the ligands which are on the test surfaces of any the first, second, third and fourth flow cells 3*a-d*, these molecules will become bound to those ligands when the first sample fluid flows through that flow cell.

Most preferably the assembly 101 further comprises a sensor 50 which can detect if molecules of a sample fluid have become bound to ligands on the test surfaces of a flow cell. As the first sample fluid flows through the first, second, third and fourth flow cells 3*a-d*, this sensor 50 is operated to detect if molecules of the first sample fluid have become bound to ligands on the test surfaces of any of the first, second, third or fourth flow cells 3*a-d*.

The first sample fluid will flow out of the respective first, second, third and fourth flow cells 3*a-d*, via the respective outputs 3*a*"-3*d*" of the respective flow cells 3*a-d*. The first sample fluid which flows out of the first flow cell 3*a* will flow through the first valve 6*a* of the second selector valve unit 6, and into the first waste reservoir 23; the first sample fluid which flows out of the second flow cell 3*b* will flow through the second valve 6*b* of the second selector valve unit 6, and into the first waste reservoir 23; the first sample fluid which flows out of the third flow cell 3*c* will flow through the third valve 6*c* of the second selector valve unit 6, and into the first waste reservoir 23; the first sample fluid which flows out of the fourth flow cell 3*d* will flow through the fourth valve 6*d* of the second selector valve unit 6, and into the first waste reservoir 23.

Optionally, the flow cells 3*a-d* in the flow cell unit 3 are then rinsed in a rinsing step: The second pumping means 11 may be selectively configured to dispense buffer fluid which can be used to rinse the flow cells 3*a-d*. In order to rinse the flow cells 3*a-d* the first pumping means 12 is configured so that it does not provide any positive or negative pressure (e.g. the first pumping means 12 is turned off); the second selector valve unit 6 is moved into its sixth position wherein all of the first, second, third and fourth valves 6*a-d* of the second selector valve unit 6 are closed; the first valve 22 is configured to be in its open configuration so that fluid can flow from the second junction 105 through the first valve 22 and into the second waste reservoir 24; the third selector valve unit 17 is arranged into it fifth configuration so that the second pumping means 11 is fluidly connected to all of the flow cells 3*a-d*. The second pumping means 11 is then operated to dispense buffer fluid. Specifically, the second pumping means 11 is typically first emptied by configuring the switching valve 11*b* to fluidly connect the syringe 11*a* to the waste reservoir 11*d*, and then dispensing the fluid contents of the syringe 11*a* into the waste reservoir 11*d*. Then the switching valve 11*b* is configured to fluidly connect the syringe 11*a* to the buffer reservoir 11*c*, so as to allow buffer fluid which is preset in the buffer reservoir 11*c*, to pass from the buffer reservoir 11*c* to the syringe 11*a*. The syringe 11*a* is then filled with buffer fluid from the buffer reservoir 11*c* by aspirating buffer fluid from the buffer reservoir 11*c*. The switching valve 11*b* is then configured to fluidly connect the syringe 11*a* to the output 11*e*; the buffer fluid contained in the syringe 11*a* is then dispensed from the syringe 11*a*.

The buffer fluid flows from the second pumping means 11, through all of the valves 17*a-d* of the third selector valve unit 17, along the buffer inlet conduits 16*a*, 16*b*, 16*c*, 16*d*, and into all of the flow cells 3*a-d* in the flow cell unit 3 via the subsidiary conduits 19*a*, 19*b*, 19*c*, 19*d*. Since the second selector valve unit 6 is in its sixth position the buffer fluid will be prevented from flowing along the subsidiary conduits 19*a*, 19*b*, 19*c*, 19*d* and into the first waste reservoir 23, thus the buffer fluid is forced to flow along the subsidiary conduits 19*a*, 19*b*, 19*c*, 19*d* to the flow cells 3*a-d*. When the buffer fluid flows through the flow cells 3*a-d* it will rinse the flow cells 3*a-d*. The buffer fluid flows through the flow cells 3*a-d* and along the single conduit 5', through the second junction 105, through the first valve 22 (which is opened) and into the second waste reservoir 24. Preferably, the assembly is kept in this configuration for a predefined amount of time until the flow cells 3*a-d* have been rinsed for said predefined amount of time. Accordingly the second pumping means 11 is maintained in its configuration where it dispenses buffer fluid for said predefined amount of time. After said predefined amount of time has lapsed, the second pumping means 11 is configured to stop dispensing buffer fluid (e.g. the second pumping means 11 is turned off); and the first valve 22 is configured to be in its closed configuration so that it blocks the flow of fluid from the second junction 105 into the second waste reservoir 24.

The first selector valve unit 4 it then arranged into its second configuration, so that the first selector valve unit 4 fluidly connect its single input 4' with the second output 4*b* only of the first selector valve unit 4. When the first selector valve unit 4 is in its second configuration, the single pumping means 12 is fluidly connected to said second output 4*b* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the second sample fluid present in the second buffer conduit 8*b*, to flow through all of the m flow cells 3*a-d*. Specifically the positive pressure provided by the single pumping mean 12 flows through the single input 4' of the first selector valve unit 4, and then into the second output 4*b* of the first selector valve unit 4, and from the second output 4*b* of the first selector valve unit 4 into the second buffer conduit 8*b* where the positive pressure pushes the second sample fluid along the second buffer conduit 8*b*, into the second input 7*b*" of the second set 107" of inputs of the switching valve unit 7, and then into the second injection conduit 9*b* via the second output 7*b*'" of the switching valve unit 7, along the second injection conduit 9*b*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the second sample fluid will contact the test surfaces of each of the first, second, third and fourth flow cells 3*a-d*; and more specifically will contact ligands which are present on said respective test surfaces. If the second sample fluid contains molecules which can bind to the ligands which are on the test surfaces of any the first, second, third and fourth flow cells 3*a-d*, these molecules will become bound to those ligands when the second sample fluid flows through that flow cell.

As the second sample fluid flows through the first, second, third and fourth flow cells 3*a-d*, this sensor 50 is operated to detect if molecules of the second sample fluid have become bound to ligands on the test surfaces of any of the first, second, third or fourth flow cells 3*a-d*.

The second sample fluid will flow out of the respective first, second, third and fourth flow cells 3*a-d*, via the respective outputs 3*a*"-3*d*" of the respective flow cells 3*a-d*. The second sample fluid which flows out of the first flow cell 3*a* will flow through the first valve 6*a* of the second selector valve unit 6, and into the first waste reservoir 23; the second sample fluid which flows out of the second flow cell 3*b* will flow through the second valve 6*b* of the second selector valve unit 6, and into the first waste reservoir 23; the second sample fluid which flows out of the third flow cell 3*c* will flow through the third valve 6*c* of the second selector valve unit 6, and into the first waste reservoir 23; the second sample fluid which flows out of the fourth flow cell 3*d* will flow through the fourth valve 6*d* of the second selector valve unit 6, and into the first waste reservoir 23.

Optionally, the above-mentioned rinsing step is performed again.

The first selector valve unit 4 it then arranged into its third configuration, so that the first selector valve unit 4 fluidly connect its single input 4' with the third output 4*c* only of the first selector valve unit 4. When the first selector valve unit 4 is in its third configuration, the single pumping means 12 is fluidly connected to said third output 4*c* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the third sample fluid present in the third buffer conduit 8*c*, to flow through all of the m flow cells 3*a-d*. Specifically the positive pressure provided by the single pumping mean 12 flows through the single input 4' of the first selector valve unit 4, and then into the third output 4*c* of the first selector valve unit 4, and from the third output 4*c* of the first selector valve unit 4 into the third buffer conduit 8*c* where the positive pressure pushes the third sample fluid along the third buffer conduit 8*c*, into the s third input 7*c*" of the second set 107" of inputs of the switching valve unit 7, and then into the third injection conduit 9*c* via the third output 7*b*'" of the switching valve unit 7, along the third injection conduit 9*c*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the third sample fluid will contact the test surfaces of each of the first, second, third and fourth flow cells 3*a-d*; and more specifically will contact ligands which are present on said respective test surfaces. If the third sample fluid contains molecules which can bind to the ligands which are on the test surfaces of any the first, second, third and fourth flow cells 3*a-d*, these molecules will become bound to those ligands when the third sample fluid flows through that flow cell.

As the third sample fluid flows through the first, second, third and fourth flow cells 3*a-d*, this sensor 50 is operated to detect if molecules of the third sample fluid have become bound to ligands on the test surfaces of any of the first, second, third or fourth flow cells 3*a-d*.

The third sample fluid will flow out of the respective first, second, third and fourth flow cells 3*a-d*, via the respective outputs 3*a*"-3*d*" of the respective flow cells 3*a-d*. The third sample fluid which flows out of the first flow cell 3*a* will flow through the first valve 6*a* of the second selector valve unit 6, and into the first waste reservoir 23; the third sample fluid which flows out of the second flow cell 3*b* will flow through the second valve 6*b* of the second selector valve unit 6, and into the first waste reservoir 23; the third sample fluid which flows out of the third flow cell 3*c* will flow through the third valve 6*c* of the second selector valve unit 6, and into the first waste reservoir 23; the third sample fluid which flows out of the fourth flow cell 3*d* will flow through the fourth valve 6*d* of the second selector valve unit 6, and into the first waste reservoir 23.

Optionally, the above-mentioned rinsing step is performed again.

The first selector valve unit 4 it then arranged into its fourth configuration, so that the first selector valve unit 4 fluidly connects its single input 4' with the fourth output 4*d* only of the first selector valve unit 4. When the first selector valve unit 4 is in its fourth configuration, the single pumping means 12 is fluidly connected to said fourth output 4*d* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the fourth sample fluid present in the fourth buffer conduit 8*d*, to flow through all of the m flow cells 3*a-d*. Specifically the positive pressure provided by the single pumping mean 12 flows through the single input 4' of the first selector valve unit 4, and then into the fourth output 4*d* of the first selector valve unit 4, and from the fourth output 4*d* of the first selector valve unit 4 into the fourth buffer conduit 8*d* where the positive pressure pushes the fourth sample fluid along the fourth buffer conduit 8*d*, into the fourth input 7*d*" of the second set 107" of inputs of the switching valve unit 7, and then into the fourth injection conduit 9*d* via the fourth output 7*d*'" of the switching valve unit 7, along the fourth injection conduit 9*d*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the fourth sample fluid will contact the test surfaces of each of the first, second, third and fourth flow cells 3*a-d*; and more specifically will contact ligands which are present on said respective test surfaces. If the fourth sample fluid contains molecules which can bind to the ligands which are on the test surfaces of any the first, second, third and fourth flow cells 3*a-d*, these molecules will become bound to those ligands when the fourth sample fluid flows through that flow cell.

As the fourth sample fluid flows through the first, second, third and fourth flow cells 3*a-d*, this sensor 50 is operated to detect if molecules of the fourth sample fluid have become bound to ligands on the test surfaces of any of the first, second, third or fourth flow cells 3*a-d*.

The fourth sample fluid will flow out of the respective first, second, third and fourth flow cells 3*a-d*, via the respective outputs 3*a*"-3*d*" of the respective flow cells 3*a-d*. The fourth sample fluid which flows out of the first flow cell 3*a* will flow through the first valve 6*a* of the second selector valve unit 6, and into the first waste reservoir 23; the fourth sample fluid which flows out of the second flow cell 3*b* will flow through the second valve 6*b* of the second selector valve unit 6, and into the first waste reservoir 23; the fourth sample fluid which flows out of the third flow cell 3*c* will flow through the third valve 6*c* of the second selector valve unit 6, and into the first waste reservoir 23; the fourth sample fluid which flows out of the fourth flow cell 3*d* will flow through the fourth valve 6*d* of the second selector valve unit 6, and into the first waste reservoir 23.

Optionally, the above-mentioned rinsing step is performed again.

The first selector valve unit 4 it then arranged into its fifth configuration, so that the first selector valve unit 4 fluidly connect its single input 4' with the fifth output 4*e* only of the first selector valve unit 4. When the first selector valve unit 4 is in its firth configuration, the single pumping means 12 is fluidly connected to said fifth output 4*e* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the fifth sample fluid present in the fifth buffer conduit 8*e*, to flow through all of the m flow cells 3*a-d*. Specifically the positive pressure provided by the single pumping mean 12 flows through the single input 4' of the first selector valve unit 4, and then into the fifth output 4*e* of the first selector valve unit 4, and from the fifth output 4*e* of the first selector valve unit 4 into the fifth buffer conduit 8*e* where the positive pressure pushes the fifth sample fluid along the fifth buffer conduit 8*e*, into the fifth input 7*e*" of the second set 107" of inputs of the switching valve unit 7, and then into the fifth injection conduit 9*e* via the fifth output 7*e*'" of the switching valve unit 7, along the fifth injection conduit 9*e*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the fifth sample fluid will contact the test surfaces of each of the first, second, third and fourth flow cells 3*a-d*; and more specifically will contact ligands which are present on said respective test surfaces. If the fifth sample fluid contains molecules which can bind to the ligands which are on the test surfaces of any the first, second, third and fourth flow cells 3*a-d*, these molecules will become bound to those ligands when the fifth sample fluid flows through that flow cell.

As the fifth sample fluid flows through the first, second, third and fourth flow cells 3*a-d*, this sensor 50 is operated to detect if molecules of the fifth sample fluid have become bound to ligands on the test surfaces of any of the first, second, third or fourth flow cells 3*a-d*.

The fifth sample fluid will flow out of the respective first, second, third and fourth flow cells 3*a-d*, via the respective outputs 3*a*"-3*d*" of the respective flow cells 3*a-d*. The fifth sample fluid which flows out of the first flow cell 3*a* will flow through the first valve 6*a* of the second selector valve unit 6, and into the first waste reservoir 23; the fifth sample fluid which flows out of the second flow cell 3*b* will flow through the second valve 6*b* of the second selector valve unit 6, and into the first waste reservoir 23; the fifth sample fluid which flows out of the third flow cell 3*c* will flow through the third valve 6*c* of the second selector valve unit 6, and into the first waste reservoir 23; the fifth sample fluid which flows out of the fourth flow cell 3*d* will flow through the fourth valve 6*d* of the second selector valve unit 6, and into the first waste reservoir 23.

Optionally, the above-mentioned rinsing step is performed again.

The first selector valve unit 4 it then arranged into its sixth position, so that the first selector valve unit 4 fluidly connects its single input 4' with the sixth output 4*f* only of the first selector valve unit 4. When the first selector valve unit 4 is in its sixth configuration, the single pumping means 12 is fluidly connected to said sixth output 4*f* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the sixth sample fluid present in the sixth buffer conduit 8*f*, to flow through all of the m flow cells 3*a-d*. Specifically the positive pressure provided by the single pumping mean 12 flows through the single input 4' of the first selector valve unit 4, and then into the sixth output 4*f* of the first selector valve unit 4, and from the sixth output 4*f* of the first selector valve unit 4 into the sixth buffer conduit 8*f* where the positive pressure pushes the sixth sample fluid along the sixth buffer conduit 8*f*, into the sixth input 7*e*" of the second set 107" of inputs of the switching valve unit 7, and then into the sixth injection conduit 9*f* via the sixth output 7*f*'" of the switching valve unit 7, along the sixth injection conduit 9*f*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the sixth sample fluid will contact the test surfaces of each of the first, second, third and fourth flow cells 3*a-d*; and more specifically will contact ligands which are present on said respective test surfaces. If the sixth sample fluid contains molecules which can bind to the ligands which are on the test surfaces of any the first, second, third and fourth flow cells 3*a-d*, these molecules will become bound to those ligands when the sixth sample fluid flows through that flow cell.

As the sixth sample fluid flows through the first, second, third and fourth flow cells 3*a-d*, this sensor 50 is operated to detect if molecules of the sixth sample fluid have become bound to ligands on the test surfaces of any of the first, second, third or fourth flow cells 3*a-d*.

The sixth sample fluid will flow out of the respective first, second, third and fourth flow cells 3*a-d*, via the respective outputs 3*a*"-3*d*" of the respective flow cells 3*a-d*. The sixth sample fluid which flows out of the first flow cell 3*a* will flow through the first valve 6*a* of the second selector valve unit 6, and into the first waste reservoir 23; the sixth sample fluid which flows out of the second flow cell 3*b* will flow through the second valve 6*b* of the second selector valve unit 6, and into the first waste reservoir 23; the sixth sample fluid which flows out of the third flow cell 3*c* will flow through the third valve 6*c* of the second selector valve unit 6, and into the first waste reservoir 23; the sixth sample fluid which flows out of the fourth flow cell 3*d* will flow through the fourth valve 6*d* of the second selector valve unit 6, and into the first waste reservoir 23.

Optionally, the above-mentioned rinsing step is performed again.

The first selector valve unit 4 it then arranged into its seventh configuration, so that the first selector valve unit 4 fluidly connect its single input 4' with the seventh output 4*g* of the first selector valve unit 4. When the first selector valve unit 4 is in its seventh configuration, the single pumping means 12 is fluidly connected to said seventh output 4*g* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the seventh sample fluid present in the seventh buffer conduit 8*g*, to flow through all of the m flow cells 3*a-d*. Specifically the positive pressure provided by the single pumping mean 12 flows through the single input 4' of the first selector valve unit 4, and then into the seventh output 4*g* of the first selector valve unit 4, and from the seventh output 4*g* of the first selector valve unit 4 into the seventh buffer conduit 8*g* where the positive pressure pushes the seventh sample fluid along the seventh buffer conduit 8*g*, into the seventh input 7*g*" of the second set 107" of inputs of the switching valve unit 7, and then into the seventh injection conduit 9*g* via the seventh output 7*g*'" of the switching valve unit 7, along the seventh injection conduit 9*g*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the seventh sample fluid will contact the test surfaces of each of the first, second, third and fourth flow cells 3*a-d*; and more specifically will contact ligands which are present on said respective test surfaces. If the seventh sample fluid contains molecules which can bind to the ligands which are on the test surfaces of any the first, second, third and fourth flow cells 3*a-d*, these molecules will become bound to those ligands when the seventh sample fluid flows through that flow cell.

As the seventh sample fluid flows through the first, second, third and fourth flow cells 3*a-d*, this sensor 50 is operated to detect if molecules of the seventh sample fluid have become bound to ligands on the test surfaces of any of the first, second, third or fourth flow cells 3*a-d*.

The seventh sample fluid will flow out of the respective first, second, third and fourth flow cells 3*a-d*, via the respective outputs 3*a*"-3*d*" of the respective flow cells 3*a-d*. The seventh sample fluid which flows out of the first flow cell 3*a* will flow through the first valve 6*a* of the second selector valve unit 6, and into the first waste reservoir 23; the seventh sample fluid which flows out of the second flow cell 3*b* will flow through the second valve 6*b* of the second selector valve unit 6, and into the first waste reservoir 23; the seventh sample fluid which flows out of the third flow cell 3*c* will flow through the third valve 6*c* of the second selector valve unit 6, and into the first waste reservoir 23; the seventh sample fluid which flows out of the fourth flow cell 3*d* will flow through the fourth valve 6*d* of the second selector valve unit 6, and into the first waste reservoir 23.

Optionally, the above-mentioned rinsing step is performed again.

The first selector valve unit 4 it then arranged into its eighth configuration, so that first selector valve unit 4 fluidly connect its single input 4' with the eighth output 4*h* only of the first selector valve unit 4. When the first selector valve unit 4 is in its eighth configuration, the single pumping means 12 is fluidly connected to said eighth output 4*h* only of the first selector valve unit 4. (The switching valve unit 7 is maintained in its second configuration, and the second selector valve unit 6 is maintained in its fifth position).

The single pumping means 12 is then configured to provide a positive pressure; the positive pressure forces the eighth sample fluid present in the eighth buffer conduit 8*h*, to flow through all of the m flow cells 3*a-d*. Specifically the positive pressure provided by the single pumping mean 12 flows through the single input 4' of the first selector valve unit 4, and then into the eighth output 4*h* of the first selector valve unit 4, and from the eighth output 4*h* of the first selector valve unit 4 into the eighth buffer conduit 8*h* where the positive pressure pushes the eighth sample fluid along the eighth buffer conduit 8*h*, into the eighth input 7*h*" of the second set 107" of inputs of the switching valve unit 7, and then into the eighth injection conduit 9*h* via the eighth output 7*h*'" of the switching valve unit 7, along the eighth injection conduit 9*h*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the eighth sample fluid will contact the test surfaces of each of the first, second, third and fourth flow cells 3*a-d*; and more specifically will contact ligands which are present on said respective test surfaces. If the eighth sample fluid contains molecules which can bind to the ligands which are on the test surfaces of any the first, second, third and fourth flow cells 3*a-d*, these molecules will become bound to those ligands when the eighth sample fluid flows through that flow cell.

As the eighth sample fluid flows through the first, second, third and fourth flow cells 3*a-d*, this sensor 50 is operated to detect if molecules of the eighth sample fluid have become bound to ligands on the test surfaces of any of the first, second, third or fourth flow cells 3*a-d*.

The eighth sample fluid will flow out of the respective first, second, third and fourth flow cells 3*a-d*, via the respective outputs 3*a*"-3*d*" of the respective flow cells 3*a-d*. The eighth sample fluid which flows out of the first flow cell 3*a* will flow through the first valve 6*a* of the second selector valve unit 6, and into the first waste reservoir 23; the eighth sample fluid which flows out of the second flow cell 3*b* will flow through the second valve 6*b* of the second selector valve unit 6, and into the first waste reservoir 23; the eighth sample fluid which flows out of the third flow cell 3*c* will flow through the third valve 6*c* of the second selector valve unit 6, and into the first waste reservoir 23; the eighth sample fluid which flows out of the fourth flow cell 3*d* will flow through the fourth valve 6*d* of the second selector valve unit 6, and into the first waste reservoir 23.

Optionally, the above-mentioned rinsing step is performed again.

Advantageously, in the present embodiment, rapid screening of a plurality of sample fluids, to identify if any one or more of said sample fluids have molecules which can bind to predefined ligands (said predefined ligands being of the type provided on the test surfaces of one or more of the flow cells 3*a-d*) can be achieved. In this example each of the eight sample fluids which were present in the respective reservoirs 1*a-h* of a first row of the sample tray holder 1 are passed consecutively, without any substantial delay between sample fluids, through the flow cells 3*a-d* in the flow cell unit 3, and the sensor 50 is used to detect if the molecules bind to ligands on the test surfaces of the flow cells as each respective sample fluid is passed through the flow cells 3*a-d*.

In a preferred embodiment, the respective sample fluids are flowed through the flow cells 3*a-d* in rapid succession, this is to ensure that the molecules of the sample fluids contact the same test surface (of the flow cells 3*a-d*) in rapid succession. Preferably, the time period between passing flowing consecutive sample fluids through the flow cells 3*a-d* is less than 10 seconds, or is preferably is less than below 5 seconds, or is more preferably is less than 2 seconds, or is most preferably is less than 1 second. For example the time period between the time when the single pumping means 12 is configured to provide a positive pressure which forces the first sample fluid present in the first injection conduit 9*a*, to flow through all of the m flow cells 3*a-d*, and the time when the single pumping means 12 is configured to provide a positive pressure which forces the second sample fluid present in the second injection conduit 9*b*, to flow through all of the m flow cells 3*a-d*, is less than 10 seconds (or is preferably is less than below 5 seconds, or is more preferably is less than 2 seconds, or is most preferably is less than 1 second). Likewise the time period between the time when the single pumping means 12 is configured to provide a positive pressure which forces the second sample fluid present in the second injection conduit 9*c*, to flow through all of the m flow cells 3*a-d*, and the time when the single pumping means 12 is configured to provide a positive pressure which forces the third sample fluid present in the third injection conduit 9*c*, to flow through all of the m flow cells 3*a-d*, is less than 10 seconds (or is preferably is less than below 5 seconds, or is more preferably is less than 2 seconds, or is most preferably is less than 1 second). The same is true for all of the respective sample fluid—in other words, the time period between the time when the single pumping means 12 is configured to provide a positive pressure which forces a sample fluid present in an injection conduit, to flow through all of the m flow cells 3*a-d*, and the time when the single pumping means 12 is configured to provide a positive pressure which forces the next sample fluid present in an injection conduit, to flow through all of the m flow cells 3*a-d*, is less than 10 seconds (or is preferably is less than below 5 seconds, or is more preferably is less than 2 seconds, or is most preferably is less than 1 second).

In another preferred embodiment, in order to minimize sample dilution edge effects due to Taylor Aris dispersion, the single pumping means 12 dispenses buffer fluid at a high flowrate when it is configured to provide a positive pressure which forces sample fluid present in a injection conduit 9*a-h*, to flow through all of the flow cells 3*a-d*. Likewise the pumping means 11 dispenses buffer fluid at a high flowrate during the rinsing step. Preferably, the respective pumping means dispense buffer fluid at a flowrate above 500 microliters per minute, or above 1 millilitres per minute, or above 2 millilitres per minute, or above 5 millilitres per minute.

In a further preferred embodiment, the time-resolved sensor signals from the sensor 50 are recorded at a rate of more than 50 sensor signal data points per seconds, or more than 100 sensor signal data points per second, or more than 100 sensor signal data points per second, while sample fluids flow through all of the flow cells 3*a-d* or at least during the rinsing step; this allows to resolve fast transitions and fast off-rates.

Optionally, after all of the first, second, third, fourth, fifth, sixth, seventh, and eighth sample fluids have been passed through the flow cells 3*a-d* the needle unit 2 is moved (preferably by the moveably stage 2') to the washing station 28. At the washing station 28 the hollow needles 2*a-d* are washed to avoid contamination of sample fluids (residing in another, second, row of reservoirs 1*a-h* provided in the sample tray holder 1) which will be subsequently aspirated into the respective hollow needles 2*a-h* of the needle unit 2.

Preferably in order to wash the hollow needles 2*a-h* of the needle unit 2, the following steps may be carried out. First the hollow needles are preferably inserted into one or several wells of the washing station 28, then switching valve unit 7 is arranged in its first configuration and the first selector valve unit 4 is arranged into its ninth configuration, then the single pumping means 12 is configured to dispense buffer fluid which flows from the single pumping means 12, through all of the hollow needles 2*a-h* and into the wells of the washing station 28, so that the inside of all of the hollow needles 2*a-h* are rinsed. Preferably, when rinsing the inside of the hollow needles 2*a-h* the level of buffer fluid within said wells rises, effectively rinsing the outside of the hollow needles 2*a-h*. Excess buffer fluid is then removed by the drains of the wells. Optionally, for washing the hollow needles 2*a-h* with a cleaning liquid different from the buffer fluid in a first section of the wash station 28, first the hollow needles 2*a-h* are inserted into the wells corresponding to the first section of the wash station, then the cleaning liquid is injected into said wells through appropriate inputs by means of an auxiliary pumping means, then the switching valve unit 7 is arranged in its first configuration and the first selector valve unit 4 is arranged into its ninth configuration, then the single pumping means 12 is configured to execute several aspiration/dispense cycles such as the cleaning liquid is aspirated and dispensed through the hollow needles 2*a-h* several times. Excess liquid is then removed by the drains of the wells.

Preferably, after the hollow needles 2*a-h* have been washed the needle unit 2 is moved so that the hollow needles 2*a-h* are simultaneously inserted into another row of reservoirs 1*a*'-*h*' (each of which contain respective sample fluids to be screened); preferably said other row of reservoirs 1*a*'-1*h*' will be the row of reservoirs which is adjacent to the row of reservoirs 1*a*-1*h* into which the needles were last inserted. As before, at least the tip of each hollow needle 2*a-h* is submerged in the respective sample fluids contained in the respective reservoirs 1*a*'-*h*' of said other row. It should be noted that the moveable stage 2' may move the needle unit 2 into a position wherein each of the respective n hollow needles 2 are simultaneously inserted into said respective reservoirs 1*a*'-*h*' of said other row.

The afore mentioned steps are then repeated so that each of the sample fluids contained in said other row of reservoirs 1*a*'-*h*' are screened.

If the sample tray holder 1 comprises more than one other row of reservoirs which contain sample fluids which are to be screened then, preferably, the above-mentioned steps are repeated until the sample fluids contained in all of the rows of reservoirs have been screened.

In the above embodiment the sample fluids being aspirated into the hollow needles 2*a-h* from the sample tray holder 1, however it should be understood that this is not an essential step; in another embodiment, instead of the sample fluids being aspirated into the hollow needles 2*a-h* from the sample tray holder 1, the sample fluids are already present in one or more of said n hollow needles 2*a-h* of said needle unit 2. For example a first sample fluid is present in the first hollow needle 2*a*; a second sample fluid is present in the second hollow needle 2*b*; a third sample fluid is present in the first hollow needle 2*c*; a fourth sample fluid is present in the fourth hollow needle 2*d*; a fifth sample fluid is present in the fifth hollow needle 2*e*; a sixth sample fluid is present in the sixth hollow needle 2*f*; a seventh sample fluid is present in the seventh hollow needle 2*g*; an eighth sample fluid is present in the eighth hollow needle 2*h*.

Also It should be understood that the present invention is not limited to requiring that the sample fluids in each of the n hollow needles 2*a-h* be different sample fluids (i.e. different compositions); on the contrary in another embodiment some of the sample fluids in the n hollow needles 2*a-h* have the same composition e.g. two of more of the n hollow needles may have sample fluids which have the same composition. It can be that the composition of the sample fluids is entirely unknown. The sample fluids in each of the n hollow needles 2*a-h* could have come from the same or be different sources.

As mentioned above, the sensor 50 is operated to detect if molecules of a sample fluid have become bound to ligands on the test surfaces of any of the first, second, third or fourth flow cells 3*a-d*. One way to detect using the sensor 50 if molecules of a particular sample fluid have become bound to ligands on the test surface of any of a flow cell 3*a-d* is to compare an output signal of the sensor 50 to a reference output signal which is a signal which the sensor 50 outputs when said sample fluid flows through said flow cell, hereafter called reference flow cell, when no ligands are provided on its test surface. Alternatively, the test surface of the reference flow cell may contain reference ligands, such as ligands with similar characteristics as a test ligand but lacking a specific molecular structure relevant to a specific molecular binding. Thus, the method may further comprise the steps of, for each of the respective m (eight) sample fluids: passing that sample fluid through the reference flow cell; obtaining an output signal from the sensor 50 as the sample fluid passes through the reference flow cell, wherein this output signal defines a reference signal. Then any of the above-mentioned steps of operating the sensor 50 to detect if molecules of a sample fluid have become bound to ligands on the test surfaces of any of the first, second, third or fourth flow cells 3*a-d*, may comprise, obtaining an output signal from the sensor as the sample fluid passes through the first, second, third or fourth flow cells 3*a-d* (one or more of which are not the reference flow cell); and comparing said output signal with said reference signal. It is then determined that a molecule of said sample fluid has bound to the ligands of a flow cell if the output signal differs from the reference signal. Most preferably, the steps of passing that sample fluid through the reference flow cell and passing that sample fluid through one or more of the flow cells which are not the reference flow cell, are executed simultaneously. In other words, most preferable, in the assembly 101 one of the flow cells 3*a-d* in the flow cell unit may be a reference flow cell; and during the method of screening a plurality of sample fluids, the step of passing that sample fluid through the reference flow cell takes place simultaneously to passing that sample fluid through the other flow cells (which are not reference flow cells).

Optionally, prior to performing the method of screening a plurality of sample fluids, to identify if any one or more of said sample fluids have molecules which can bind to predefined ligands (said predefined ligands being of the type provided on the test surfaces of one or more of the flow cells 3*a-d*) described above, a further step of providing ligands on the respective test surfaces of one or more of said m flow cells 3*a-h* in said flow cell unit 3 may be performed.

50505050Most preferably such a further step of providing ligands on the respective test surfaces of one or more of said m flow cells 3*a-h* in said flow cell unit 3 would be performed prior to using the assembly 101 to screen one or more sample fluids for molecules which can bind to predefined ligands (said predefined ligands being of the type provided on the test surfaces of one or more of the flow cells 3*a-d*)), and even prior to providing sample fluids in said n hollow needles 2*a-h*. Most preferably the step of providing ligands on the respective test surfaces of one or more of said m flow cells 3*a-h* in said flow cell unit 3 comprises providing ligands on the test surfaces of a plurality (at least two) said flow cells 3*a-h* in said flow cell unit 3, wherein the type of ligands provided on the test surfaces differ between flow cells such that the test surfaces of said plurality of flow cells have different types of ligands.

In the following there will be described the steps carried out to provide: ligands of a first type, which can bind to a first type of molecule, are provided on the test surface of the first flow cell 3*a*; ligands of a second type, which can bind to a second type of molecule, are provided on the test surface of the second flow cell 3*b*; ligands of a third type, which can bind to a third type of molecule, are provided on the test surface of the third flow cell 3*c*; ligands of a fourth type, which can bind to a fourth type of molecule, are provided on the test surface of the fourth flow cell 3*d* (it should be understood that it is optional to provide ligands of a fourth type on the test surface of the fourth flow cell 3*d*; in a variation of this embodiment no ligands are provided on the test surface of the fourth flow cell 3*b*, so in other words the test surface of the fourth flow cell 3*b* is without any ligands):

A first immobilization reagent is provided in a first reservoir 1*a* of a row in said sample try holder 1. It should be understood that the first immobilization reagent may comprise any suitable immobilization reagent; for example the first immobilization reagent may comprise qa mixture of 1-Ethyl-3-(3-dimethylaminopropyl)carbodiimide (EDC) and N-hydroxysuccinimide (NHS) and/or Ethanolamine for amine coupling, and/or NiCl2 for His-Tag coupling, and/or any other suitable reagents. In this example the first immobilization reagent comprises a 1:1 mixture of EDC/NHS.

r different types of ligands are provided in respective r different reservoirs 1*a-h* of said row of said sample tray holder 1, wherein r is greater than one. As mentioned in this example four different types of ligands will be provided on the respective test surfaces of the respective flow cells 3*a-d* accordingly in this example r is four. It should be understood that r may have any value greater than one. In this example r is equal to m so four different types of ligands are provided in the respective second, third, fourth and fifth reservoirs 1*b*'-f' of said row (i.e. the same row to which said first reservoir 1*a*' belongs) of said sample tray holder 1:

Ligands of a first type (referred to hereafter as first ligands) are provided in the second reservoir 1*b* of said row. In this example said first ligands, optionally diluted in acetate buffer, are provided in the second reservoir 1*b*.

Ligands of a second type (referred to hereafter as second ligands) are provided in the third reservoir 1*c*. In this example said second ligands, optionally diluted in acetate buffer, are provided in the second reservoir 1*c*.

Ligands of a third type (referred to hereafter as third ligands) are provided in the fourth reservoir 1*d*'. In this example said third ligands, optionally diluted in acetate buffer, is provided in the fourth reservoir 1*d*'.

In this example ligands of a fourth type (referred to hereafter as fourth ligands) are provided in the fifth reservoir 1*e*. In this example said fourth ligands, optionally diluted in acetate buffer, are provided in the fifth reservoir 1*e*. In this particular example the fourth ligands are the same type as either the first, second, or third ligands, with the exception that the fourth ligands are modified (genetically) so that the fourth ligands lack any binding sites. However, it should be understood that it is optional to provide ligands of a fourth type in the fifth reservoir 1*e*; in a variation of this embodiment no ligands are provided on the test surface of the fourth flow cell 3*b*, in which case no ligands are provided in the fifth reservoir 1*e*.

A second immobilization reagent is provided in at least one of the remaining reservoirs 1*f-h* in said row. In this example the second immobilization reagent comprises Ethanolamine, however it will be understood that the second immobilization reagent may take any suitable form. In this example the second immobilization reagent is provided in the sixth reservoir 1*f* of said row.

Optionally a buffer is provided in the seventh and eighth reservoirs 1*g*, 1*h* of said row.

The needle unit 2 is then arranged so that each of the respective n hollow needles 2*a-h* is simultaneously inserted into a respective reservoir 1*a-h*; at least the tip of each hollow needle 2*a-h* is simultaneously submerged in the respective sample fluid contained in the respective reservoir 1*a-h* into which it is inserted. It should be noted that the moveable stage 2' may move the needle unit 2 into this position.

Preferably the second selector valve unit 6 is then moved into its sixth position wherein all of the first, second, third and fourth valves 6*a-d* of the second selector valve unit 6 are closed. The second valve 22 is also configured to be closed, so that the first valve 22 can block the flow of fluid from the second junction 105 into the second waste reservoir 24. When the second selector valve unit 6 is in its sixth position and the second valve 22 is closed, the flow of fluids along the n injection conduits 9*a-h* is restricted; accordingly fluids flowing from the hollow needles 2*a-h* into the n inputs 7*a*'-7*h*' of the first set 107' of inputs of the switching valve unit 7, will flow into the respective buffer conduits 8*a-h* via the n inputs 7*a*"-7*h*" of the second set 107" of inputs of the switching valve unit 7.

The switching valve unit 7 is then arranged in its first configuration so that the switching valve unit 7 simultaneously fluidly connects each of the n inputs 7*a*'-7*h*' of the first set 107' of inputs with a respective n output 7*a*'''-7*h*''' (specifically the switching valve unit 7 simultaneously fluidly connects all of the first, second, third, fourth, fifth, sixth, seventh and eight inputs 7*a*'-7*h*' of the first set 107' of inputs with the respective first, second, third, fourth, fifth, sixth, seventh and eighth outputs 7*a*'''-7*h*''').

The first selector valve unit 4 is then arranged into its ninth configuration, such that the first selector valve unit 4 fluidly connect its single input 4' with all of its n outputs; specifically the first selector valve unit 4 is arranged so that all of its first, second, third, fourth, fifth, sixth, seventh and eighth outputs 4*a-h* are simultaneously fluidly connected to the single input 4'. When the first selector valve unit 4 is in its ninth configuration, the single pumping means 12 is simultaneously fluidly connected to each of said first, second, third, fourth, fifth, sixth, seventh and eighth outputs 4*a-h* of the first selector valve unit 4.

The single pumping means 12 is then configured to provide a negative pressure (e.g. negative fluid pressure) so that respective fluids in each of said reservoirs 1*a-h* are aspirated, simultaneously, into the respective hollow needles 2*a-h*, through the respective hollow needles 2*a-h* and through the switching valve unit 7, and into respective buffer conduits 8*a-h*: Specifically, in this example the first immobilization reagent is aspirated into the first hollow needle 2*a* of said needle unit 2, and from there the negative pressure forces the first immobilization reagent to flow through the first hollow needle 2*a*, through the switching valve unit 7, and into the first buffer conduit 8*a*; said first ligands (which are optionally diluted in an acetate buffer) are aspirated into the second hollow needle 2*b* and from there the negative pressure forces the first ligands to flow through the second hollow needle 2*b*, through the switching valve unit 7, and into the second buffer conduit 8*b*; said second ligands (which are optionally diluted in an acetate buffer) are aspirated into the third hollow needle 2*c* and from there the negative pressure forces the second ligands to flow through the third hollow needle 2*c*, through the switching valve unit 7, and into the third buffer conduit 8*c*; said third ligands (which are optionally diluted in an acetate buffer) are aspirated into the fourth hollow needle 2*d* and from there the negative pressure forces the third ligands to flow through the fourth hollow needle 2*d*, through the switching valve unit 7, and into the fourth buffer conduit 8*d*; said fourth ligands (which are optionally diluted in an acetate buffer) are aspirated into the fifth hollow needle 2*e* and from there the negative pressure forces the fourth ligands to flow through the fifth hollow needle 2*e*, through the switching valve unit 7, and into the fifth buffer conduit 8*e*; said second immobilization reagent is aspirated into the sixth hollow needle 2*f* and from there the negative pressure forces the second immobilization reagent to flow through the sixth hollow needle 2*f*, through the switching valve unit 7, and into the sixth buffer conduit 8*f*; and optionally, said buffer fluid in the seventh reservoir 1*g* is aspirated into the seventh needle 2*g*, and from there the negative pressure forces the buffer fluid to flow through the seventh hollow needle 2*g*, through the switching valve unit 7, and into the seventh buffer conduit 8*g*; and optionally, said buffer fluid in the eighth reservoir 1*h* is aspirated into the eighth hollow needle 2*h* and from there the negative pressure forces the buffer fluid to flow through the eighth hollow needle 2*h*, through the switching valve unit 7, and into the eighth buffer conduit 8*h*.

Accordingly, after this step has been performed the first buffer conduit 8*a* contains the first immobilization reagent; the second buffer conduit 8*b* contains the said first ligands (which are optionally diluted in an acetate buffer); the third buffer conduit 8*c* contains said second ligands (which are optionally diluted in an acetate buffer); the fourth buffer conduit 8*d* contains said third ligands (which are optionally diluted in an acetate buffer); the fifth buffer conduit 8*e* contains said fourth ligands (which are optionally diluted in an acetate buffer); the sixth buffer conduit 8*f* contains said second immobilization reagent; and optionally, the seventh buffer conduit 8*g* contains buffer fluid; and optionally, the eighth buffer conduit 8*h* contains buffer fluid.

The switching valve unit 7 arranged in its second configuration so that the switching valve unit 7 blocks the flow of fluid between said n inputs 7*a*'-7*h*' of the first set 107' of inputs and the n outputs 7*a*'''-7*h*'''. In this second configuration the switching valve unit 7 prevents fluid, which is present in any of the n buffer conduits 8*a-h*, from flowing back into the hollow needles 2*a-h*.

The first selector valve unit 4 it then arranged in its first configuration so that the single input 4' of the first selector valve unit 4 is fluidly connected to the first output 4*a* only of the first selector valve unit 4.

The second selector valve unit 6 is arranged in its fifth position so that second selector valve unit 6 fluidly connects all of the outputs 3*a*"-*d*" of all of the flow cells 3*a-d* in the flow cell unit 3 with the first waste reservoir 23.

The single pumping means 12 is then configured to provide a positive pressure; the positive pressure forces the first immobilization reagent present in the first buffer conduit 8*a*, to flow through all of the m flow cells. Specifically the positive pressure provided by the single pumping mean 12 flows through the single input 4' of the first selector valve unit 4, and then into the first output 4*a* first selector valve unit 4, and from the first output 4*a* of the first selector valve unit 4 into the first buffer conduit 8*a* where the positive pressure pushes the first immobilization reagent along the first buffer conduit 8*a*, into the first input 7*a*" of the second set 107" of inputs of the switching valve unit 7, and then into the first injection conduit 9*a* via the first output 7*a*' of the switching valve unit 7, along the first injection conduit 9*a*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23.

When the first immobilization reagent flows through the first, second, third and fourth flow cells 3*a-d*, the first immobilization reagent will contact the test surfaces of each flow cell 3*a-d*, thereby activating the test surfaces. Activation of a test surface of a flow cell means providing an immobilization agent (i.e. an agent which can hold a ligand) on the test surface of the flow cell. An immobilization agent may include reactive groups by carboxyl activation for example. Importantly, once a test surface of a flow cell has been activated by the first immobilization agent, ligands which subsequently contact that test surface (e.g. ligands which flow over that test surface) will become attached to said test surface. The ligands which have become attached to the test surface, can in turn bind to molecules in sample fluids which flow through said flow cell. The sensor 50 can be used to detect if molecules in a sample fluid have bound to the ligands on the test surface of a flow cell.

Optionally, the flow cells 3*a-d* in the flow cell unit 3 are then rinsed in a rinsing step: The second pumping means 11 may be selectively configured to dispense a buffer fluid which can be used to rinse the flow cells 3*a-d*.

In order to rinse the flow cells 3*a-d* the first pumping means 12 is configured so that it does not provide any positive or negative pressure (e.g. the first pumping means 12 is turned off); the second selector valve unit 6 is moved into its sixth position wherein all of the first, second, third and fourth valves 6*a-d* of the second selector valve unit 6 are closed; the first valve 22 is configured to be in its open configuration so that fluid can flow from the second junction 105 through the first valve 22 and into the second waste reservoir 24; the third selector valve unit 17 is arranged into its fifth configuration so that the second pumping means 11 is fluidly connected to all of the flow cells 3*a-d*.

The second pumping means 11 is then operated to dispense buffer fluid. Specifically, the second pumping means 11 is typically first emptied by configuring the switching valve 11*b* to fluidly connect the syringe 11*a* to the waste reservoir 11*d*, and then dispensing the fluid contents of the syringe 11*a* into the waste reservoir 11*d*. Then the switching valve 11*b* is configured to fluidly connect the syringe 11*a* to the buffer reservoir 11*c*, so as to allow buffer fluid which is present in the buffer reservoir 11*c*, to pass from the buffer reservoir 11*c* to the syringe 11*a*. The syringe 11*a* is then filled with buffer fluid from the buffer reservoir 11*c* by aspirating buffer fluid from the buffer reservoir 11*c*. The switching valve 11*b* is then configured to fluidly connect the syringe 11*a* to the output 11*e*; the buffer fluid contained in the syringe 11*a* is then dispensed from the syringe 11*a*.

The buffer fluid flows from the second pumping means 11, through all of the valves 17*a-d* of the third selector valve unit 17, along the buffer inlet conduits 16*a*, 16*b*, 16*c*, 16*d*, and into all of the flow cells 3*a-d* in the flow cell unit 3 via the subsidiary conduits 19*a*, 19*b*, 19*c*, 19*d*. Since the second selector valve unit 6 is in its sixth position the buffer fluid will be prevented from flowing along the subsidiary conduits 19*a*, 19*b*, 19*c*, 19*d* and into the first waste reservoir 23, thus the buffer fluid is forced to flow along the subsidiary conduits 19*a*, 19*b*, 19*c*, 19*d* to the flow cells 3*a-d*. When the buffer fluid flows through the flow cells 3*a-d* it will rinse the flow cells 3*a-d*. The buffer fluid flows through the flow cells 3*a-d* and along the single conduit 5', through the second junction 105, through the first valve 22 (which is opened) and into the second waste reservoir 24.

The assembly is kept in this configuration for a predefined amount of time until the flow cells 3*a-d* have been rinsed for said predefined amount of time. Accordingly the second pumping means 11 is maintained in its configuration where it dispenses buffer fluid for said predefined amount of time.

After said predefined amount of time has lapsed, the second pumping means 11 is configured to stop dispensing buffer fluid (e.g. the second pumping means 11 is turned off); and the first valve 22 is configured to be in its closed configuration so that it blocks the flow of fluid from the second junction 105 into the second waste reservoir 24.

Once the above-mentioned, optional, rinsing of the flow cells 3*a-d* has been performed the next steps in the method may be executed:

The first selector valve unit 4 it then arranged in its second configuration so that the single input 4' of the first selector valve unit 4 is fluidly connected to the second output 4*b* only of the first selector valve unit 4.

The second selector valve unit 6 is arranged in its first position wherein the first valve 6*a* is opened and the second, third, fourth valves 6*b-d* are closed thereby fluidly connecting the output 3*a*" of the first flow cell 3*a* only with the first waste reservoir 23. The third selector valve unit 17 is arranged in its first configuration.

The single pumping means 12 is then configured to provide a positive pressure; the positive pressure forces the first ligands present in the second buffer conduit 8*b*, to flow through the first flow cell 3*a* only. Specifically the positive pressure provided by the single pumping means 12 flows through the single input 4' of the first selector valve unit 4, and then into the second output 4*b* of the first selector valve unit 4, and from the second output 4*b* of the first selector valve unit 4 into the second buffer conduit 8*b* where the positive pressure pushes the first ligands along the second buffer conduit 8*b*, into the second input 7*b*" of the second set 107" of inputs of the switching valve unit 7, and then into the second injection conduit 9*b* via the second output 7*b*'" of the switching valve unit 7, along the second injection conduit 9*b*, and then along the single conduit 5', and subsequently through the first flow cell 3*a* only, through the first valve 6*a* only of the second selector valve 6 and into the first waste reservoir 23.

Because the second selector valve 6 is in its first position, the first ligands arriving at the flow cell unit 3 from the single conduit 5', will flow through the first flow cell 3*a* only (not through the second, third or fourth flow cells 3*b-d*) and into the first waste reservoir 23. As the first ligands flow through the first flow cell 3*a* they will become attached to the test surface of the first flow cell 3*a* (the first immobilization agent which flowed over the test surface of the first flow cell 3*a* in the preceding step primed the test surface of the first flow cell 3*a* so that the first ligands will attach to the test surface of the first flow cell 3*a* when the first ligands flow over the test surface of the first flow cell 3*a*). Accordingly the test surface of the first flow cell 3*a* is thus provided with the first ligands.

Optionally, the sensor 50 is used to monitor the amount of first ligands which attach to the test surface of the first flow cell 3*a*. This can be done by recording the signal output by the sensor 50 as the first ligands flow through the first flow cell 3*a*.

Optionally, the above-mentioned rinsing step is performed again.

The first selector valve unit 4 it then arranged in its third configuration so that the single input 4' of the first selector valve unit 4 is fluidly connected to the third output 4*c* only of the first selector valve unit 4.

The second selector valve unit 6 is arranged in its second position wherein the second valve 6*b* is opened and the first, third, and fourth valves 6*a,c,d* are closed thereby fluidly connecting the output 3*b*" of the second flow cell 3*b* only with the first waste reservoir 23. The third selector valve unit 17 is arranged in its second configuration.

The single pumping means 12 is then configured to provide a positive pressure; the positive pressure forces the second ligands present in the third buffer conduit 8*c*, to flow through the second flow cell 3*b* only. Specifically the positive pressure provided by the single pumping mean 12 flows through the single input 4' of the first selector valve unit 4, and then into the third output 4*c* of the first selector valve unit 4, and from the third output 4*c* of the first selector valve unit 4 into the third buffer conduit 8*c* where the positive pressure pushes the second ligands along the third buffer conduit 8*c*, into the third input 7*c*" of the second set 107" of inputs of the switching valve unit 7, and then into the third injection conduit 9*c* via the third output 7*b*'" of the switching valve unit 7, along the third injection conduit 9*c*, and then along the single conduit 5', and subsequently through the second flow cell 3*b* only, and then through the second valve 6*a* only of the second selector valve 6 and into the first waste reservoir 23.

Because the second selector valve 6 is in its second position, the second ligands arriving at the flow cell unit 3 from the single conduit 5', will flow through the second flow cell 3*b* only (not through the first, third or fourth flow cells 3*a,c,d*) and into the first waste reservoir 23. As the second ligands flow through the second flow cell 3*b* they will become attached to the test surface of the second flow cell 3*a* (the first immobilization agent which flowed over the test surface of the second flow cell 3*b* primed the test surface of the second flow cell 3*b* so that the second ligands will attach to the test surface of the second flow cell 3*b* when the second ligands flow over the test surface of the second flow cell 3*b*). Accordingly the test surface of the second flow cell 3*b* is thus provided with the second ligands.

Optionally, the sensor 50 is used to monitor the amount of second ligands which attach to the test surface of the second flow cell 3*b*. This can be done by recording the signal output by the sensor 50 as the second ligands flow through the second flow cell 3*b*.

Optionally, the above-mentioned rinsing step is performed again.

The first selector valve unit 4 it then arranged in its fourth configuration so that the single input 4' of the first selector valve unit 4 is fluidly connected to the fourth output 4*b* only of the first selector valve unit 4.

The second selector valve unit 6 is arranged in its third position wherein the third valve 6*c* is opened and the first, second, and fourth valves 6*a,b,d* are closed thereby fluidly connecting the output 3*c*" of the third flow cell 3*c* only with the first waste reservoir 23. The third selector valve unit 17 is arranged in its third configuration.

The single pumping means 12 is then configured to provide a positive pressure; the positive pressure forces the third ligands present in the fourth buffer conduit 8*d*, to flow through the third flow cell 3*c* only.

Specifically the positive pressure provided by the single pumping mean 12 flows through the single input 4' of the first selector valve unit 4, and then into the fourth output 4*d* of the first selector valve unit 4, and from the fourth output 4*d* of the first selector valve unit 4 into the fourth buffer conduit 8*d* where the positive pressure pushes the third ligands along the fourth buffer conduit 8*d*, into the fourth input 7*d*" of the second set 107" of inputs of the switching valve unit 7, and then into the fourth injection conduit 9*d* via the fourth output 7*d*'" of the switching valve unit 7, along the fourth injection conduit 9*d*, and then along the single conduit 5', and subsequently through the third flow cell 3*a* only, and then through the third valve 6*d* only of the second selector valve 6 and into the first waste reservoir 23.

Because the second selector valve 6 is in its third position, the third ligands arriving at the flow cell unit 3 from the single conduit 5', will flow through the third flow cell 3*c* only (not through the first, second or fourth flow cells 3*a,b,d*) and into the first waste reservoir 23. As the third ligands flow through the third flow cell 3*c* they will become attached to the test surface of the third flow cell 3*c* (the first immobilization agent which flowed over the test surface of the third flow cell 3*c* primed the test surface of the third flow cell 3*c* so that the third ligands will attach to the test surface of the third flow cell 3*c* when the third ligands flow over the test surface of the third flow cell 3*b*). Accordingly the test surface of the third flow cell 3*c* is thus provided with the third ligands.

Optionally, the sensor 50 is used to monitor the amount of third ligands which attach to the test surface of the third flow cell 3*c*. This can be done by recording the signal output by the sensor 50 as the third ligands flow through the third flow cell 3*c*.

Optionally, the above-mentioned rinsing step is performed again.

The first selector valve unit 4 it then arranged in its fifth configuration so that the single input 4' of the first selector valve unit 4 is fluidly connected to the fifth output 4*e* only of the first selector valve unit 4.

The second selector valve unit 6 is arranged in its fourth position wherein the fourth valve 6*d* is opened and the first, second, and third valves 6*a,b,c* are closed thereby fluidly connecting the output 3*d*" of the fourth flow cell 3*d* only with the first waste reservoir 23. The third selector valve unit 17 is arranged in its fourth configuration.

The single pumping means 12 is then configured to provide a positive pressure; the positive pressure forces the fourth ligands present in the fifth buffer conduit 8*e*, to flow through the fourth flow cell 3*d* only.

Specifically the positive pressure provided by the single pumping mean 12 flows through the single input 4' of the first selector valve unit 4, and then into the fifth output 4*e* of the first selector valve unit 4, and from the fifth output 4*e* of the first selector valve unit 4 into the fifth buffer conduit 8*e* where the positive pressure pushes the fourth ligands along the fifth buffer conduit 8*e*, into the fifth input 7*e*" of the second set 107" of inputs of the switching valve unit 7, and then into the fifth injection conduit 9*e* via the fifth output 7*e*'" of the switching valve unit 7, along the fifth injection conduit 9*e*, and then along the single conduit 5', and subsequently through the fourth flow cell 3*a* only, and then through the fourth valve 6*d* only of the second selector valve 6 and into the first waste reservoir 23.

Because the second selector valve 6 is in its fourth position, the fourth ligands arriving at the flow cell unit 3 from the single conduit 5', will flow through the fourth flow cell 3*d* only (not through the first, second or third flow cells 3*a,b,c*) and into the first waste reservoir 23. As the fourth ligands flow through the fourth flow cell 3*d* they will become attached to the test surface of the fourth flow cell 3*d* (the first immobilization agent which flowed over the test surface of the fourth flow cell 3*c* primed the test surface of the fourth flow cell 3*d* so that the fourth ligands will attach to the test surface of the fourth flow cell 3*d* when the fourth ligands flow over the test surface of the fourth flow cell 3*d*). Accordingly the test surface of the fourth flow cell 3*d* is thus provided with the fourth ligands.

In this particular example the fourth ligands are the same as either the first, second, or third ligands, with the exception that the fourth ligands are modified (genetically) so that the fourth ligands lack a specific binding site. Most preferably the aim when screening a plurality of sample fluids is to identify sample(s) which have molecules which can bind to a specific binding site of a ligand. It is possible that molecules bind to other parts of the ligand (which are not binding sites), and molecules of a sample fluid which bind to other parts of the ligand which are not binding sites of the ligand, are referred to as being a sticky compound". Advantageously, having a fourth ligands which are the same as either the first, second, or third ligands, with the exception that the fourth ligands are modified (genetically) so that the fourth ligands lack a specific binding site, allows to identify if a sample fluid contains a "sticky compound", thus allowing to determine if molecules of a sample fluid which have bound to ligands in that flow cell have bound to the specific binding site of the ligand or have likely bound to another part of the ligand. For example, if the fourth ligands are the same as the first ligands, but are modified (genetically) so that the fourth ligands lack a specific binding site, and molecules within a sample fluid which has been passed through the flow cells 3*a-d* were shown (via the sensor) to bind to the first ligands in the first flow cell, and to also bind to the fourth ligands in the fourth flow cell, this indicates that the sample fluid contains a "sticky compound" and potentially the molecules of the sample fluid did not bind to the specific binding site on the first ligands but rather bound to another part of the first ligands (often such a sample fluid would not be considered as a good drug candidate for binding to equivalent ligands within the human body). If on the other hand the molecules within a sample fluid which has been passed through the flow cells 3*a-d* was shown (via the sensor) to bind to the first ligands in the first flow cell, but not to bind to the fourth ligands in the fourth flow cell, this indicates that sample fluid does not contain a "sticky compound" and that the molecules of the sample fluid did bind to the specific binding site on the first ligands (often such a sample fluid would be considered to be a good drug candidate for binding to equivalent ligands within the human body).

Optionally, the sensor 50 is used to monitor the amount of fourth ligands which attach to the test surface of the fourth flow cell 3*d*. This can be done by recording the signal output by the sensor 50 as the fourth ligands flow through the fourth flow cell 3*d*.

Optionally, the above-mentioned rinsing step is performed again.

It should be understood that providing the fourth flow cell with ligands (in this case fourth ligands) is an optional step; in a variation of this embodiment the fourth flow cell is not provided with any ligands on its test surface. According the test surface of the fourth flow cell 3*d* is without any ligands. In such a case the output of the sensor measuring binding in the fourth flow cell, when the sample fluid passes through all of the flow cells, can be used as a reference signal, to which the output of the sensor measuring binding in the first, second, and third flow cell 3*a-c* can be compared. When a sample fluid is passed through all of the flow cells 3*a-d*, and if the output of the sensor measuring binding in the first flow cell 3*a*, differs from the output of the sensor measuring binding in the fourth flow cell 3*d*, this indicates that molecules of that sample fluid have bound to the first ligands in the first flow cell 3*a*. Likewise when a sample fluid is passed through all of the flow cells 3*a-d*, and if the output of the sensor measuring binding in the second flow cell 3*b*, differs from the output of the sensor measuring binding in the fourth flow cell 3*d*, this indicates that molecules of that sample fluid have bound to the second ligands in the second flow cell 3*b*. Likewise, when a sample fluid is passed through all of the flow cells 3*a-d*, and if the output of the sensor measuring binding in the third flow cell 3*c*, differs from the output of the sensor measuring binding in the fourth flow cell 3*d*, this indicates that molecules of that sample fluid have bound to the third ligands in the third flow cell 3*c.a*

Referring back to the present embodiment, the first selector valve unit 4 it then arranged in its sixth configuration so that the single input 4' of the first selector valve unit 4 is fluidly connected to the sixth output 4*f* only of the first selector valve unit 4.

The second selector valve unit 6 is arranged in its fifth position so that second selector valve unit 6 fluidly connects all of the outputs 3*a*"-*d*" of all of the flow cells 3*a-d* in the flow cell unit 3 with the first waste reservoir 23.

The single pumping means 12 is then configured to provide a positive pressure; the positive pressure forces the second immobilization reagent present in the sixth buffer conduit 8*f*, to flow through all of the m flow cells 3*a-d*.

Specifically the positive pressure provided by the single pumping mean 12 flows through the single input 4' of the first selector valve unit 4, and then into the sixth output 4*f* first selector valve unit 4, and from the sixth output 4*f* of the first selector valve unit 4 into the sixth buffer conduit 8*f* where the positive pressure pushes the second immobilization reagent along the sixth buffer conduit 8*f*, into the sixth input 7*f*" of the second set 107" of inputs of the switching valve unit 7, and then into the sixth injection conduit 9*f* via the sixth output 7*f*'" of the switching valve unit 7, along the sixth injection conduit 9*f*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23.

When the second immobilization reagent flows through the first, second, third and fourth flow cells 3*a-d*, the second immobilization reagent will act to passivate the test surfaces of the respective first, second, third and fourth flow cells 3*a-d*. In the present application to passivate a test surface means to provide a passivating agent on the test surface, wherein a passivating agent is an agent removes immobilization agents from the test surface (thereby ensuring that there is no immobilization agent which can hold a ligand present on the test surface, thus ensuring that there is no ligands present on the test surface). An example of a passivating agent includes, but is not limited to, Ethanolamine.

Optionally, the above-mentioned rinsing step is performed again.

Optionally, the first selector valve unit 4 it then arranged in its seventh configuration so that the single input 4' of the first selector valve unit 4 is fluidly connected to the seventh output 4*e* only of the first selector valve unit 4.

The second selector valve unit 6 is maintained in its fifth position so that second selector valve unit 6 fluidly connects all of the outputs 3*a*"-d" of all of the flow cells 3*a-d* in the flow cell unit 3 with the first waste reservoir 23.

The single pumping means 12 is then configured to provide a positive pressure; the positive pressure forces the optional buffer which is present in the seventh buffer conduit 8*g*, to flow through all of the m flow cells 3*a-h*.

Specifically the positive pressure provided by the single pumping mean 12 flows through the single input 4' of the first selector valve unit 4, and then into the seventh output 4*g* of the first selector valve unit 4, and from the seventh output 4*g* of the first selector valve unit 4 into the seventh buffer conduit 8*g* where the positive pressure pushes the buffer along the seventh buffer conduit 8*g*, into the seventh input 7*g*" of the second set 107" of inputs of the switching valve unit 7, and then into the seventh injection conduit 9*g* via the seventh output 7*g*'" of the switching valve unit 7, along the seventh injection conduit 9*g*, and then along the single conduit 5', and subsequently through the first, second, third and fourth flow cells 3*a-d*, and through the second selector valve 6 (i.e. through the first, second, third and/or fourth valves 6*a-d* of the second selector valve 6) and into the first waste reservoir 23.

When the buffer flows through the first, second, third and fourth flow cells 3*a-d*, the buffer will act to equilibrate the test surfaces within the flow cells 3*a-d*.

Optionally, the above-mentioned rinsing step is performed again.

Optionally, the first selector valve unit 4 it then arranged in its eighth configuration so that the single input 4' of the first selector valve unit 4 is fluidly connected to the eighth output 4*h* only of the first selector valve unit 4.

The second selector valve unit 6 is maintained in its fifth position so that second selector valve unit 6 fluidly connects all of the outputs 3*a*"-d" of all of the flow cells 3*a-d* in the flow cell unit 3 with the first waste reservoir 23.

The single pumping means 12 is then configured to provide a positive pressure; the positive pressure forces the optional buffer which is present in the eighth buffer conduit 8*h*, to flow through all of the m flow cells 3*a-h*.

Specifically the positive pressure provided by the single pumping mean 12 flows through the single input 4' of the first selector valve unit 4, and then into the eighth output 4*h* of the first selector valve unit 4, and from the eighth output 4*h* of the first selector valve unit 4 into the eighth buffer conduit 8*h* where the positive pressure pushes the buffer along the eighth buffer conduit 8*h*, into the eighth input 7*h*" of the second set 107" of inputs of the switching valve unit 7, and then into the eighth injection conduit 9*h* via the eighth output 7*h*'" of the switching valve unit 7, along the eighth injection conduit 9*h*, and then along the single conduit 5', and subsequently through the first, second, third and fourth flow cells 3*a-d*, and through the second selector valve 6 (i.e. through the first, second, third and/or fourth valves 6*a-d* of the second selector valve 6) and into the first waste reservoir 23.

When the buffer flows through the first, second, third and fourth flow cells 3*a-d*, the buffer will act to equilibrate the test surfaces within the flow cells 3*a-d*. Example of suitable buffers are Phosphate-buffered saline (PBS), or buffers based on 4-(2-hydroxyethyl)-1-piperazineethanesulfonic acid) (HEPES).

Optionally, the above-mentioned rinsing step is performed again.

Optionally the hollow needles 2*a-h* in the needle unit 2 are then washed. Most preferably the hollow needles 2*a-h* are washed before they are filled with sample fluids which is to undergo screening according to the afore-method. For example after the ligands have been provided on the test surfaces of the respective flow cells 3 the moveable stage 2' may operate to move the needle unit 2 to the wash station 28 where the hollow needles 2*a-h* are washed; after the hollow needles 2*a-h* have been washed the moveable stage 2' moves the needle unit 2 to a position over the sample tray holder 1 where each of the needle unit 2 can aspirate sample fluids from respective reservoirs which are to be screened.

It should be understood that the first, second, third and fourth ligands may take any suitable form. The first, second, third and fourth ligands can bind to molecules which have a predefined characteristic such as having a high affinity to the ligands either via a simple lock-and-key mechanism where a molecule fits into a so-called binding pocket of a ligand, or assisted by more complex molecular processes such as conformational changes. Thus, it can be determined which molecules in a sample fluid have said predefined characteristic of having a high affinity to the ligands, by passing the sample fluid over the surfaces of the flow cell unit 3 and then determining which molecules have become bound to the ligands. In drug discovery applications where a multitude of molecules from a compound library are screened for finding suitable drug candidates binding to a drug target, typically, the different ligands can be used to exclude non-specific binding effects, for instance by providing a drug target as first ligands, and similar molecules as the drug target but lacking a specific binding pocket as second and third and fourth ligands. Thus, any of the flow cells comprising test surfaces with immobilized second, third or fourth ligands can be used as reference flow cell. In another example, three different drug targets are provided as first, second and third ligands on the test surfaces of three flow cells, and the fourth flow cell is the reference flow cell with an empty test surface.

It should be understood that in a variation of the above-described embodiment, instead of providing the first immobilization reagent, the first ligand, second ligand, third ligand, fourth ligand, second immobilization reagent, and buffers, in the respective, first, second, third, fourth, fifth, sixth, seventh, and eighth, reservoirs 1*a-h* of said sample tray holder 1, and then aspirating these into the respective hollow needles 2*a-h*, the first immobilization reagent, the first ligand, second ligand, third ligand, fourth ligand, second immobilization reagent, and buffers, could be initially present in the respective, first, second, third, fourth, fifth, sixth, seventh, and eighth, hollow needles 2*a-h*. In such an embodiment no sample tray holder 1 is required.

Figure 2:
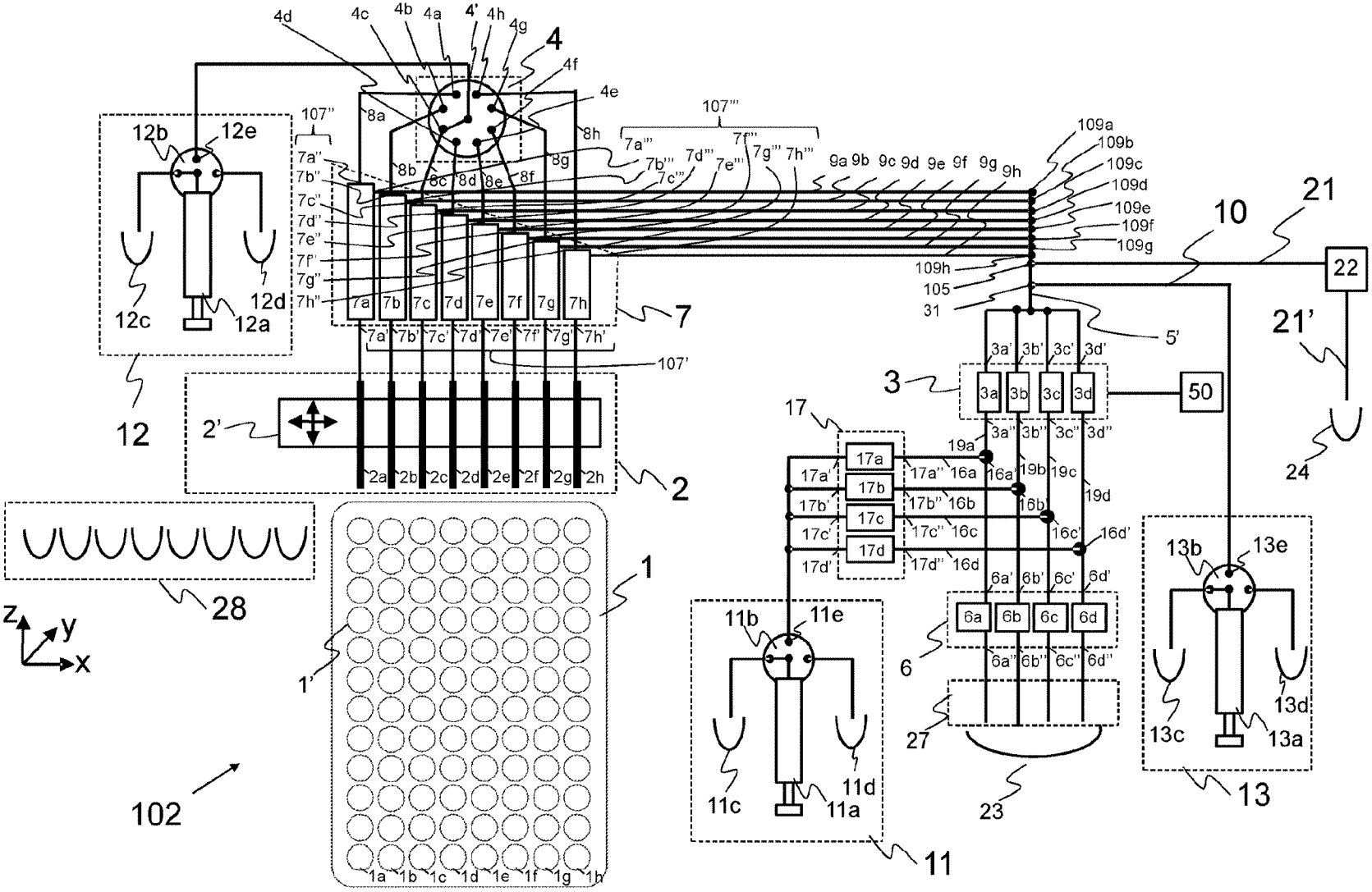
FIG. 2 shows an assembly according to a further embodiment of the present invention.

FIG. 2 shows an assembly 102 according to a further embodiment of the present invention. The assembly 102 has many of the same features as the assembly 101 shown in FIG. 1 and like features are awarded the same reference numbers.

FIG. 2 illustrates an assembly 102 according to a further embodiment of the present invention. The assembly 102 comprises many of the same features of the assembly 101 of FIG. 1 and like features are awarded the same reference numbers.

The assembly 102 further comprises, a third pumping means 13 which can be selectively configured to provide positive pressure or negative pressure. Said third pumping means is fluidly connected to a third junction 31, wherein said third junction 31 is located along the single conduit 5'. between where the injection conduits 9*a-h* are fluidly connected to said single conduit 5' and the m inputs 3*a'*-3*d'* of said m flow cells 3*a-d* in said flow cell unit. Specifically, in the assembly 102 the third junction is located along the single conduit 5', between said second junction 105 and the m inputs 3*a'*-3*d'* of said m flow cells 3*a-d* in said flow cell unit 3.

The third pumping means 13 may have any suitable configuration. In this example, the third pumping means 13 comprises a syringe 13*a*, a switching valve 13*b*, a buffer reservoir 13*c* which contains a buffer fluid, a waste reservoir 13*d* and an output 13*e*. Preferably, before providing positive pressure, the third pumping means 13 is typically primed by configuring the switching valve 13*b* to fluidly connect the syringe 13*a* to the waste reservoir 13*d*, so as to allow buffer fluid to pass from the syringe 13*a* to the waste reservoir 13*d*; then the buffer fluid contents of the syringe 13*a* are dispensed into the waste reservoir 13*d*. Then the switching valve 13*b* is configured to fluidly connect the syringe 13*a* to the buffer reservoir 13*c*, so as to allow buffer fluid to pass from the buffer reservoir 13*c* into the syringe 13*a*. The syringe 13*a* is then filled with buffer fluid from the buffer reservoir 13*c* by aspirating buffer fluid from the buffer reservoir 13*c*. In order to provide positive pressure, the switching valve 13*b* is configured to fluidly connect the syringe 13*a* to the output 13*e*; buffer fluid contained in the syringe 13*a* is then dispensed from the syringe; the dispensed buffer fluid creates the positive pressure. Similarly, preferably, before providing negative pressure, the syringe 13*a* is typically at least partially emptied (and most preferably is fully emptied); the switching valve 13*b* is configured to fluidly connect the syringe 13*a* to the waste reservoir 13*d* so as to allow fluid to pass from the syringe 13*a* to the waste reservoir 13*d*; the fluid contents of the syringe 13*a* is then at least partially emptied into the waste reservoir 13*d*. In order to provide negative pressure, the switching valve 13*b* is configured to fluidly connect the syringe 13*a* to the output 13*e*; then fluid 13*e* present in the output is aspirated into the syringe 13*a*; aspirating fluid from the output 13*e* into the syringe 13*a* creates the negative pressure.

Most preferably the third pumping means 13 (specifically the output 13*e* of the third pumping means 13) is fluidly connected to the third junction 31 via a conduit 10 referred to hereafter as the pump conduit 10. One end of the pump conduit 10 is connected to the output 13*e* and the opposite end of the pump conduit 10 is connected to the third junction 31. Preferably, the pump conduit 10 has a volume greater than three times the combined inner volume of all conduits between the sample container 1 and the junction 5, such as samples do not reach and contaminate the third pumping means 13 during the alternative pickup step. Preferably, the pump conduit 10 has a volume greater than 10 microliters, or greater than 50 microliters, or greater than 100 microliters.

The assembly 102 operates (for screening samples and/or for capturing or immobilizing ligands on sensor surfaces present in the flow cell unit 3, and) in substantially the same manner as the assembly 101 with the exception that the third pumping means 13 is used to aspirate fluids from the respective reservoirs 1*a-h* in the sample tray holder 1, into the respective injection conduits 9*a*-9*h*, instead of using the first pumping means 12 to aspirate fluids into the respective buffer conduits 8*a-h*.

For example, instead of said steps of arranging the first selector valve unit 4 into its ninth configuration, such that the first selector valve unit 4 fluidly connect its single input 4' with all of its n outputs; and then configuring the single pumping means 12 to provide a negative pressure (e.g. negative fluid pressure) so that the respective sample fluids in each of said respective reservoirs 1*a'-h* in said row are aspirated, simultaneously, into said respective hollow needles 2*a-h*; and said respective sample fluids are forced to simultaneously flow out of the respective hollow needles 2*a-h* and through the switching valve unit 7, and out of the switching valve unit 7 via the n inputs 7*a*"-7*h*" of the second set 107" of inputs of the switching valve unit 7, into the respective buffer conduits 8*a-h*, as is done in the assembly 101, in the assembly 102, the second selector valve unit 6 is moved into its sixth position, and the second switch 22 is closed; then the switching valve unit 7 is moved into its first position, and the third pumping means 13 is configured to provide a negative pressure e.g. negative fluid pressure) so that the respective sample fluids in each of said respective reservoirs 1*a'-h* in said row are aspirated, simultaneously, into said respective hollow needles 2*a-h*; and said respective sample fluids are forced to simultaneously flow out of the respective hollow needles 2*a-h* and through the switching valve unit 7, and out of the switching valve unit 7 via the n outputs 7*a'''*-7*h'''* of the switching valve unit 7, and into the respective injection conduits 9*a-h*.

For example, instead of configuring the single pumping means 12 to provide a negative pressure (e.g. negative fluid pressure) so that: the first immobilization reagent is aspirated into the first hollow needle 2*a* of said needle unit 2, and from there the negative pressure forces the first immobilization reagent to flow through the first hollow needle 2*a*, through the switching valve unit 7, and into the first buffer conduit 8*a*; said first ligands (which are optionally diluted in an acetate buffer) are aspirated into the second hollow needle 2*b* and from there the negative pressure forces the first ligands to flow through the second hollow needle 2*b*, through the switching valve unit 7, and into the second buffer conduit 8*b*; said second ligands (which are optionally diluted in an acetate buffer) are aspirated into the third hollow needle 2*c* and from there the negative pressure forces the second ligands to flow through the third hollow needle 2*c*, through the switching valve unit 7, and into the third buffer conduit 8*c*; said third ligands (which are optionally diluted in an acetate buffer) are aspirated into the fourth hollow needle 2*d* and from there the negative pressure forces the third ligands to flow through the fourth hollow needle 2*d*, through the switching valve unit 7, and into the fourth buffer conduit 8*d*; said fourth ligands (which are optionally diluted in an acetate buffer) are aspirated into the fifth hollow needle 2*e* and from there the negative pressure forces the fourth ligands to flow through the fifth hollow needle 2*e*, through the switching valve unit 7, and into the fifth buffer conduit 8*e*; said second immobilization reagent is aspirated into the sixth hollow needle 2*f* and from there the negative pressure forces the second immobilization reagent to flow through the sixth hollow needle 2*f*, through the switching valve unit 7, and into the sixth buffer conduit 8*f*; and optionally, said buffer fluid in the seventh reservoir 1*g* is aspirated into the seventh needle 2*g*, and from there the negative pressure forces the buffer fluid to flow through the seventh hollow needle 2*g*, through the switching valve unit 7, and into the seventh buffer conduit 8*g*; and optionally, said buffer fluid in the eighth reservoir 1*h* is aspirated into the eighth hollow needle 2*h* and from there the negative pressure forces the buffer fluid to flow through the eighth hollow needle 2*h*, through the switching valve unit 7, and into the eighth buffer conduit 8*h*, as is done in the assembly 101, in the assembly 102, the second selector valve unit 6 is moved into its sixth position, and the second switch 22 is closed; then the switching valve unit 7 is moved into its first position, and the third pumping means 13 is configured to provide a negative pressure e.g. negative fluid pressure) so that the first immobilization reagent is aspirated into the first hollow needle 2*a* of said needle unit 2, and from there the negative pressure forces the first immobilization reagent to flow through the first hollow needle 2*a*, through the switching valve unit 7, and into the first injection conduit 9*a*; said first ligands (which are optionally diluted in an acetate buffer) are aspirated into the second hollow needle 2*b* and from there the negative pressure forces the first ligands to flow through the second hollow needle 2*b*, through the switching valve unit 7, and into the second injection conduit 9*b*; said second ligands (which are optionally diluted in an acetate buffer) are aspirated into the third hollow needle 2*c* and from there the negative pressure forces the second ligands to flow through the third hollow needle 2*c*, through the switching valve unit 7, and into the third injection conduit 9*c*; said third ligands (which are optionally diluted in an acetate buffer) are aspirated into the fourth hollow needle 2*d* and from there the negative pressure forces the third ligands to flow through the fourth hollow needle 2*d*, through the switching valve unit 7, and into the fourth injection conduit 9*d*; said fourth ligands (which are optionally diluted in an acetate buffer) are aspirated into the fifth hollow needle 2*e* and from there the negative pressure forces the fourth ligands to flow through the fifth hollow needle 2*e*, through the switching valve unit 7, and into the fifth injection conduit 9*e*; said second immobilization reagent is aspirated into the sixth hollow needle 2*f* and from there the negative pressure forces the second immobilization reagent to flow through the sixth hollow needle 2*f*, through the switching valve unit 7, and into the sixth injection conduit 9*f*; and optionally, said buffer fluid in the seventh reservoir 1*g* is aspirated into the seventh needle 2*g*, and from there the negative pressure forces the buffer fluid to flow through the seventh hollow needle 2*g*, through the switching valve unit 7, and into the seventh injection conduit 9*g*; and optionally, said buffer fluid in the eighth reservoir 1*h* is aspirated into the eighth hollow needle 2*h* and from there the negative pressure forces the buffer fluid to flow through the eighth hollow needle 2*h*, through the switching valve unit 7, and into the eighth injection conduit 9*h*.

Preferably, when aspirating sample from the reservoirs 1*a-h*, a volume of more than three times the combined inner volume of all conduits between the sample container 1 and the junction 5 is aspirated by the third pumping means, such as the sample concentration within the portion of the injection conduits 9*a* through 9*h* close to the junction 5 is only minimally diluted due to Taylor-Aris dispersion. Advantageously, the sample concentration within the portion of the injection conduits 9*a* through 9*h* close to the junction 5 is then close to 100% of the original sample concentration in the respective well of the sample container 1.

Figure 3:
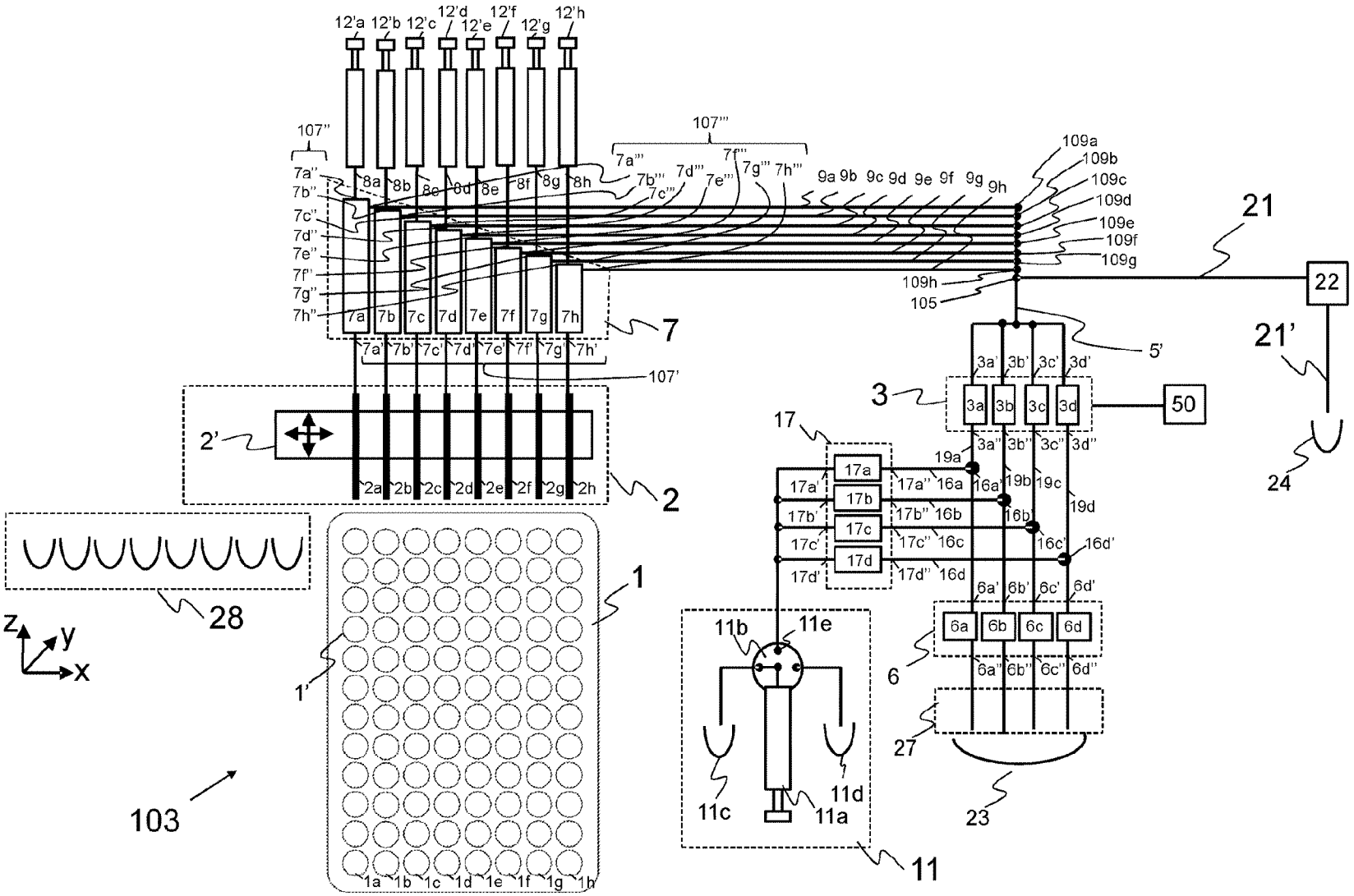
FIG. 3 shows an assembly according to a further embodiment of the present invention.

FIG. 3 shows an assembly 103 according to a further embodiment of the present invention. The assembly 103 has many of the same features as the assembly 101 shown in FIG. 1 and like features are awarded the same reference numbers.

However, instead of having a single pumping means 12 and first selector valve unit 4, as is the case in the assembly 101, the assembly 103 comprises n pumping means 12'*a-h*. As already mentioned in this example n is equal to eight therefore the assembly 103 comprises eight pumping means, namely a first pumping means 12'*a*, a second pumping means 12'*b*, a third pumping means 12'*c*, a fourth pumping means 12'*d*, a fifth pumping means 12'*e*, a sixth pumping means 12'*f*, a seventh pumping means 12'*g*, an eighth pumping means 12'*h*. Most preferably the number of pumping means (12'*a-h*) corresponds to the number of hollow needles in the needle unit 2.

Each of then pumping means (12'*a*-12'*h*) has a respective output 12*a*'-12*h*' thereby providing n outputs. Each of the pumping means (12'*a-h*) can be selectively configured to provide positive pressure (e.g. positive fluid pressure) or negative pressure (e.g. negative fluid pressure, such as a vacuum) at its respective output 12*a*'-12*h*'. Each respective output 12*a*'-*h*' is fluidly connected to a respective input 7*a*"-h" belonging to the second set 107" of inputs of the switching valve unit 7. Specifically, the output 12*a*' of the first pumping means 12'*a* is fluidly connected to the first input 7*a*" of the second set 107" of inputs of the switching valve unit 7; the output 12*b*' of the second pumping means 12'*b* is fluidly connected to the second input 7*b*" of the second set 107" of inputs of the switching valve unit 7; the output 12*c*' of the third pumping means 12'*c* is fluidly connected to the third input 7*c*" of the second set 107" of inputs of the switching valve unit 7; the output 12*d*' of the fourth pumping means 12'*d* is fluidly connected to the fourth input 7*d*" of the second set 107" of inputs of the switching valve unit 7; the output 12*e*' of the fifth pumping means 12'*e* is fluidly connected to the fifth input 7*e*" of the second set 107" of inputs of the switching valve unit 7; the output 12*f*' of the sixth pumping means 12'*f* is fluidly connected to the sixth input 7*f*" of the second set 107" of inputs of the switching valve unit 7; the output 12*g*' of the seventh pumping means 12'*g* is fluidly connected to the seventh input 7*g*" of the second set 107" of inputs of the switching valve unit 7; the output 12*h*' of the eighth pumping means 12'*h* is fluidly connected to the eighth input 7*h*" of the second set 107" of inputs of the switching valve unit 7.

The assembly 103 can be used to perform a method of screening a plurality of sample fluids to identify if any one or more of said sample fluids contain molecules which can bind to predefined ligands (said predefined ligands being of the type provided on the test surfaces of one or more of the flow cells 3*a-d*), according to a further embodiment of the present invention:

During use a sample holder tray 1 which comprises a plurality of reservoirs 1' is provided; sample fluids are provided in at least some of the reservoirs 1'. In the example shown in FIG. 1, the sample holder tray 1 comprises a series of rows of reservoirs 1'; in at least one of the rows all of the reservoirs 1' in that row are provided with sample fluids which are to undergo screening. Preferably in at least two of the rows all of the reservoirs 1' in those two rows are provided with sample fluids which are to undergo screening. Most preferably sample fluids are provided in all of the reservoirs 1' of said sample holder tray 1.

Different sample fluids may be provided in each respective reservoir 1'; in other words the sample fluids provided in said different reservoirs 1' may have different compositions (this is not essential; it could be that some of the sample fluids in different reservoirs 1' have the same composition). In this example the different sample fluids having different compositions are provided in said respective reservoirs 1': In a first row of reservoirs, a first sample fluid is provided in a first reservoir 1*a*' of that row; a second sample fluid is provided in a second reservoir 1*b*' of said row; a third sample fluid is provided in a third reservoir 1*c*' of said row; a fourth sample fluid is provided in a fourth reservoir 1*d*' of said row; a fifth sample fluid is provided in a fifth reservoir 1*e*' of said row; a sixth sample fluid is provided in a sixth reservoir 1*f*' of said row; a seventh sample fluid is provided in a seventh reservoir 1*g*' of said row; an eighth sample fluid is provided in an eighth reservoir 1*h*' of said row.

The needle unit 2 is then arranged so that each of the respective n hollow needles 2 is simultaneously inserted into a respective reservoir 1*a-h*; specifically the needle unit 2 is arranged so that, the first hollow needle 2*a* is inserted into said first reservoir 1*a*', the second hollow needle 2*b* is inserted into said second reservoir 1*b*', the third hollow needle 2*c* is inserted into said third reservoir 1*c*', the fourth hollow needle 2*d* is inserted into said fourth reservoir 1*d*', the fifth hollow needle 2*e* is inserted into said fifth reservoir 1*e*', the sixth hollow needle 2*f* is inserted into said sixth reservoir 1*f*, the seventh hollow needle 2*g* is inserted into said seventh reservoir 1*g*', the eighth hollow needle 2*h* is inserted into said eighth reservoir 1*h*'. At least the tip of each hollow needle 2*a-h* is submerged in the respective sample fluids contained in the respective reservoirs 1*a*'-*h*'. It should be noted that the moveable stage 2' may move the needle unit 2 into a position wherein each of the respective n hollow needles 2 are simultaneously inserted into a respective reservoir 1*a-h*.

Preferably the second selector valve unit 6 is then moved into its sixth position wherein all of the first, second, third and fourth valves 6*a-d* of the second selector valve unit 6 are closed. The second valve 22 is also configured to be closed, so that the first valve 22 can block the flow of fluid from the second junction 105 into the second waste reservoir 24. When the second selector valve unit 6 is in its sixth position and the second valve 22 is closed, the flow of fluids along the n injection conduits 9*a-h* is restricted; accordingly fluids flowing from the hollow needles 2*a-h* into the n inputs 7*a*'-7*h*' of the first set 107' of inputs of the switching valve unit 7, will flow into the respective buffer conduits 8*a-h* via the n inputs 7*a*"-7*h*" of the second set 107" of inputs of the switching valve unit 7.

The switching valve unit 7 is arranged in its first configuration (if the switching valve unit 7 is not already arranged in its first configuration) so that the switching valve unit 7 simultaneously fluidly connects each of the n inputs 7*a*'-7*h*' of the first set 107' of inputs with a respective n output 7*a*'''-7*h*''' (specifically the switching valve unit 7 simultaneously fluidly connects all of the first, second, third, fourth, fifth, sixth, seventh and eighth inputs 7*a*'-7*h*' of the first set 107' of inputs with the respective first, second, third, fourth, fifth, sixth, seventh and eighth outputs 7*a*'''-7*h*''').

Each of the n pumping means (12'*a*-12'*h*) are then configured to provide a negative pressure (e.g. negative fluid pressure) so that the respective sample fluids in each of said respective reservoirs 1*a*'-*h* in said row are aspirated, simultaneously, into said respective hollow needles 2*a-h*; and said respective sample fluids are forced to simultaneously flow out of the respective hollow needles 2*a-h* and through the switching valve unit 7. In this example the respective sample fluids in each of said respective reservoirs 1*a*'-*h* in said row are aspirated, simultaneously, into said respective hollow needles 2*a-h*; and said respective sample fluids are forced to simultaneously flow out of the respective hollow needles 2*a-h* and through the switching valve unit 7, and out of the switching valve unit 7 via the n inputs 7*a*"-7*h*" of the second set 107" of inputs of the switching valve unit 7, into the respective buffer conduits 8*a-h*.

Specifically, the first sample fluid present in the first reservoir 1*a* is aspirated into the first hollow needle 2*a* of said needle unit 2, and from there the negative pressure forces the first immobilization reagent to flow through the first hollow needle 2*a*, through the switching valve unit 7, and into the first buffer conduit 8*a*; the second sample fluid present in the second reservoir 1*b* is aspirated into the second hollow needle 2*b* and from there the negative pressure forces the second sample fluid to flow through the second hollow needle 2*b*, through the switching valve unit 7, and into the second buffer conduit 8*b*; the third sample fluid present in the third reservoir 1*c* is aspirated into the third hollow needle 2*c* and from there the negative pressure forces the third sample fluid to flow through the third hollow needle 2*c*, through the switching valve unit 7, and into the third buffer conduit 8*c*; the fourth sample fluid present in the fourth reservoir 1*d* is aspirated into the fourth hollow needle 2*d* and from there the negative pressure forces the fourth sample fluid to flow through the fourth hollow needle 2*d*, through the switching valve unit 7, and into the fourth buffer conduit 8*d*; the fifth sample fluid present in the fifth reservoir 1*e* is aspirated into the fifth hollow needle 2*e* and from there the negative pressure forces the fifth sample fluid to flow through the fifth hollow needle 2*e*, through the switching valve unit 7, and into the fifth buffer conduit 8*e*; the sixth sample fluid present in the sixth reservoir if is aspirated into the sixth hollow needle 2*f* and from there the negative pressure forces the sixth sample fluid to flow through the sixth hollow needle 2*f*, through the switching valve unit 7, and into the sixth buffer conduit 8*f*; the seventh sample fluid present in the seventh reservoir 1*g* is aspirated into the seventh needle 2*g*, and from there the negative pressure forces the seventh sample fluid to flow through the seventh hollow needle 2*g*, through the switching valve unit 7, and into the seventh buffer conduit 8*g*; the eighth sample fluid present in the eighth reservoir 1*h*' is aspirated into the eighth hollow needle 2*h* and from there the negative pressure forces the eighth sample fluid to flow through the eighth hollow needle 2*h*, through the switching valve unit 7, and into the eighth buffer conduit 8*h*.

Accordingly after this step has been performed the first, second, third, fourth, fifth, sixth, seventh, and eighth sample fluids are present in the respective first, second, third, fourth, fifth, sixth, seventh, and eighth buffer conduits 8*a-f*.

The switching valve unit 7 then arranged in its second configuration so that the switching valve unit 7 blocks the flow of fluid between said n inputs 7*a*'-7*h*' of the first set 107' of inputs and the n outputs 7*a*'''-7*h*'''. In this second configuration the switching valve unit 7 prevents fluid, which is present at any of the n outputs 7*a*'''-7*h*''' or which is present in any of the n buffer conduits 8*a-f*, from flowing back into the hollow needles 2*a-h*.

Preferably the second selector valve unit 6 is then moved into its fifth position, so that all of the first, second, third and fourth valves 6*a-d* of the second selector valve unit 6 are opened, thereby fluidly connecting all of the outputs 3*a*"-3*d*" of all of the flow cells 3*a-d* in the flow cell unit 3 with the first waste reservoir 23.

The first pumping means 12'*a* is then configured to provide a positive pressure; the positive pressure forces the first sample fluid present in the first buffer conduit 8*a*, to flow through all of the m flow cells 3*a-d*. Specifically the positive pressure provided by the single pumping means 12 flows into the first buffer conduit 8*a* where the positive pressure pushes the first sample fluid along the first buffer conduit 8*a*, into the first input 7*a*" of the second set 107" of inputs of the switching valve unit 7, and then into the first injection conduit 9*a* via the first output 7*a*''' of the switching valve unit 7, along the first injection conduit 9*a*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the first sample fluid will contact the test surfaces of each of the first, second, third and fourth flow cells 3*a-d*; and more specifically will contact ligands which are present on said respective test surfaces. If the first sample fluid contains molecules which can bind to the ligands which are on the test surfaces of any the first, second, third and fourth flow cells 3*a-d*, these molecules will become bound to those ligands when the first sample fluid flows through that flow cell.

Most preferably the assembly 101 further comprises a sensor 50 which can detect if molecules of a sample fluid have become bound to ligands on the test surfaces of a flow cell. As the first sample fluid flows through the first, second, third and fourth flow cells 3*a-d*, this sensor 50 is operated to detect if molecules of the first sample fluid have become bound to ligands on the test surfaces of any of the first, second, third or fourth flow cells 3*a-d*.

The first sample fluid will flow out of the respective first, second, third and fourth flow cells 3*a-d*, via the respective outputs 3*a*"-3*d*" of the respective flow cells 3*a-d*. The first sample fluid which flows out of the first flow cell 3*a* will flow through the first valve 6*a* of the second selector valve unit 6, and into the first waste reservoir 23; the first sample fluid which flows out of the second flow cell 3*b* will flow through the second valve 6*b* of the second selector valve unit 6, and into the first waste reservoir 23; the first sample fluid which flows out of the third flow cell 3*c* will flow through the third valve 6*c* of the second selector valve unit 6, and into the first waste reservoir 23; the first sample fluid which flows out of the fourth flow cell 3*d* will flow through the fourth valve 6*d* of the second selector valve unit 6, and into the first waste reservoir 23.

Optionally, the flow cells 3*a-d* in the flow cell unit 3 are then rinsed in a rinsing step: The second pumping means 11 may be selectively configured to dispense buffer fluid which can be used to rinse the flow cells 3*a-d*. In order to rinse the flow cells 3*a-d* each of the n pumping means (12'*a*-12'*h*) are configured so that it does not provide any positive or negative pressure (e.g. each of the n pumping means (12'*a*-12'*h*) are turned off); the second selector valve unit 6 is moved into its sixth position wherein all of the first, second, third and fourth valves 6*a-d* of the second selector valve unit 6 are closed; the first valve 22 is configured to be in its open configuration so that fluid can flow from the second junction 105 through the first valve 22 and into the second waste reservoir 24; the third selector valve unit 17 is arranged into it fifth configuration so that the second pumping means 11 is fluidly connected to all of the flow cells 3*a-d*. The second pumping means 11 is then operated to dispense buffer fluid by providing positive pressure. Specifically, the second pumping means 11 is typically first emptied by configuring the switching valve 11*b* to fluidly connect the syringe 11*a* to the waste reservoir 11*d*, and then dispensing the fluid contents of the syringe 11*a* into the waste reservoir 11*d*. Then the switching valve 11*b* is configured to fluidly connect the syringe 11*a* to the buffer reservoir 11*c*, so as to allow buffer fluid which is preset in the buffer reservoir 11*c*, to pass from the buffer reservoir 11*c* to the syringe 11*a*. The syringe 11*a* is then filled with buffer fluid from the buffer reservoir 11*c* by aspirating buffer fluid from the buffer reservoir 11*c*. The switching valve 11*b* is then configured to fluidly connect the syringe 11*a* to the output 11*e*; the buffer fluid contained in the syringe 11*a* is then dispensed from the syringe 11*a*. The buffer fluid flows from the second pumping means 11, through all of the valves 17*a-d* of the third selector valve unit 17, along the buffer inlet conduits 16*a*, 16*b*, 16*c*, 16*d*, and into all of the flow cells 3*a-d* in the flow cell unit 3 via the subsidiary conduits 19*a*, 19*b*, 19*c*, 19*d*. Since the second selector valve unit 6 is in its sixth position the buffer fluid will be prevented from flowing along the subsidiary conduits 19*a*, 19*b*, 19*c*, 19*d* and into the first waste reservoir 23, thus the buffer fluid is forced to flow along the subsidiary conduits 19*a*, 19*b*, 19*c*, 19*d* to the flow cells 3*a-d*. When the buffer fluid flows through the flow cells 3*a-d* it will rinse the flow cells 3*a-d*. The buffer fluid flows through the flow cells 3*a-d* and along the single conduit 5', through the second junction 105, through the first valve 22 (which is opened) and into the second waste reservoir 24. Preferably, the assembly is kept in this configuration for a predefined amount of time until the flow cells 3*a-d* have been rinsed for said predefined amount of time. Accordingly the second pumping means 11 is maintained in its configuration where it dispenses buffer fluid for said predefined amount of time. After said predefined amount of time has lapsed, the second pumping means 11 is configured to stop dispensing buffer fluid (e.g. the second pumping means 11 is turned off); and the first valve 22 is configured to be in its closed configuration so that it blocks the flow of fluid from the second junction 105 into the second waste reservoir 24.

The second pumping means 12'*b* is then configured to provide a positive pressure; the positive pressure forces the second sample fluid present in the second buffer conduit 8*b*, to flow through all of the m flow cells 3*a-d*. Specifically the positive pressure provided by the single pumping mean 12 flows into the second buffer conduit 8*b* where the positive pressure pushes the second sample fluid along the second buffer conduit 8*b*, into the second input 7*b*" of the second set 107" of inputs of the switching valve unit 7, and then into the second injection conduit 9*b* via the second output 7*b*'" of the switching valve unit 7, along the second injection conduit 9*b*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the second sample fluid will contact the test surfaces of each of the first, second, third and fourth flow cells 3*a-d*; and more specifically will contact ligands which are present on said respective test surfaces. If the second sample fluid contains molecules which can bind to the ligands which are on the test surfaces of any the first, second, third and fourth flow cells 3*a-d*, these molecules will become bound to those ligands when the second sample fluid flows through that flow cell.

As the second sample fluid flows through the first, second, third and fourth flow cells 3*a-d*, this sensor 50 is operated to detect if molecules of the second sample fluid have become bound to ligands on the test surfaces of any of the first, second, third or fourth flow cells 3*a-d*.

The second sample fluid will flow out of the respective first, second, third and fourth flow cells 3*a-d*, via the respective outputs 3*a*"-3*d*" of the respective flow cells 3*a-d*. The second sample fluid which flows out of the first flow cell 3*a* will flow through the first valve 6*a* of the second selector valve unit 6, and into the first waste reservoir 23; the second sample fluid which flows out of the second flow cell 3*b* will flow through the second valve 6*b* of the second selector valve unit 6, and into the first waste reservoir 23; the second sample fluid which flows out of the third flow cell 3*c* will flow through the third valve 6*c* of the second selector valve unit 6, and into the first waste reservoir 23; the second sample fluid which flows out of the fourth flow cell 3*d* will flow through the fourth valve 6*d* of the second selector valve unit 6, and into the first waste reservoir 23.

Optionally, the above-mentioned rinsing step is performed again.

The third pumping means 12'*c* is then configured to provide a positive pressure; the positive pressure forces the third sample fluid present in the third buffer conduit 8*c*, to flow through all of the m flow cells 3*a-d*. Specifically the positive pressure provided by the single pumping mean 12 flows into the third buffer conduit 8*c* where the positive pressure pushes the third sample fluid along the third buffer conduit 8*c*, into the s third input 7*c*" of the second set 107" of inputs of the switching valve unit 7, and then into the third injection conduit 9*c* via the third output 7*b*'" of the switching valve unit 7, along the third injection conduit 9*c*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the third sample fluid will contact the test surfaces of each of the first, second, third and fourth flow cells 3*a-d*; and more specifically will contact ligands which are present on said respective test surfaces. If the third sample fluid contains molecules which can bind to the ligands which are on the test surfaces of any the first, second, third and fourth flow cells 3*a-d*, these molecules will become bound to those ligands when the third sample fluid flows through that flow cell.

As the third sample fluid flows through the first, second, third and fourth flow cells 3*a-d*, this sensor 50 is operated to detect if molecules of the third sample fluid have become bound to ligands on the test surfaces of any of the first, second, third or fourth flow cells 3*a-d*.

The third sample fluid will flow out of the respective first, second, third and fourth flow cells 3*a-d*, via the respective outputs 3*a*"-3*d*" of the respective flow cells 3*a-d*. The third sample fluid which flows out of the first flow cell 3*a* will flow through the first valve 6*a* of the second selector valve unit 6, and into the first waste reservoir 23; the third sample fluid which flows out of the second flow cell 3*b* will flow through the second valve 6*b* of the second selector valve unit 6, and into the first waste reservoir 23; the third sample fluid which flows out of the third flow cell 3*c* will flow through the third valve 6*c* of the second selector valve unit 6, and into the first waste reservoir 23; the third sample fluid which flows out of the fourth flow cell 3*d* will flow through the fourth valve 6*d* of the second selector valve unit 6, and into the first waste reservoir 23.

Optionally, the above-mentioned rinsing step is performed again.

The fourth pumping means 12'*d* is then configured to provide a positive pressure; the positive pressure forces the fourth sample fluid present in the fourth buffer conduit 8*d*, to flow through all of the m flow cells 3*a-d*. Specifically the positive pressure provided by the single pumping mean 12 flows into the fourth buffer conduit 8*d* where the positive pressure pushes the fourth sample fluid along the fourth buffer conduit 8*d*, into the fourth input 7*d*" of the second set 107" of inputs of the switching valve unit 7, and then into the fourth injection conduit 9*d* via the fourth output 7*d*'" of the switching valve unit 7, along the fourth injection conduit 9*d*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the fourth sample fluid will contact the test surfaces of each of the first, second, third and fourth flow cells 3*a-d*; and more specifically will contact ligands which are present on said respective test surfaces. If the fourth sample fluid contains molecules which can bind to the ligands which are on the test surfaces of any the first, second, third and fourth flow cells 3*a-d*, these molecules will become bound to those ligands when the fourth sample fluid flows through that flow cell.

As the fourth sample fluid flows through the first, second, third and fourth flow cells 3*a-d*, this sensor 50 is operated to detect if molecules of the fourth sample fluid have become bound to ligands on the test surfaces of any of the first, second, third or fourth flow cells 3*a-d*.

The fourth sample fluid will flow out of the respective first, second, third and fourth flow cells 3*a-d*, via the respective outputs 3*a*"-3*d*" of the respective flow cells 3*a-d*. The fourth sample fluid which flows out of the first flow cell 3*a* will flow through the first valve 6*a* of the second selector valve unit 6, and into the first waste reservoir 23; the fourth sample fluid which flows out of the second flow cell 3*b* will flow through the second valve 6*b* of the second selector valve unit 6, and into the first waste reservoir 23; the fourth sample fluid which flows out of the third flow cell 3*c* will flow through the third valve 6*c* of the second selector valve unit 6, and into the first waste reservoir 23; the fourth sample fluid which flows out of the fourth flow cell 3*d* will flow through the fourth valve 6*d* of the second selector valve unit 6, and into the first waste reservoir 23.

Optionally, the above-mentioned rinsing step is performed again.

The fifth pumping means 12'*e* is then configured to provide a positive pressure; the positive pressure forces the fifth sample fluid present in the fifth buffer conduit 8*e*, to flow through all of the m flow cells 3*a-d*. Specifically the positive pressure provided by the single pumping mean 12 flows into the fifth buffer conduit 8*e* where the positive pressure pushes the fifth sample fluid along the fifth buffer conduit 8*e*, into the fifth input 7*e*" of the second set 107" of inputs of the switching valve unit 7, and then into the fifth injection conduit 9*e* via the fifth output 7*e*'" of the switching valve unit 7, along the fifth injection conduit 9*e*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the fifth sample fluid will contact the test surfaces of each of the first, second, third and fourth flow cells 3*a-d*; and more specifically will contact ligands which are present on said respective test surfaces. If the fifth sample fluid contains molecules which can bind to the ligands which are on the test surfaces of any the first, second, third and fourth flow cells 3*a-d*, these molecules will become bound to those ligands when the fifth sample fluid flows through that flow cell.

As the fifth sample fluid flows through the first, second, third and fourth flow cells 3*a-d*, this sensor 50 is operated to detect if molecules of the fifth sample fluid have become bound to ligands on the test surfaces of any of the first, second, third or fourth flow cells 3*a-d*.

The fifth sample fluid will flow out of the respective first, second, third and fourth flow cells 3*a-d*, via the respective outputs 3*a*"-3*d*" of the respective flow cells 3*a-d*. The fifth sample fluid which flows out of the first flow cell 3*a* will flow through the first valve 6*a* of the second selector valve unit 6, and into the first waste reservoir 23; the fifth sample fluid which flows out of the second flow cell 3*b* will flow through the second valve 6*b* of the second selector valve unit 6, and into the first waste reservoir 23; the fifth sample fluid which flows out of the third flow cell 3*c* will flow through the third valve 6*c* of the second selector valve unit 6, and into the first waste reservoir 23; the fifth sample fluid which flows out of the fourth flow cell 3*d* will flow through the fourth valve 6*d* of the second selector valve unit 6, and into the first waste reservoir 23.

Optionally, the above-mentioned rinsing step is performed again.

The sixth pumping means 12'*f* is then configured to provide a positive pressure; the positive pressure forces the sixth sample fluid present in the sixth buffer conduit 8*f*, to flow through all of the m flow cells 3*a-d*. Specifically the positive pressure provided by the single pumping mean 12 flows into the sixth buffer conduit 8*f* where the positive pressure pushes the sixth sample fluid along the sixth buffer conduit 8*f*, into the sixth input 7*e*" of the second set 107" of inputs of the switching valve unit 7, and then into the sixth injection conduit 9*f* via the sixth output 7*f*' of the switching valve unit 7, along the sixth injection conduit 9*f*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the sixth sample fluid will contact the test surfaces of each of the first, second, third and fourth flow cells 3*a-d*; and more specifically will contact ligands which are present on said respective test surfaces. If the sixth sample fluid contains molecules which can bind to the ligands which are on the test surfaces of any the first, second, third and fourth flow cells 3*a-d*, these molecules will become bound to those ligands when the sixth sample fluid flows through that flow cell.

As the sixth sample fluid flows through the first, second, third and fourth flow cells 3*a-d*, this sensor 50 is operated to detect if molecules of the sixth sample fluid have become bound to ligands on the test surfaces of any of the first, second, third or fourth flow cells 3*a-d*.

The sixth sample fluid will flow out of the respective first, second, third and fourth flow cells 3*a-d*, via the respective outputs 3*a*"-3*d*" of the respective flow cells 3*a-d*. The sixth sample fluid which flows out of the first flow cell 3*a* will flow through the first valve 6*a* of the second selector valve unit 6, and into the first waste reservoir 23; the sixth sample fluid which flows out of the second flow cell 3*b* will flow through the second valve 6*b* of the second selector valve unit 6, and into the first waste reservoir 23; the sixth sample fluid which flows out of the third flow cell 3*c* will flow through the third valve 6*c* of the second selector valve unit 6, and into the first waste reservoir 23; the sixth sample fluid which flows out of the fourth flow cell 3*d* will flow through the fourth valve 6*d* of the second selector valve unit 6, and into the first waste reservoir 23.

Optionally, the above-mentioned rinsing step is performed again.

The seventh pumping means 12'*g* is then configured to provide a positive pressure; the positive pressure forces the seventh sample fluid present in the seventh buffer conduit 8*g*, to flow through all of the m flow cells 3*a-d*. Specifically the positive pressure provided by the single pumping mean 12 flows into the seventh buffer conduit 8*g* where the positive pressure pushes the seventh sample fluid along the seventh buffer conduit 8*g*, into the seventh input 7*g*" of the second set 107" of inputs of the switching valve unit 7, and then into the seventh injection conduit 9*g* via the seventh output 7*g*'" of the switching valve unit 7, along the seventh injection conduit 9*g*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the seventh sample fluid will contact the test surfaces of each of the first, second, third and fourth flow cells 3*a-d*; and more specifically will contact ligands which are present on said respective test surfaces. If the seventh sample fluid contains molecules which can bind to the ligands which are on the test surfaces of any the first, second, third and fourth flow cells 3*a-d*, these molecules will become bound to those ligands when the seventh sample fluid flows through that flow cell.

As the seventh sample fluid flows through the first, second, third and fourth flow cells 3*a-d*, this sensor 50 is operated to detect if molecules of the seventh sample fluid have become bound to ligands on the test surfaces of any of the first, second, third or fourth flow cells 3*a-d*.

The seventh sample fluid will flow out of the respective first, second, third and fourth flow cells 3*a-d*, via the respective outputs 3*a*"-3*d*" of the respective flow cells 3*a-d*. The seventh sample fluid which flows out of the first flow cell 3*a* will flow through the first valve 6*a* of the second selector valve unit 6, and into the first waste reservoir 23; the seventh sample fluid which flows out of the second flow cell 3*b* will flow through the second valve 6*b* of the second selector valve unit 6, and into the first waste reservoir 23; the seventh sample fluid which flows out of the third flow cell 3*c* will flow through the third valve 6*c* of the second selector valve unit 6, and into the first waste reservoir 23; the seventh sample fluid which flows out of the fourth flow cell 3*d* will flow through the fourth valve 6*d* of the second selector valve unit 6, and into the first waste reservoir 23.

Optionally, the above-mentioned rinsing step is performed again.

The eighth pumping means 12'*h* is then configured to provide a positive pressure; the positive pressure forces the eighth sample fluid present in the eighth buffer conduit 8*h*, to flow through all of the m flow cells 3*a-d*. Specifically the positive pressure provided by the single pumping mean 12 flows into the eighth buffer conduit 8*h* where the positive pressure pushes the eighth sample fluid along the eighth buffer conduit 8*h*, into the eighth input 7*h*" of the second set 107" of inputs of the switching valve unit 7, and then into the eighth injection conduit 9*h* via the eighth output 7*h*'" of the switching valve unit 7, along the eighth injection conduit 9*h*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23. Accordingly the eighth sample fluid will contact the test surfaces of each of the first, second, third and fourth flow cells 3*a-d*; and more specifically will contact ligands which are present on said respective test surfaces. If the eighth sample fluid contains molecules which can bind to the ligands which are on the test surfaces of any the first, second, third and fourth flow cells 3*a-d*, these molecules will become bound to those ligands when the eighth sample fluid flows through that flow cell.

As the eighth sample fluid flows through the first, second, third and fourth flow cells 3*a-d*, this sensor 50 is operated to detect if molecules of the eighth sample fluid have become bound to ligands on the test surfaces of any of the first, second, third or fourth flow cells 3*a-d*.

The eighth sample fluid will flow out of the respective first, second, third and fourth flow cells 3*a-d*, via the respective outputs 3*a*"-3*d*" of the respective flow cells 3*a-d*. The eighth sample fluid which flows out of the first flow cell 3*a* will flow through the first valve 6*a* of the second selector valve unit 6, and into the first waste reservoir 23; the eighth sample fluid which flows out of the second flow cell 3*b* will flow through the second valve 6*b* of the second selector valve unit 6, and into the first waste reservoir 23; the eighth sample fluid which flows out of the third flow cell 3*c* will flow through the third valve 6*c* of the second selector valve unit 6, and into the first waste reservoir 23; the eighth sample fluid which flows out of the fourth flow cell 3*d* will flow through the fourth valve 6*d* of the second selector valve unit 6, and into the first waste reservoir 23.

Optionally, the above-mentioned rinsing step is performed again.

Advantageously, in the present embodiment, rapid screening of a plurality of sample fluids, to identify if any one or more of said sample fluids have molecules which can bind to predefined ligands (said predefined ligands being of the type provided on the test surfaces of one or more of the flow cells 3*a-d*) can be achieved. In this example each of the eight sample fluids which were present in the respective reservoirs 1*a-h* of a first row of the sample tray holder 1 are passed consecutively, without any substantial delay between sample fluids, through the flow cells 3*a-d* in the flow cell unit 3, and the sensor 50 is used to detect if the molecules bind to ligands on the test surfaces of the flow cells as each respective sample fluid is passed through the flow cells 3*a-d*.

In a preferred embodiment, the respective sample fluids are flowed through the flow cells 3*a-d* in rapid succession, this is to ensure that the molecules of the sample fluids contact the same test surface (of the flow cells 3*a-d*) in rapid succession. Preferably, the time period between passing flowing consecutive sample fluids through the flow cells 3*a-d* is less than 10 seconds, or is preferably is less than below 5 seconds, or is more preferably is less than 2 seconds, or is most preferably is less than 1 second. For example the time period between the time when the first pumping means 12'*a* is configured to provide a positive pressure which forces the first sample fluid present in the first injection conduit 9*a*, to flow through all of the m flow cells 3*a-d*, and the time when the second pumping means 12'*b* is configured to provide a positive pressure which forces the second sample fluid present in the second injection conduit 9*b*, to flow through all of the m flow cells 3*a-d*, is less than 10 seconds (or is preferably is less than below 5 seconds, or is more preferably is less than 2 seconds, or is most preferably is less than 1 second). Likewise the time period between the time when the second pumping means 12'*b* is configured to provide a positive pressure which forces the second sample fluid present in the second injection conduit 9*c*, to flow through all of the m flow cells 3*a-d*, and the time when the third pumping means 12'*c* is configured to provide a positive pressure which forces the third sample fluid present in the third injection conduit 9*c*, to flow through all of the m flow cells 3*a-d*, is less than 10 seconds (or is preferably is less than below 5 seconds, or is more preferably is less than 2 seconds, or is most preferably is less than 1 second). The same is true for all of the respective sample fluids—in other words, the time period between the time when a sample fluid present in an injection conduit is forced by any of the n pumping means 12'*a-h*, to flow through all of the m flow cells 3*a-d*, and the time when the next sample fluid present in an injection conduit is forced by any of the n pumping means 12'*a-h*, to flow through all of the m flow cells 3*a-d*, is less than 10 seconds (or is preferably is less than below 5 seconds, or is more preferably is less than 2 seconds, or is most preferably is less than 1 second).

In another preferred embodiment, in order to minimize sample dilution edge effects due to Taylor Aris dispersion, any of the n pumping means 12'*a-h* dispenses at a high flowrate when it is configured to provide a positive pressure which forces sample fluid present in an injection conduit 9*a-h*, to flow through all of the flow cells 3*a-d*. Likewise the pumping means 11 dispenses at a high flowrate during the rinsing step. Preferably, the respective pumping means dispense at a flowrate above 500 microliters per minute, or above 1 millilitres per minute, or above 2 millilitres per minute, or above 5 millilitres per minute.

In a further preferred embodiment, the time-resolved sensor signals from the sensor 50 are recorded at a rate of more than 50 points per seconds, or more than 100 points per second, or more than 100 points per second, while sample fluids flow through all of the flow cells 3*a-d* or at least during the rinsing step; this allows to resolve fast transitions and fast off-rates.

Optionally, after all of the first, second, third, fourth, fifth, sixth, seventh, and eighth sample fluids have been passed through the flow cells 3*a-d* the needle unit 2 is moved (preferably by the moveably stage 2') to the washing station 28. At the washing station 28 the hollow needles 2*a-d* are washed, in the manner described for the previous embodiment 101, to avoid contamination of sample fluids (residing in another, second, row of reservoirs 1*a-h* provided in the sample tray holder 1) which will be subsequently aspirated into the respective hollow needles 2*a-h* of the needle unit 2.

The afore mentioned steps are then repeated so that each of the sample fluids contained in said other row of reservoirs 1*a'-h'* are screened.

If the sample tray holder 1 comprises more than one other row of reservoirs which contain sample fluids which are to be screened then, preferably, the above-mentioned steps are repeated until the sample fluids contained in all of the rows of reservoirs have been screened.

In the above embodiment the sample fluids being aspirated into the hollow needles 2*a-h* from the sample tray holder 1, however it should be understood that this is not an essential step; in another embodiment, instead of the sample fluids being aspirated into the hollow needles 2*a-h* from the sample tray holder 1, the sample fluids are already present in one or more of said n hollow needles 2*a-h* of said needle unit 2. For example a first sample fluid is present in the first hollow needle 2*a*; a second sample fluid is present in the second hollow needle 2*b*; a third sample fluid is present in the first hollow needle 2*c*; a fourth sample fluid is present in the fourth hollow needle 2*d*; a fifth sample fluid is present in the fifth hollow needle 2*e*; a sixth sample fluid is present in the sixth hollow needle 2*f*; a seventh sample fluid is present in the seventh hollow needle 2*g*; an eighth sample fluid is present in the eighth hollow needle 2*h*.

Also it should be understood that the present invention is not limited to requiring that the sample fluids in each of the n hollow needles 2*a-h* be different sample fluids (i.e. different compositions); on the contrary in another embodiment some of the sample fluids in the n hollow needles 2*a-h* have the same composition e.g. two of more of the n hollow needles may have sample fluids which have the same composition. It can be that the composition of the sample fluids is entirely unknown. The sample fluids in each of the n hollow needles 2*a-h* could have come from the same or be different sources.

As mentioned above, the sensor 50 is operated to detect if molecules of a sample fluid have become bound to ligands on the test surfaces of any of the first, second, third or fourth flow cells 3*a-d*. One way to detect using the sensor 50 if molecules of a particular sample fluid have become bound to ligands on the test surface of any of a flow cell 3*a-d* is to compare an output signal of the sensor 50 to a reference output signal which is a signal which the sensor 50 outputs when said sample fluid flows through said flow cell, hereafter called reference flow cell, when no ligands are provided on its test surface. Alternatively, the test surface of the reference flow cell may contain reference ligands, such as ligands with similar characteristics as a test ligand but lacking a specific molecular structure relevant to a specific molecular binding. Thus, the method may further comprise the steps of, for each of the respective m (eight) sample fluids: passing that sample fluid through the reference flow cell; obtaining an output signal from the sensor 50 as the sample fluid passes through the reference flow cell, wherein this output signal defines a reference signal.

Then any of the above-mentioned steps of operating the sensor 50 to detect if molecules of a sample fluid have become bound to ligands on the test surfaces of any of the first, second, third or fourth flow cells 3*a-d*, may comprise, obtaining an output signal from the sensor as the sample fluid passes through the first, second, third or fourth flow cells 3*a-d* (one or more of which are not the reference flow cell); and comparing said output signal with said reference signal. It is then determined that a molecule of said sample fluid has bound to the ligands of a flow cell if the output signal differs from the reference signal. Most preferably, the steps of passing that sample fluid through the reference flow cell and passing that sample fluid through one or more of the flow cells which are not the reference flow cell, are executed simultaneously. In other words, most preferable, in the assembly 101 one of the flow cells 3*a-d* in the flow cell unit may be a reference flow cell; and during the method of screening a plurality of sample fluids, the step of passing that sample fluid through the reference flow cell takes place simultaneously to passing that sample fluid through the other flow cells (which are not reference flow cells).

Optionally, prior to performing the method of screening a plurality of sample fluids, to identify if any one or more of said sample fluids have molecules which can bind to predefined ligands (said predefined ligands being of the type provided on the test surfaces of one or more of the flow cells 3*a-d*) described above, a further step of providing ligands on the respective test surfaces of one or more of said m flow cells 3*a-h* in said flow cell unit 3 of the assembly 103 may be performed.

Most preferably such a further step of providing ligands on the respective test surfaces of one or more of said m flow cells 3*a-h* in said flow cell unit 3 would be performed prior to using the assembly 101 to screen one or more sample fluids for molecules which can bind to predefined ligands (said predefined ligands being of the type provided on the test surfaces of one or more of the flow cells 3*a-d*)), and even prior to providing sample fluids in said n hollow needles 2*a-h*. Most preferably the step of providing ligands on the respective test surfaces of one or more of said m flow cells 3*a-h* in said flow cell unit 3 comprises providing ligands on the test surfaces of a plurality (at least two) said flow cells 3*a-h* in said flow cell unit 3, wherein the type of ligands provided on the test surfaces differ between flow cells such that the test surfaces of said plurality of flow cells have different types of ligands.

In the following there will be described the steps carried out to provide: ligands of a first type, which can bind to a first type of molecule, are provided on the test surface of the first flow cell 3*a*; ligands of a second type, which can bind to a second type of molecule, are provided on the test surface of the second flow cell 3*b*; ligands of a third type, which can bind to a third type of molecule, are provided on the test surface of the third flow cell 3*c*; ligands of a fourth type, which can bind to a fourth type of molecule, are provided on the test surface of the fourth flow cell 3*d* (it should be understood that it is optional to provide ligands of a fourth type on the test surface of the fourth flow cell 3*d*; in a variation of this embodiment no ligands are provided on the test surface of the fourth flow cell 3*b*, so in other words the test surface of the fourth flow cell 3*b* is without any ligands):

A first immobilization reagent is provided in a first reservoir 1*a* of a row in said sample try holder 1. It should be understood that the first immobilization reagent may comprise any suitable immobilization reagent; for example the first immobilization reagent may comprise qa mixture of 1-Ethyl-3-(3-dimethylaminopropyl)carbodiimide (EDC) and N-hydroxysuccinimide (NHS) and/or Ethanolamine for amine coupling, and/or NiCl2 for His-Tag coupling, and/or any other suitable reagents. In this example the first immobilization reagent comprises a 1:1 mixture of EDC/NHS.

r different types of ligands are provided in respective r different reservoirs 1*a-h* of said row of said sample tray holder 1, wherein r is greater than one. As mentioned in this example four different types of ligands will be provided on the respective test surfaces of the respective flow cells 3*a-d* accordingly in this example r is four. It should be understood that r may have any value greater than one. In this example r is equal to m so four different types of ligands are provided in the respective second, third, fourth and fifth reservoirs 1*b*'-f' of said row (i.e. the same row to which said first reservoir 1*a*' belongs) of said sample tray holder 1:

Ligands of a first type (referred to hereafter as first ligands) are provided in the second reservoir 1*b* of said row. In this example said first ligands, optionally diluted in acetate buffer, are provided in the second reservoir 1*b*.

Ligands of a second type (referred to hereafter as second ligands) are provided in the third reservoir 1*c*. In this example said second ligands, optionally diluted in acetate buffer, are provided in the second reservoir 1*c*.

Ligands of a third type (referred to hereafter as third ligands) are provided in the fourth reservoir 1*d*'. In this example said third ligands, optionally diluted in acetate buffer, is provided in the fourth reservoir 1*d*'.

In this example ligands of a fourth type (referred to hereafter as fourth ligands) are provided in the fifth reservoir 1*e*. In this example said fourth ligands, optionally diluted in acetate buffer, are provided in the fifth reservoir 1*e*. In this particular example the fourth ligands are the same type as either the first, second, or third ligands, with the exception that the fourth ligands are modified (genetically) so that the fourth ligands lack any binding sites. However, it should be understood that it is optional to provide ligands of a fourth type in the fifth reservoir 1*e*; in a variation of this embodiment no ligands are provided on the test surface of the fourth flow cell 3*b*, in which case no ligands are provided in the fifth reservoir 1*e*.

A second immobilization reagent is provided in at least one of the remaining reservoirs 1*f-h* in said row. In this example the second immobilization reagent comprises Ethanolamine, however it will be understood that the second immobilization reagent may take any suitable form. In this example the second immobilization reagent is provided in the sixth reservoir 1*f* of said row.

Optionally a buffer is provided in the seventh and eighth reservoirs 1*g*, 1*h* of said row.

The needle unit 2 is then arranged so that each of the respective n hollow needles 2*a-h* is simultaneously inserted into a respective reservoir 1*a-h*; at least the tip of each hollow needle 2*a-h* is simultaneously submerged in the respective sample fluid contained in the respective reservoir 1*a-h* into which it is inserted. It should be noted that the moveable stage 2' may move the needle unit 2 into this position.

Preferably the second selector valve unit 6 is then moved into its sixth position wherein all of the first, second, third and fourth valves 6*a-d* of the second selector valve unit 6 are closed. The second valve 22 is also configured to be closed, so that the first valve 22 can block the flow of fluid from the second junction 105 into the second waste reservoir 24. When the second selector valve unit 6 is in its sixth position and the second valve 22 is closed, the flow of fluids along the n injection conduits 9*a-h* is restricted; accordingly fluids flowing from the hollow needles 2*a-h* into the n inputs 7*a*'-7*h*' of the first set 107' of inputs of the switching valve unit 7, will flow into the respective buffer conduits 8*a-h* via the n inputs 7*a*"-7*h*" of the second set 107" of inputs of the switching valve unit 7.

The switching valve unit 7 is then arranged in its first configuration so that the switching valve unit 7 simultaneously fluidly connects each of the n inputs 7*a*'-7*h*' of the first set 107' of inputs with a respective n output 7*a*'''-7*h*''' (specifically the switching valve unit 7 simultaneously fluidly connects all of the first, second, third, fourth, fifth, sixth, seventh and eight inputs 7*a*'-7*h*' of the first set 107' of inputs with the respective first, second, third, fourth, fifth, sixth, seventh and eighth outputs 7*a*'''-7*h*''').

Each of then pumping means (12'*a*-12'*h*) is then configured to provide a negative pressure (e.g. negative fluid pressure) so that respective fluids in each of said reservoirs 1*a-h* are aspirated, simultaneously, into the respective hollow needles 2*a-h*, through the respective hollow needles 2*a-h* and through the switching valve unit 7, and into respective buffer conduits 8*a-h*: Specifically, in this example the first immobilization reagent is aspirated into the first hollow needle 2*a* of said needle unit 2, and from there the negative pressure forces the first immobilization reagent to flow through the first hollow needle 2*a*, through the switching valve unit 7, and into the first buffer conduit 8*a*; said first ligands (which are optionally diluted in an acetate buffer) are aspirated into the second hollow needle 2*b* and from there the negative pressure forces the first ligands to flow through the second hollow needle 2*b*, through the switching valve unit 7, and into the second buffer conduit 8*b*; said second ligands (which are optionally diluted in an acetate buffer) are aspirated into the third hollow needle 2*c* and from there the negative pressure forces the second ligands to flow through the third hollow needle 2*c*, through the switching valve unit 7, and into the third buffer conduit 8*c*; said third ligands (which are optionally diluted in an acetate buffer) are aspirated into the fourth hollow needle 2*d* and from there the negative pressure forces the third ligands to flow through the fourth hollow needle 2*d*, through the switching valve unit 7, and into the fourth buffer conduit 8*d*; said fourth ligands (which are optionally diluted in an acetate buffer) are aspirated into the fifth hollow needle 2*e* and from there the negative pressure forces the fourth ligands to flow through the fifth hollow needle 2*e*, through the switching valve unit 7, and into the fifth buffer conduit 8*e*; said second immobilization reagent is aspirated into the sixth hollow needle 2*f* and from there the negative pressure forces the second immobilization reagent to flow through the sixth hollow needle 2*f*, through the switching valve unit 7, and into the sixth buffer conduit 8*f*; and optionally, said buffer fluid in the seventh reservoir 1*g* is aspirated into the seventh needle 2*g*, and from there the negative pressure forces the buffer fluid to flow through the seventh hollow needle 2*g*, through the switching valve unit 7, and into the seventh buffer conduit 8*g*; and optionally, said buffer fluid in the eighth reservoir 1*h* is aspirated into the eighth hollow needle 2*h* and from there the negative pressure forces the buffer fluid to flow through the eighth hollow needle 2*h*, through the switching valve unit 7, and into the eighth buffer conduit 8*h*.

Accordingly, after this step has been performed the first buffer conduit 8*a* contains the first immobilization reagent; the second buffer conduit 8*b* contains the said first ligands (which are optionally diluted in an acetate buffer); the third buffer conduit 8*c* contains said second ligands (which are optionally diluted in an acetate buffer); the fourth buffer conduit 8*d* contains said third ligands (which are optionally diluted in an acetate buffer); the fifth buffer conduit 8*e* contains said fourth ligands (which are optionally diluted in an acetate buffer); the sixth buffer conduit 8*f* contains said second immobilization reagent; and optionally, the seventh buffer conduit 8*g* contains buffer fluid; and optionally, the eighth buffer conduit 8*h* contains buffer fluid.

The switching valve unit 7 arranged in its second configuration so that the switching valve unit 7 blocks the flow of fluid between said n inputs 7*a*'-7*h*' of the first set 107' of inputs and the n outputs 7*a*'''-7*h*'''. In this second configuration the switching valve unit 7 prevents fluid, which is present in any of the n buffer conduits 8*a-h*, from flowing back into the hollow needles 2*a-h*.

The second selector valve unit 6 is arranged in its fifth position so that second selector valve unit 6 fluidly connects all of the outputs 3*a*"-*d*" of all of the flow cells 3*a-d* in the flow cell unit 3 with the first waste reservoir 23.

The first pumping means 12'*a* is then configured to provide a positive pressure; the positive pressure forces the first immobilization reagent present in the first buffer conduit 8*a*, to flow through all of the m flow cells. Specifically the positive pressure provided by the single pumping mean 12 flows into the first buffer conduit 8*a* where the positive pressure pushes the first immobilization reagent along the first buffer conduit 8*a*, into the first input 7*a*" of the second set 107" of inputs of the switching valve unit 7, and then into the first injection conduit 9*a* via the first output 7*a*''' of the switching valve unit 7, along the first injection conduit 9*a*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23.

When the first immobilization reagent flows through the first, second, third and fourth flow cells 3*a-d*, the first immobilization reagent will contact the test surfaces of each flow cell 3*a-d*, thereby activating the test surfaces. Activation of a test surface of a flow cell means providing an immobilization agent (i.e. an agent which can hold a ligand) on the test surface of the flow cell. An immobilization agent may include reactive groups by carboxyl activation for example. Importantly, once a test surface of a flow cell has been activated by the first immobilization agent, ligands which subsequently contact that test surface (e.g. ligands which flow over that test surface) will become attached to said test surface. The ligands which have become attached to the test surface, can in turn bind to molecules in sample fluids which flow through said flow cell. The sensor 50 can be used to detect if molecules in a sample fluid have bound to the ligands on the test surface of a flow cell.

Optionally, the flow cells 3*a-d* in the flow cell unit 3 are then rinsed in a rinsing step: The second pumping means 11 may be selectively configured to dispense a buffer fluid which can be used to rinse the flow cells 3*a-d*. In order to rinse the flow cells 3*a-d* each of the n pumping means 12'*a-h* is configured so that it does not provide any positive or negative pressure (e.g. each of the n pumping means 12'*a-h*); the second selector valve unit 6 is moved into its sixth position wherein all of the first, second, third and fourth valves 6*a-d* of the second selector valve unit 6 are closed; the first valve 22 is configured to be in its open configuration so that fluid can flow from the second junction 105 through the first valve 22 and into the second waste reservoir 24; the third selector valve unit 17 is arranged into its fifth configuration so that the second pumping means 11 is fluidly connected to all of the flow cells 3*a-d*. The second pumping means 11 is then operated to dispense buffer fluid. Specifically, the second pumping means 11 is typically first emptied by configuring the switching valve 11*b* to fluidly connect the syringe 11*a* to the waste reservoir 11*d*, and then dispensing the fluid contents of the syringe 11*a* into the waste reservoir 11*d*. Then the switching valve 11*b* is configured to fluidly connect the syringe 11*a* to the buffer reservoir 11*c*, so as to allow buffer fluid which is preset in the buffer reservoir 11*c*, to pass from the buffer reservoir 11*c* to the syringe 11*a*. The syringe 11*a* is then filled with buffer fluid from the buffer reservoir 11*c* by aspirating buffer fluid from the buffer reservoir 11*c*. The switching valve 11*b* is then configured to fluidly connect the syringe 11*a* to the output 11*e*; the buffer fluid contained in the syringe 11*a* is then dispensed from the syringe 11*a*.

The buffer fluid flows from the second pumping means 11, through all of the valves 17*a-d* of the third selector valve unit 17, along the buffer inlet conduits 16*a*, 16*b*, 16*c*, 16*d*, and into all of the flow cells 3*a-d* in the flow cell unit 3 via the subsidiary conduits 19*a*, 19*b*, 19*c*, 19*d*. Since the second selector valve unit 6 is in its sixth position the buffer fluid will be prevented from flowing along the subsidiary conduits 19*a*, 19*b*, 19*c*, 19*d* and into the first waste reservoir 23, thus the buffer fluid is forced to flow along the subsidiary conduits 19*a*, 19*b*, 19*c*, 19*d* to the flow cells 3*a-d*. When the buffer fluid flows through the flow cells 3*a-d* it will rinse the flow cells 3*a-d*. The buffer fluid flows through the flow cells 3*a-d* and along the single conduit 5', through the second junction 105, through the first valve 22 (which is opened) and into the second waste reservoir 24.

The assembly is kept in this configuration for a predefined amount of time until the flow cells 3*a-d* have been rinsed for said predefined amount of time. Accordingly the second pumping means 11 is maintained in its configuration where it dispenses buffer fluid for said predefined amount of time.

After said predefined amount of time has lapsed, the second pumping means 11 is configured to stop dispensing buffer fluid (e.g. the second pumping means 11 is turned off); and the first valve 22 is configured to be in its closed configuration so that it blocks the flow of fluid from the second junction 105 into the second waste reservoir 24.

Once the above-mentioned, optional, rinsing of the flow cells 3*a-d* has been performed the next steps in the method may be executed:

The second selector valve unit 6 is arranged in its first position wherein the first valve 6*a* is opened and the second, third, fourth valves 6*b-d* are closed thereby fluidly connecting the output 3*a*" of the first flow cell 3*a* only with the first waste reservoir 23. The third selector valve unit 17 is arranged in its first configuration.

The second pumping means 12'*b* is then configured to provide a positive pressure; the positive pressure forces the first ligands present in the second buffer conduit 8*b*, to flow through the first flow cell 3*a* only. Specifically the positive pressure provided by the second pumping means 12'*a* flows into the second buffer conduit 8*b* where the positive pressure pushes the first ligands along the second buffer conduit 8*b*, into the second input 7*b*" of the second set 107" of inputs of the switching valve unit 7, and then into the second injection conduit 9*b* via the second output 7*b*''' of the switching valve unit 7, along the second injection conduit 9*b*, and then along the single conduit 5', and subsequently through the first flow cell 3*a* only, through the first valve 6*a* only of the second selector valve 6 and into the first waste reservoir 23.

Because the second selector valve 6 is in its first position, the first ligands arriving at the flow cell unit 3 from the single conduit 5', will flow through the first flow cell 3*a* only (not through the second, third or fourth flow cells 3*b-d*) and into the first waste reservoir 23. As the first ligands flow through the first flow cell 3*a* they will become attached to the test surface of the first flow cell 3*a* (the first immobilization agent which flowed over the test surface of the first flow cell 3*a* in the preceding step primed the test surface of the first flow cell 3*a* so that the first ligands will attach to the test surface of the first flow cell 3*a* when the first ligands flow over the test surface of the first flow cell 3*a*).

Optionally, the sensor 50 is used to monitor the amount of first ligands which attach to the test surface of the first flow cell 3*a*. This can be done by recording the signal output by the sensor 50 as the first ligands flow through the first flow cell 3*a*.

Optionally, the above-mentioned rinsing step is performed again.

The second selector valve unit 6 is arranged in its second position wherein the second valve 6*b* is opened and the first, third, and fourth valves 6*a,c,d* are closed thereby fluidly connecting the output 3*b*" of the second flow cell 3*b* only with the first waste reservoir 23. The third selector valve unit 17 is arranged in its second configuration.

The third pumping means 12'*c* is then configured to provide a positive pressure; the positive pressure forces the second ligands present in the third buffer conduit 8*c*, to flow through the second flow cell 3*b* only. Specifically the positive pressure provided by the third pumping means 12'*c* flows into the third buffer conduit 8*c* where the positive pressure pushes the second ligands along the third buffer conduit 8*c*, into the third input 7*c*" of the second set 107" of inputs of the switching valve unit 7, and then into the third injection conduit 9*c* via the third output 7*b*'" of the switching valve unit 7, along the third injection conduit 9*c*, and then along the single conduit 5', and subsequently through the second flow cell 3*b* only, and then through the second valve 6*a* only of the second selector valve 6 and into the first waste reservoir 23.

Because the second selector valve 6 is in its second position, the second ligands arriving at the flow cell unit 3 from the single conduit 5', will flow through the second flow cell 3*b* only (not through the first, third or fourth flow cells 3*a,c,d*) and into the first waste reservoir 23. As the second ligands flow through the second flow cell 3*b* they will become attached to the test surface of the second flow cell 3*a* (the first immobilization agent which flowed over the test surface of the second flow cell 3*b* primed the test surface of the second flow cell 3*b* so that the second ligands will attach to the test surface of the second flow cell 3*b* when the second ligands flow over the test surface of the second flow cell 3*b*).

Optionally, the sensor 50 is used to monitor the amount of second ligands which attach to the test surface of the second flow cell 3*b*. This can be done by recording the signal output by the sensor 50 as the second ligands flow through the second flow cell 3*b*.

Optionally, the above-mentioned rinsing step is performed again.

The second selector valve unit 6 is arranged in its third position wherein the third valve 6*c* is opened and the first, second, and fourth valves 6*a,b,d* are closed thereby fluidly connecting the output 3*c*" of the third flow cell 3*c* only with the first waste reservoir 23. The third selector valve unit 17 is arranged in its third configuration.

The fourth pumping means 12'*d* is then configured to provide a positive pressure; the positive pressure forces the third ligands present in the fourth buffer conduit 8*d*, to flow through the third flow cell 3*c* only.

Specifically the positive pressure provided by the single pumping mean 12 flows into the fourth buffer conduit 8*d* where the positive pressure pushes the third ligands along the fourth buffer conduit 8*d*, into the fourth input 7*d*" of the second set 107" of inputs of the switching valve unit 7, and then into the fourth injection conduit 9*d* via the fourth output 7*d*'" of the switching valve unit 7, along the fourth injection conduit 9*d*, and then along the single conduit 5', and subsequently through the third flow cell 3*a* only, and then through the third valve 6*d* only of the second selector valve 6 and into the first waste reservoir 23.

Because the second selector valve 6 is in its third position, the third ligands arriving at the flow cell unit 3 from the single conduit 5', will flow through the third flow cell 3*c* only (not through the first, second or fourth flow cells 3*a,b,d*) and into the first waste reservoir 23. As the third ligands flow through the third flow cell 3*c* they will become attached to the test surface of the third flow cell 3*c* (the first immobilization agent which flowed over the test surface of the third flow cell 3*c* primed the test surface of the third flow cell 3*c* so that the third ligands will attach to the test surface of the third flow cell 3*c* when the third ligands flow over the test surface of the third flow cell 3*b*).

Optionally, the sensor 50 is used to monitor the amount of third ligands which attach to the test surface of the third flow cell 3*c*. This can be done by recording the signal output by the sensor 50 as the third ligands flow through the third flow cell 3*c*.

Optionally, the above-mentioned rinsing step is performed again.

The second selector valve unit 6 is arranged in its fourth position wherein the fourth valve 6*d* is opened and the first, second, and third valves 6*a,b,c* are closed thereby fluidly connecting the output 3*d*" of the fourth flow cell 3*d* only with the first waste reservoir 23. The third selector valve unit 17 is arranged in its fourth configuration.

The fifth pumping means 12'*e* is then configured to provide a positive pressure; the positive pressure forces the fourth ligands present in the fifth buffer conduit 8*e*, to flow through the fourth flow cell 3*d* only.

Specifically the positive pressure provided by the single pumping mean 12 flows into the fifth buffer conduit 8*e* where the positive pressure pushes the fourth ligands along the fifth buffer conduit 8*e*, into the fifth input 7*e*" of the second set 107" of inputs of the switching valve unit 7, and then into the fifth injection conduit 9*e* via the fifth output 7*e*'" of the switching valve unit 7, along the fifth injection conduit 9*e*, and then along the single conduit 5', and subsequently through the fourth flow cell 3*a* only, and then through the fourth valve 6*d* only of the second selector valve 6 and into the first waste reservoir 23.

Because the second selector valve 6 is in its fourth position, the fourth ligands arriving at the flow cell unit 3 from the single conduit 5', will flow through the fourth flow cell 3*d* only (not through the first, second or third flow cells 3*a,b,c*) and into the first waste reservoir 23. As the fourth ligands flow through the fourth flow cell 3*d* they will become attached to the test surface of the fourth flow cell 3*d* (the first immobilization agent which flowed over the test surface of the fourth flow cell 3*c* primed the test surface of the fourth flow cell 3*d* so that the fourth ligands will attach to the test surface of the fourth flow cell 3*d* when the fourth ligands flow over the test surface of the fourth flow cell 3*d*).

In this particular example the fourth ligands are the same as either the first, second, or third ligands, with the exception that the fourth ligands are modified (genetically) so that the fourth ligands lack a specific binding site. Most preferably the aim when screening a plurality of sample fluids is to identify sample(s) which have molecules which can bind to a specific binding site of a ligand. It is possible that molecules bind to other parts of the ligand (which are not binding sites), and molecules of a sample fluid which bind to other parts of the ligand which are not binding sites of the ligand, are referred to as being a sticky compound". Advantageously, having a fourth ligands which are the same as either the first, second, or third ligands, with the exception that the fourth ligands are modified (genetically) so that the fourth ligands lack a specific binding site, allows to identify if a sample fluid contains a "sticky compound", thus allowing to determine if molecules of a sample fluid which have bound to ligands in that flow cell have bound to the specific binding site of the ligand or have likely bound to another part of the ligand. For example, if the fourth ligands are the same as the first ligands, but are modified (genetically) so that the fourth ligands lack a specific binding site, and molecules within a sample fluid which has been passed through the flow cells 3*a-d* were shown (via the sensor) to bind to the first ligands in the first flow cell, and to also bind to the fourth ligands in the fourth flow cell, this indicates that the sample fluid contains a "sticky compound" and potentially the molecules of the sample fluid did not bind to the specific binding site on the first ligands but rather bound to another part of the first ligands (often such a sample fluid would not be considered as a good drug candidate for binding to equivalent ligands within the human body). If on the other hand the molecules within a sample fluid which has been passed through the flow cells 3*a-d* was shown (via the sensor) to bind to the first ligands in the first flow cell, but not to bind to the fourth ligands in the fourth flow cell, this indicates that sample fluid does not contain a "sticky compound" and that the molecules of the sample fluid did bind to the specific binding site on the first ligands (often such a sample fluid would be considered to be a good drug candidate for binding to equivalent ligands within the human body).

Optionally, the sensor 50 is used to monitor the amount of fourth ligands which attach to the test surface of the fourth flow cell 3*d*. This can be done by recording the signal output by the sensor 50 as the fourth ligands flow through the fourth flow cell 3*d*.

Optionally, the above-mentioned rinsing step is performed again.

It should be understood that providing the fourth flow cell with ligands (in this case fourth ligands) is an optional step; in a variation of this embodiment the fourth flow cell is not provided with any ligands on its test surface. According the test surface of the fourth flow cell 3*d* is without any ligands. In such a case the output of the sensor measuring binding in the fourth flow cell, when the sample fluid passes through all of the flow cells, can be used as a reference signal, to which the output of the sensor measuring binding in the first, second, and third flow cell 3*a-c* can be compared. When a sample fluid is passed through all of the flow cells 3*a-d*, and if the output of the sensor measuring binding in the first flow cell 3*a*, differs from the output of the sensor measuring binding in the fourth flow cell 3*d*, this indicates that molecules of that sample fluid have bound to the first ligands in the first flow cell 3*a*. Likewise when a sample fluid is passed through all of the flow cells 3*a-d*, and if the output of the sensor measuring binding in the second flow cell 3*b*, differs from the output of the sensor measuring binding in the fourth flow cell 3*d*, this indicates that molecules of that sample fluid have bound to the second ligands in the second flow cell 3*b*. Likewise, when a sample fluid is passed through all of the flow cells 3*a-d*, and if the output of the sensor measuring binding in the third flow cell 3*c*, differs from the output of the sensor measuring binding in the fourth flow cell 3*d*, this indicates that molecules of that sample fluid have bound to the third ligands in the third flow cell 3*c.a*

Referring back to the present embodiment, the second selector valve unit 6 is arranged in its fifth position so that second selector valve unit 6 fluidly connects all of the outputs 3*a*"-*d*" of all of the flow cells 3*a-d* in the flow cell unit 3 with the first waste reservoir 23.

The sixth pumping means 12'*f* is then configured to provide a positive pressure; the positive pressure forces the second immobilization reagent present in the sixth buffer conduit 8*f*, to flow through all of the m flow cells 3*a-d*.

Specifically the positive pressure provided by the single pumping mean 12 flows into the sixth buffer conduit 8*f* where the positive pressure pushes the second immobilization reagent along the sixth buffer conduit 8*f*, into the sixth input 7*f*" of the second set 107" of inputs of the switching valve unit 7, and then into the sixth injection conduit 9*f* via the sixth output 7*f*'" of the switching valve unit 7, along the sixth injection conduit 9*f*, and then along the single conduit 5', and subsequently through the first, second, third and fourth flow cells 3*a-d*, through the second selector valve 6 (i.e. through the first, second, third and/or fourth valves 6*a-d* of the second selector valve 6) and into the first waste reservoir 23.

When the second immobilization reagent flows through the first, second, third and fourth flow cells 3*a-d*, the second immobilization reagent will act to passivate the test surfaces of the respective first, second, third and fourth flow cells 3*a-d*. In the present application to passivate a test surface means to provide a passivating agent on the test surface, wherein a passivating agent is an agent removes immobilization agents from the test surface (thereby ensuring that there is no immobilization agent which can hold a ligand present on the test surface, thus ensuring that there is no ligands present on the test surface). An example of a passivating agent includes, but is not limited to, Ethanolamine.

Optionally, the above-mentioned rinsing step is performed again.

Optionally, The second selector valve unit 6 is maintained in its fifth position so that second selector valve unit 6 fluidly connects all of the outputs 3*a*"-*d*" of all of the flow cells 3*a-d* in the flow cell unit 3 with the first waste reservoir 23.

The seventh pumping means 12'*g* is then configured to provide a positive pressure; the positive pressure forces the optional buffer which is present in the seventh buffer conduit 8*g*, to flow through all of the m flow cells 3*a-h*.

Specifically the positive pressure provided by the single pumping mean 12 flows into the seventh buffer conduit 8*g* where the positive pressure pushes the buffer along the seventh buffer conduit 8*g*, into the seventh input 7*g*" of the second set 107" of inputs of the switching valve unit 7, and then into the seventh injection conduit 9*g* via the seventh output 7*g*'" of the switching valve unit 7, along the seventh injection conduit 9*g*, and then along the single conduit 5', and subsequently through the first, second, third and fourth flow cells 3*a-d*, and through the second selector valve 6 (i.e. through the first, second, third and/or fourth valves 6*a-d* of the second selector valve 6) and into the first waste reservoir 23.

When the buffer flows through the first, second, third and fourth flow cells 3*a-d*, the buffer will act to equilibrate the test surfaces within the flow cells 3*a-d*.

Optionally, the above-mentioned rinsing step is performed again.

Optionally, the second selector valve unit 6 is maintained in its fifth position so that second selector valve unit 6 fluidly connects all of the outputs 3*a*"-*d*" of all of the flow cells 3*a-d* in the flow cell unit 3 with the first waste reservoir 23.

The eight pumping means 12'*g* is then configured to provide a positive pressure; the positive pressure forces the optional buffer which is present in the eighth buffer conduit 8*h*, to flow through all of the m flow cells 3*a-h*.

Specifically the positive pressure provided by the single pumping mean 12 flows into the eighth buffer conduit 8*h* where the positive pressure pushes the buffer along the eighth buffer conduit 8*h*, into the eighth input 7*h*" of the second set 107" of inputs of the switching valve unit 7, and then into the eighth injection conduit 9*h* via the eighth output 7*h*'" of the switching valve unit 7, along the eighth injection conduit 9*h*, and then along the single conduit 5', and subsequently through the first, second, third and fourth flow cells 3*a-d*, and through the second selector valve 6 (i.e. through the first, second, third and/or fourth valves 6*a-d* of the second selector valve 6) and into the first waste reservoir 23.

When the buffer flows through the first, second, third and fourth flow cells 3*a-d*, the buffer will act to equilibrate the test surfaces within the flow cells 3*a-d*. Example of suitable buffers are Phosphate-buffered saline (PBS), or buffers based on 4-(2-hydroxyethyl)-1-piperazineethanesulfonic acid) (HEPES).

Optionally, the above-mentioned rinsing step is performed again.

Optionally the hollow needles 2*a-h* in the needle unit 2 are then washed. Most preferably the hollow needles 2*a-h* are washed before they are filled with sample fluids which is to undergo screening according to the afore-method. For example after the ligands have been provided on the test surfaces of the respective flow cells 3 the moveable stage 2' may operate to move the needle unit 2 to the wash station 28 where the hollow needles 2*a-h* are washed; after the hollow needles 2*a-h* have been washed the moveable stage 2' moves the needle unit 2 to a position over the sample tray holder 1 where each of the needle unit 2 can aspirate sample fluids from respective reservoirs which are to be screened.

It should be understood that the first, second, third and fourth ligands may take any suitable form. The first, second, third and fourth ligands can bind to molecules which have a predefined characteristic such as having a high affinity to the ligands either via a simple lock-and-key mechanism where a molecule fits into a binding pocket of a ligand, or assisted by more complex molecular processes such as conformational changes. Thus, it can be determined which molecules in a sample fluid have said predefined characteristic of having a high affinity to the ligands, by passing the sample fluid over the surfaces of the flow cell unit 3 and then determining which molecules have become bound to the ligands. In drug discovery applications where a multitude of molecules from a compound library are screened for finding suitable drug candidates binding to a drug target, typically, the different ligands can be used to exclude non-specific binding effects, for instance by providing a drug target as first ligands, and similar molecules as the drug target but lacking a specific binding pocket as second and third and fourth ligands. Thus, any of the flow cells comprising test surfaces with immobilized second, third or fourth ligands can be used as reference flow cell. In another example, three different drug targets are provided as first, second and third ligands on the test surfaces of three flow cells, and the fourth flow cell is the reference flow cell with an empty test surface.

Figure 4:
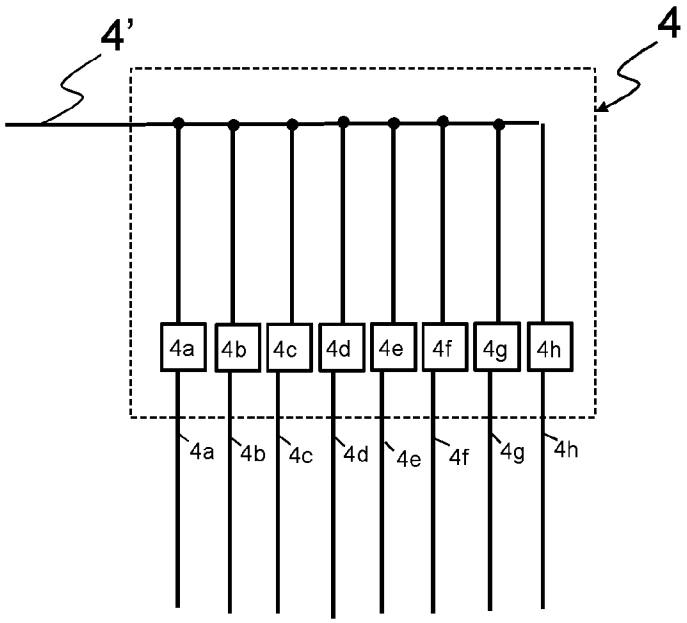
FIG. 4 shows a magnified view of one implementation of the first selector valve unit 4 which can be used in any of the assemblies of FIGS. 1-3.

FIG. 4 shows a magnified view of one possible implementation of the first selector valve unit 4 which can be used in any of the assemblies of the present invention. As shown FIG. 4 the first selector valve 4 has a single input 4' (which is to be fluidly connected to the single pumping mean 12 in the assembly), and plurality of outputs 4*a-h* (namely a first output 4*a*; a second output 4*b*; a third output 4*c*; a fourth output 4*d*; a fifth output 4*e*; a sixth output 4*f*; a seventh output 4*g*; an eighth output 4*h*). Most preferably the number of outputs 4*a-h* which the first selector valve unit 4 has corresponds to the number of hollow needles in the needle unit 2 (which in the above described assemblies is eight); however it will be understood that the first selector valve unit 4 could have any number of outputs 4*a-h*.

The first selector valve 4 comprises a plurality of valves 4*a*'-*h*'. Most preferably the number of valves 4*a*'-*h*' corresponds to the number of outputs 4*a-h*; therefore in this example the first selector valve 4 comprises eight valves 4*a*'-*h*' (namely a first valve 4*a*'; a second valve 4*b*'; a third valve 4*c*'; a fourth valve 4*d*'; a fifth valve 4*e*'; a sixth valve 4*f*'; a seventh valve 4*g*'; an eighth valve 4*h*'). Each valve 4*a*'-*h*' is fluidly connected between the single input 4' of the first selector valve 4 and a respective output 4*a-h*. Each valve 4*a*'-*h*' can be arranged in an open configuration or a closed configuration; when a valve 4*a*'-*h*' is in its open configuration that valve 4*a*'-*h*' fluidly connects the single input 4' to a respective output 4*a-h*, when a valve 4*a*'-*h*' is in its closed configuration that valve 4*a*'-*h*' blocks the flow of fluid from the single input 4' to said respective output 4*a-h*.

As mentioned with respect to the exemplary assemblies 101-103, the first selector valve unit 4 can be selectively configured into any one of n+1 different configurations (wherein n is the number of hollow needles 2*a-h* in the needle unit 2): when the first selector valve unit 4 is in a first configuration the single input 4' is fluidly connected to the first output 4*a* only; in the implementation shown in FIG. 4 the first configuration is achieved by opening the first valve 4*a*' only and closing each of the other valves 4*b*'-4*h*'. When the first selector valve unit 4 is in a second configuration the single input 4' is fluidly connected to the second output 4*b* only; in the implementation shown in FIG. 4 the second configuration is achieved by opening the second valve 4*b*' only and closing each of the other valves 4*a*',4*c*'-4*h*'. When the first selector valve unit 4 is in a third configuration the single input 4' is fluidly connected to the third output 4*c* only; in the implementation shown in FIG. 4 this third configuration is achieved by opening the third valve 4*c*' only and closing each of the other valves 4*a*',*b*',4*d*'-4*h*'. When the first selector valve unit 4 is in a fourth configuration the single input 4' is fluidly connected to the fourth output 4*d* only; in the implementation shown in FIG. 4 this fourth configuration is achieved by opening the fourth valve 4*d*' only and closing each of the other valves 4*a*'-*c*' and 4*e*'-*h*'. When the first selector valve unit 4 is in a fifth configuration the single input 4' is fluidly connected to the fifth output 4*e* only; in the implementation shown in FIG. 4 this fifth configuration is achieved by opening the fifth valve 4*e*' only and closing each of the other valves 4*a*'-*d*' and 4*f*'-*h*'. When the first selector valve unit 4 is in a sixth configuration the single input 4' is fluidly connected to the sixth output 4*f* only; in the implementation shown in FIG. 4 this sixth configuration is achieved by opening the sixth valve 4*f*' only and closing each of the other valves 4*a*'-*e*' and 4*g*'-*h*'. When the first selector valve unit 4 is in a seventh configuration the single input 4' is fluidly connected to the seventh output 4*g* only; in the implementation shown in FIG. 4 this seventh configuration is achieved by opening the seventh valve 4*g*' only and closing each of the other valves 4*a*'-*f*' and 4*h*'. When the first selector valve unit 4 is in an eighth configuration the single input 4' is fluidly connected to the eighth output 4*h* only; in the implementation shown in FIG. 4 this eighth configuration is achieved by opening the eighth valve 4*h*' only and closing each of the other valves 4*a*'-*g*'. When the first selector valve unit 4 is in a ninth configuration the single input 4' is simultaneously fluidly connected to all of the first, second, third, fourth, fifth, sixth, seventh, and eighth outputs 4*a-h*. In the implementation shown in FIG. 4 the ninth configuration is achieved by opening the all of the valves 4*a'-h'* (more specifically by having all of the valves 4*a'-h'* open simultaneously).

Figure 5:
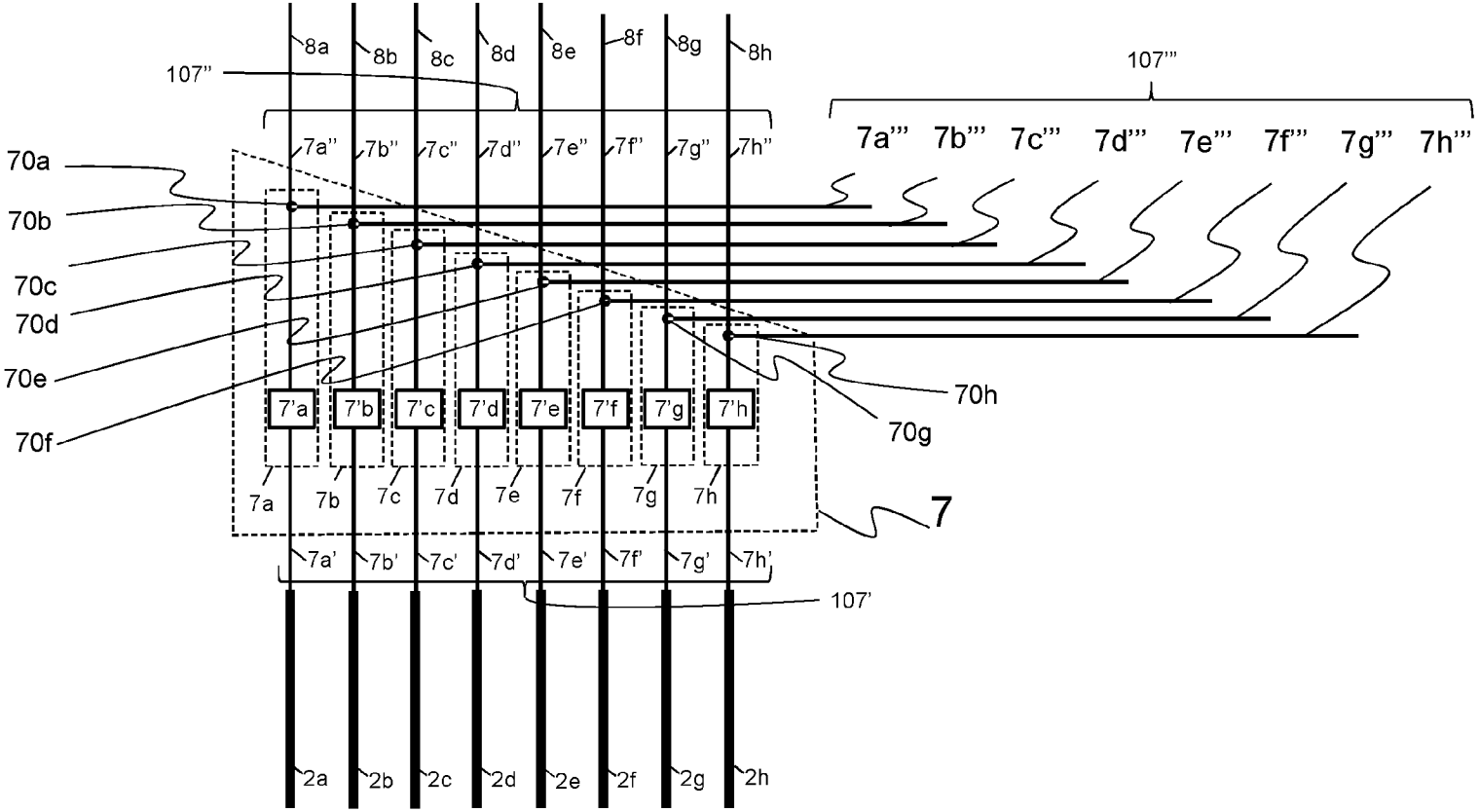
FIG. 5 shows a magnified view of one implementation of the switching valve unit 7, which can be used any of the assemblies of the present invention.

FIG. 5 shows a magnified view of one possible implementation of the switching valve unit 7 which can be used in any of the assemblies of the present invention.

As already described in the assembly embodiment above, the switching valve unit 7 has a first set 107' of inputs 7*a'-h'*, and a second set 107" of inputs 7*a"-h"*, and a set 107''' of outputs 7*a'''-h'''*.

The first set 107' of inputs comprises a plurality of inputs 7*a'-h'* (in this example n inputs) (which are to be fluidly connected to respective n hollow needles 2*a-h* in the assembly). Most preferably the number of inputs 7*a'-h'* in the first set 107' of inputs correspond to the number of hollow needles 2*a-h* in the needle unit 2.

The second set 107" of inputs comprises a plurality of inputs 7*a"-h"* (in this example n inputs) (which are to be fluidly connected to respective n outputs 4*a-h* of the first selector valve unit 4 in the assembly). Preferably the number of inputs 7*a"-h"* in the second set 107" of inputs correspond to the number of inputs 7*a'-h'* in the first set 107' of inputs. Preferably the number of inputs 7*a"-h"* in the second set 107" of inputs correspond to the number of hollow needles 2*a-h* in the needle unit 2. Preferably the number of inputs 7*a"-h"* in the second set 107" of inputs correspond to the number of outputs 4*a-h* of the first selector valve unit 4.

The set of outputs 107''' comprises a plurality of outputs 7*a'''-h'''*. Each of said outputs 7*a'''-h'''* are to be fluidly connected to a respective injection conduit 9*a-h* in the assembly. Preferably the number of outputs 7*a'''-h'''* correspond to the number of hollow needles 2*a-h* in the needle unit 2. Preferably the number of outputs 7*a'''-h'''* correspond to the number of inputs 7*a"-h"* in the second set 107" of inputs and also correspond to the number of inputs 7*a'-h'* in the first set 107' of inputs.

Each respective input 7*a"-h"* of the second set 107" of inputs is fluidly connected to a respective output 7*a'''-h'''* at respective junction 70*a-h*. Each of said junctions 70*a-h* are preferably valveless.

The switching valve unit 7 further comprises a plurality of valves 7'*a-h*. The number of valves preferably correspond to the number of hollow needles 2*a-h* in the needle unit 2. Each respective valve 7'*a-h* has an input which is fluidly connected to a respective input 7*a'-h'* of the first set 107', and an output which is fluidly connected to a respective junction 70*a-h*. Accordingly, each respective valve 7'*a-h* is located between a respective input 7*a'-h'* of the first set 107' of inputs and a respective junction 70*a-h*. Each respective valve 7'*a-h* can be selectively arranged in an open configuration or a closed configuration; when a valve 7'*a-h* is in its open configuration fluid can flow from the respective input of the valve to the respective junction 70*a-h*, and thus fluid can flow from the respective input 7*a'-h'* of the first set 107' of inputs to which the input of said valve 7'*a-h* is connected, to the respective junction 70*a-h* to which the output of said valve 7'*a-h* is connected.

As already described with respect to the assemblies 101-103 above, the switching valve unit 7 can be selectively arranged in a first configuration or a second configuration, wherein in said first configuration the switching valve unit 7 fluidly connects the n inputs 7*a'-h'* of the first set 107' of inputs with said n inputs 7*a"-h"* of the second set 107" of inputs, and in said second configuration the switching valve unit 7 blocks the flow of fluid between the n inputs 7*a'-h'* of the first set 107' of inputs and said n inputs 7*a"-h"* of the second set 107" of inputs. In the implementation shown in FIG. 3, the first configuration is achieved by opening all of the valves 7'*a-h*; and the second configuration is achieved by closing all of the valves 7'*a-h*.

In another preferred embodiment, the switching valve unit 7 comprises a rotary valve with custom rotor and stator to simultaneously allow parallel opening and closing of the respective conduits.

It should be understood that the flow cell unit 3 used in any of the above-mentioned assembly embodiments may be provided in a cartridge which can be selectively removed from the assembly; the cartridge may be a disposable cartridge for example. It should be understood that the cartridge may take any suitable form; however, the cartridge will always contain the flow cells 3*a-d* of the flow cell unit 3.

Figure 7:
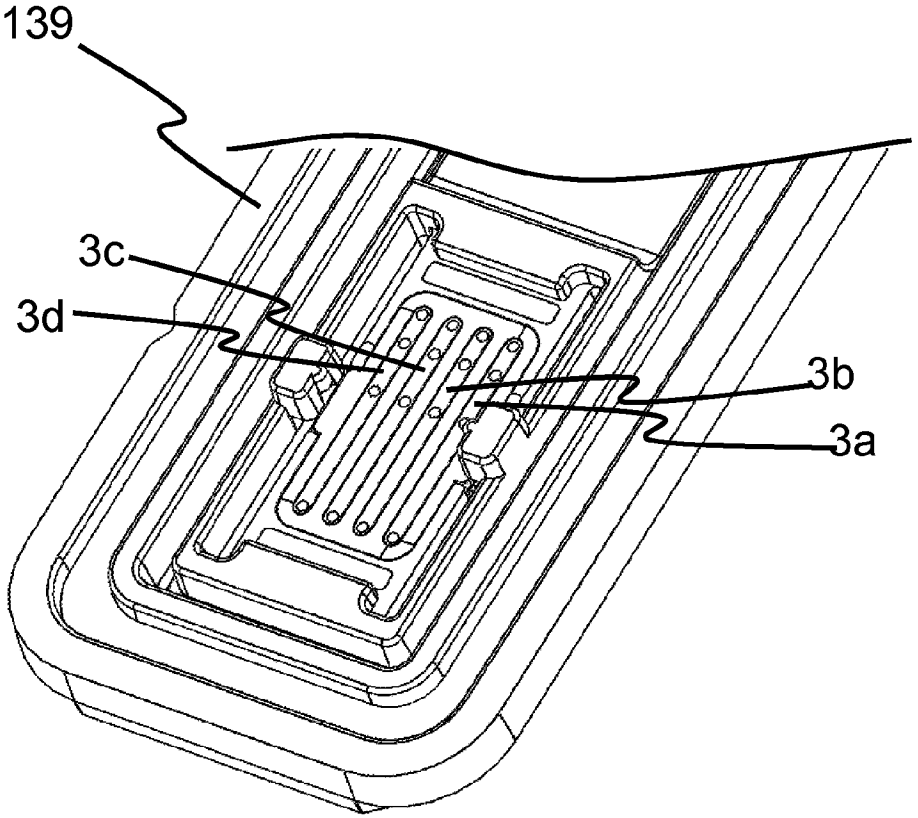
FIG. 7 provides the bottom view of a disposable cartridge, which can contain the flow cells which make up cell unit in any of the assemblies of FIG. 1 or 2.

FIG. 7 provides the bottom view of portion of an exemplary cartridge. In this example the cartridge 139 is a disposable cartridge. Referring to FIG. 7 there is shown the flow cells 3*a-d* of the flow cell unit 3 provided in the disposable cartridge 139. The flow cells 3*a-d* are integral to the disposable cartridge 139. When the flow cells 3*a-d* of the cartridge become damaged or non-useable the cartridge is simply removed, and a new cartridge is provided in the assembly.

Figure 6B:
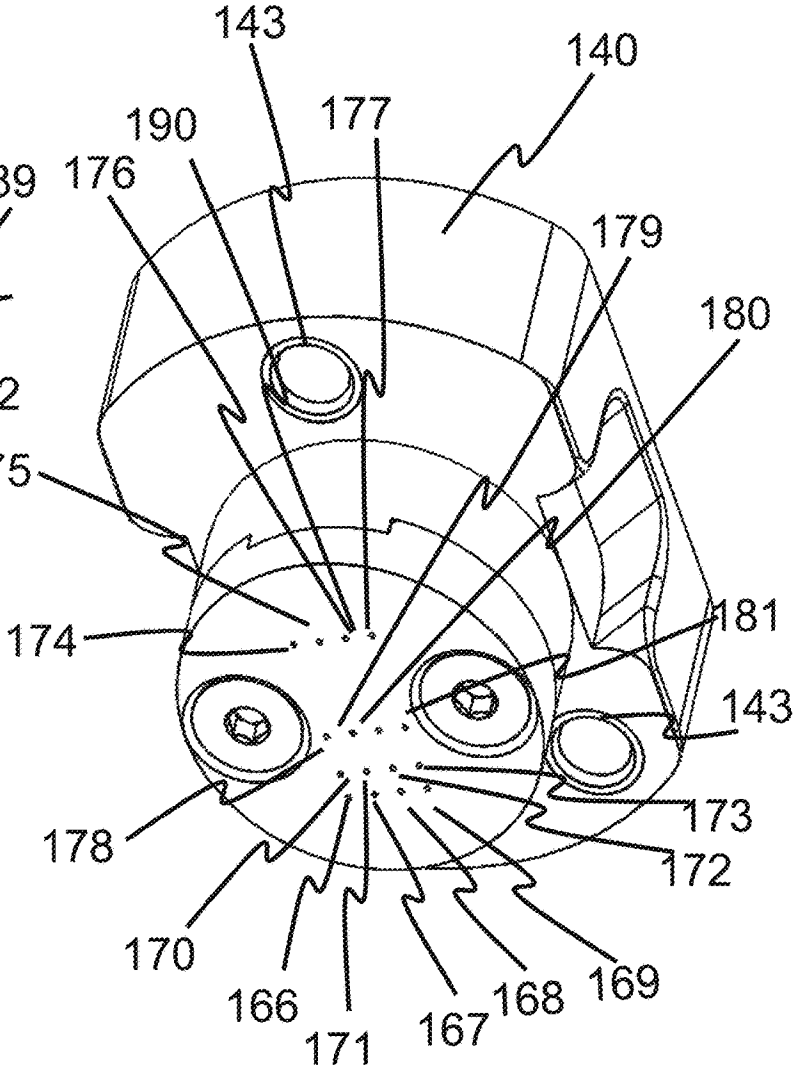
FIG. 6*a* provides a perspective view of a portion of a disposable cartridge and FIG. 6*b* provides a perspective view of a plunger assembly, wherein the disposable cartridge and plunger assembly can mechanically cooperate with one another.
Figure 6A:
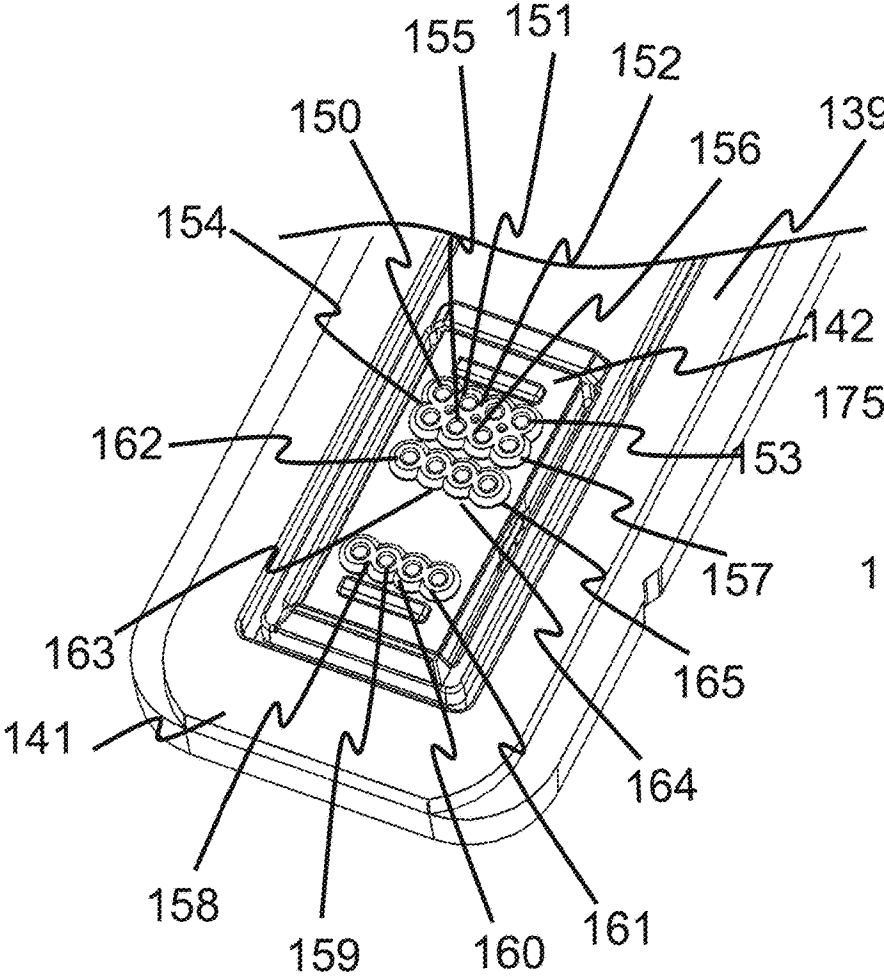

FIG. 6*a* provides a perspective view of a portion of the disposable cartridge 139 and FIG. 6*b* provides a perspective view of an exemplary plunger assembly 140, wherein the disposable cartridge 139 and plunger assembly 140 can mechanically cooperate with one another; the disposable cartridge 139 and plunger assembly 140 can be used in any of the above-mentioned assemblies.

FIG. 6*a* shows a partial perspective-top view of the cartridge 139, which can be used in any of above-described assemblies to define the flow cell unit 3. The cartridge 139 comprises fluidic interfaces 150-165. Each fluidic interface 150-165 comprises a ring member made of an elastomeric compound such as EPDM, FKM or silicone. FIG. 6*b* shows a perspective-bottom view of a plunger assembly 140 which is fixed part of the assembly. The plunger assembly 140 is suitable for cooperating with the cartridge 139. The plunger assembly 140 further comprises fluidic channels 190 having positions corresponding the positions fluidic interfaces 150-165 provided in the cartridge 139; the respective rim at the open end of each fluidic channel 190 defines a corresponding interface 166-181. The number of fluidic channels preferably corresponds to the number of fluidic interfaces 150-165 provided on the cartridge.

The cartridge 139 comprise a main body 141, the main body 141 may be injected molded, preferably comprising a thermoplastic material such as Polycarbonate or Cyclic Olefin Copolymer Preferably the plunger assembly comprises hard and inert material with high resistance to chemicals, for example precision machined or polished stainless steel or PEEK.

The plunger assembly 140 comprises linear bearings 143 which allow it to be movable in a direction perpendicular to the plane of fluidic interfaces 150-165 of the cartridge 139; in particular, the plunger assembly 140 can be moved to abut the cartridge 139 so as to bring the respective rim at the open end of each fluidic channel 190 which defines a corresponding interface 166-181, into abutment with a corresponding ring member with defines a respective fluidic interface 150-165 on the cartridge. The plunger assembly 140 and cartridge 139 may be maintained in such a position (i.e. a position where by the interfaces are aligned and abut) by means of a pinion such as a stainless steel bolt, or a spring.

Preferably, the plunger assembly 140 is positioned in the assembly so that the respective rims at the open end of each fluidic channel 190 which defines a corresponding interface 166-181, abut respective ring members on the cartridge 139 with define respective fluidic interface 150-165 form a fluid-impermeable seal between the fluidic interfaces 150-165 on the cartridge 139 and the fluidic interfaces 166-181 on the plunger assembly 140. Preferably the plunger assembly 140 is positioned so that the respective rims at the open end of each fluidic channel 190 which defines a corresponding interface 166-181, compress respective ring members on the cartridge 139 with define respective fluidic interface 150-165 form a fluid-impermeable seal between the fluidic interfaces 150-165 on the cartridge 139 and the fluidic interfaces 166-181 on the plunger assembly 140. As an example, the respective rim at the open end of the fluidic channel 190 which defines a fluidic interface 174 is pressed onto the small rings forming the ninth fluidic interface 158, thereby combining and sealing the cartridge part of the second conduit 15 and the fixed parts of the second conduit 15. When moving the plunger assembly 140 away from the cartridge, the fluidic interfaces are separated allowing easy removal and disposable and replacement of the cartridge 139.

In the depicted embodiment, the fluidic interfaces 150-165 on the cartridge 139 comprise rings of elastomeric material; preferably the rings are provided as a sinnle substrate and that sinnle substrate is attached to the main body 141 of the cartridge 139; the centre of each ring is aligned with a respective hole which is defined in the main body 141. In a further preferred embodiment, the fluidic interfaces 150-165 are formed integral to the main body 141 of the cartridge 139; in such an embodiment the main body 141 and the fluidic interfaces 150-165 may both be formed from a single injection molded part; the single injection molded part may comprise dual materials and integrated elastomeric ring seals.

Various modifications and variations to the described embodiments of the invention will be apparent to those skilled in the art without departing from the scope of the invention as defined in the appended claims. Although the invention has been described in connection with specific preferred embodiments, it should be understood that the invention as claimed should not be unduly limited to such specific embodiment.

The invention claimed is:

1. An assembly comprising, a needle unit comprising 'n' hollow needles, wherein n is greater than one, and wherein each hollow needle can receive a respective sample fluid;

a flow cell unit comprising 'm' flow cells, wherein 'm' is greater than one, each flow cell having an input and an output, and a test surface on which ligands can be provided located between the input and output;

a means for consecutively moving sample fluids, from each of said n hollow needles respectively, into all said m flow cells, so that said sample fluids flow consecutively through the same flow cells.

2. An assembly according to claim 1 wherein, said means for consecutively moving sample fluids, from each of said n hollow needles respectively, into all said m flow cells, comprises at least one pumping means which is selectively operable to provide positive pressure or negative pressure;

a switching valve unit having a first set of inputs comprising n inputs which are fluidly connected to respective n hollow needles, and a second set of inputs comprising n inputs which are fluidly connectable to said at least one pumping means, and a set of outputs comprising n outputs, and wherein the switching valve unit is selectively arrangeable in a first configuration or a second configuration, wherein in said first configuration the switching valve unit fluidly connects one or more of the n inputs of the first set of inputs with one or more of said n outputs, and in said second configuration the switching valve unit blocks the flow of fluid between the one or more of the n inputs of the first set of inputs with one or more of said n outputs.

3. An assembly according to claim 2 wherein said means for consecutively moving sample fluids, from each of said n hollow needles respectively, into all said m flow cells, comprises, a single pumping means which is selectively operable to provide positive fluid pressure or negative fluid pressure; and a first selector valve unit having a single input which is fluidly connected to the single pumping means, and n outputs and wherein first selector valve unit is configured such that it can selectively fluidly connect its single input with one or more of its n outputs; and wherein the switching valve unit comprises a first set of inputs comprising n inputs which are fluidly connected to respective n hollow needles, and a second set of inputs comprising n inputs which are fluidly connected to respective n outputs of the first selector valve unit, and a set of outputs comprising n outputs, and wherein the switching valve unit is selectively arrangeable in a first configuration or a second configuration, wherein in said first configuration the switching valve unit fluidly connects one or more of the n inputs of the first set of inputs with one or more of said n outputs, and in said second configuration the switching valve unit blocks the flow of fluid between the one or more of the n inputs of the first set of inputs with one or more of said n outputs.

4. An assembly according to claim 3 wherein the first selector valve unit comprises n valves, each valve being fluidly connected to said single pumping means, and each being fluidly connected to a respective one of said n outputs of said first selector valve unit, wherein each of the n valves is selectively configurable to be opened or closed.

5. An assembly according to claim 3 wherein the switching valve unit comprises n switching valve subunits, wherein each subunit comprises a first port which is fluidly connected to a respective hollow needle, a second port which is fluidly connected to a respective output of the first selector valve unit, and third port which is fluidly connected to a respective output of the switching valve unit.

6. An assembly according to claim 3 wherein the switching valve unit comprises n switching valve subunits, wherein each subunit comprises a valve which is selectively configurable to be opened or closed, and one valveless junction wherein, a respective output of the first selector valve unit is fluidly connected to the said valveless junction, said valve is fluidly connected to said valveless junction, and one of said n outputs of said switching valve unit is fluidly connected to said valveless junction; and wherein said valve is arranged between a respective one of said n needles and said valveless junction.

7. An assembly according to claim 3 wherein each respective output of the first selector valve unit is fluidly connected to a respective input of the switching valve unit via a respective conduit.

8. An assembly according to claim 2 wherein said means for consecutively moving sample fluids, from each of said n hollow needles respectively, into all said m flow cells, comprises, n pumping means each of which has a respective output so as to provide n outputs, and wherein each of said n pumping means is selectively operable to provide positive fluid pressure or negative fluid pressure at its respective outputs; and wherein the switching valve unit comprises a first set of inputs comprising n inputs which are fluidly connected to respective n hollow needles, and a second set of inputs comprising n inputs which are fluidly connected to respective n outputs of said respective n pumping means, and a set of outputs comprising n outputs, and wherein the switching valve unit is selectively arrangeable in a first configuration or a second configuration, wherein in said first configuration the switching valve unit fluidly connects one or more of the n inputs of the first set of inputs with one or more of said n outputs, and in said second configuration the switching valve unit blocks the flow of fluid between the one or more of the n inputs of the first set of inputs with one or more of said n outputs.

9. An assembly according to claim 2, wherein each of said n outputs of said switching valve unit are fluidly connected to a single conduit, and wherein said single conduit is fluidly connected to respective m inputs of said m flow cells in said flow cell unit.

10. An assembly according to claim 9 wherein each respective output of the switching valve unit is fluidly connected to said single conduit, via a respective injection conduit.

11. An assembly according to claim 9, wherein the assembly further comprises a first valve and a waste reservoir, and wherein the first valve is fluidly connected between said waste reservoir and a second junction, wherein said second junction is located between where the n outputs of said switching valve unit are fluidly connected to said single conduit and the m inputs of said m flow cells in said flow cell unit.

12. An assembly according to claim 1 further comprising, a waste reservoir; and a second selector valve unit, wherein the second selector valve unit is fluidly connected between respective m outputs of the m flow cells in said flow cell unit and said waste reservoir, and wherein the second selector valve unit is configured to selectively fluidly connect one or more of said m outputs of the m flow cells with a first waste reservoir.

13. An assembly according to claim 1 further comprising, a second pumping means which is selectively operable to provide positive pressure or negative pressure; and a third selector valve unit which is arranged between the second pumping means and respective m outputs of the m flow cells, wherein the third selector valve unit is configured to selectively fluidly connect the second pumping means with one or more of said m outputs of the m flow cells.

14. An assembly according to claim 1 further comprising, a third pumping means which is selectively operable to provide positive pressure or negative pressure, wherein said third pumping means is fluidly connected to a third junction, wherein said third junction is located between where the n outputs of said switching valve unit are fluidly connected to a single conduit and the m inputs of said m flow cells in said flow cell unit.

15. An assembly according to claim 2, wherein each of said n outputs of said switching valve unit are fluidly connected to a single conduit, and wherein said single conduit is fluidly connected to respective m inputs of said m flow cells in said flow cell unit; and wherein the assembly further comprises a waste reservoir which is fluidly connected to a valve, and wherein the valve is fluidly connected to a junction, such that the valve is located between said junction and said waste reservoir, and wherein the valve is moveable between a first position wherein the junction is fluidly connected to said waste reservoir, and a second position wherein the valve blocks the flow of fluid from the junction to the waste reservoir; and a auxiliary sample delivery unit which is fluidly connected to said junction;

wherein the assembly further comprising an addressing means, which comprises, a first port which is fluidly connected to said single conduit down-stream of where the n outputs of said switching valve unit are fluidly connected to a single conduit; and a second port which is fluidly connected to said junction; and a third port which is fluidly connected to the inputs of one or more of said m flow cells; and a fourth port which is fluidly connected to the inputs of one or more other of said m flow cells; and wherein the addressing means further comprises a valve which is configured such that it is selectively arrangeable in first configuration and a second configuration, wherein in the first configuration the valve fluidly connects the first port with the third port and fluidly connects the second port and the fourth port, and wherein in the second configuration the valve fluidly connects the first port with fourth port, and fluidly connects the third port with the second port.

16. An assembly according to claim 15 wherein the m flow cells comprise at least a first subset of flow cells and a second subset of flow cells; and wherein the third port is fluidly connected to the inputs of all of the flow cells in the first subset; and the fourth port which is fluidly connected to the inputs of all of the flow cells in the second subset.

17. An assembly according to claim 16 further comprising, a second pumping means which is selectively operable to provide positive pressure or negative pressure;

a third pumping means which is selectively operable to provide positive pressure or negative pressure;

a first valve which is fluidly connected to the outputs of all of the flow cells in the first subset, and which is fluidly connected to the second pumping means, wherein the first valve is arranged between said outputs and said second pumping means and is selectively arrangeable in a first configuration wherein the first valve fluidly connects the outputs of all of the flow cells in the first subset with the second pumping means, and a second configuration wherein the first valve blocks the flow of fluid between the outputs of all of the flow cells in the first subset and the second pumping means;

a second valve which is fluidly connected to the outputs of all of the flow cells in the second subset, and which is fluidly connected to the third pumping means, wherein the second valve is arranged between said outputs and said third pumping means and is selectively arrangeable in a first configuration wherein the second valve fluidly connects the outputs of all of the flow cells in the second subset with the third pumping means, and a second configuration wherein the second valve blocks the flow of fluid between the outputs of all of the flow cells in the first subset and the third pumping means.

18. An assembly according to claim 1 further comprising, a moveable stage which is configured to move the needle unit between a first position where hollow needles of the needle unit can be washed and a second position where sample fluid is provided in the hollow needles of the needle unit.

19. A method of screening sample fluids for molecules which can bind to predefined ligands, using the assembly of claim 1, the method comprising the steps of, receiving a respective sample fluid into each of said n hollow needles;

consecutively moving each sample fluid, from its respective hollow needle, into all said m flow cells, so that said sample fluids are made to consecutively flow through said same flow cells.

20. A method according to claim 19, using the assembly of claim 3, comprising the steps of, (a) arranging the switching valve unit in its first configuration;

(b) arranging the first selector valve unit such that it fluidly connect its single input with all of its n outputs;

(c) operating the pumping means to provide a negative pressure so that sample fluids in each of said needles are forced to flow out of the respective needles and through the switching valve unit, wherein the sample fluid in each respective needle is different;

(d) arranging the switching valve unit in its second configuration;

(e) arranging the first selector valve unit such that it fluidly connect its single input with one of its n outputs;

(f) operating the pumping means to provide a positive pressure so that one of said sample fluids is forced to flow through each of said m flow cells;

(g) arranging the first selector valve unit such that it fluidly connect its single input with another one of its n outputs;

(h) operating the pumping means to provide a positive pressure so that another one of said sample fluids is forced to flow through each of said m flow cells.

21. A method according to claim 20 comprising the step, (i) repeating steps d-g until each of said sample fluids has been forced to flow through each of said m flow cells.

22. A method according to claim 20, further comprising the step of providing different sample fluids in each of said hollow needles of said needle unit, by, simultaneously inserting each of said needles into a respective well containing a sample fluid;

arranging the switching valve unit in its first configuration;

arranging the first selector valve unit such that it fluidly connect its single input with all of its n outputs;

operating the pumping means to provide a negative pressure so that sample fluids in said wells are aspirated into the respective hollow needles.

23. A method according to claim 19 further comprising the steps of, detecting, using a sensor, if molecules of a sample fluid have become bound to ligands on the test surfaces of one or more of said flow cells.

24. A method according to claim 23 wherein the step of detecting, using a sensor, if molecules of a sample fluid have become bound to ligands on the test surfaces of one or more of said flow cells comprises, passing the sample fluid through a flow cell which is without ligands on its test surface;

obtaining an output signal from the sensor as the sample fluid passes through said flow cell which is without ligands on its test surface, wherein the output signal defines a reference signal;

obtaining an output signal from the sensor as the sample fluid passes through a flow cell which has ligands on its test surface, and comparing said output signal with said reference signal;

determining that a molecule of said sample fluid has bound to the ligands of the flow cell if the output signal differs from the reference signal.

25. A method according to claim 19 further comprising the steps of providing ligands on the respective test surfaces of one or more of said flow cells in said flow cell unit.

26. A method according to claim 25 wherein the step of providing ligands on the respective test surfaces of one or more of said flow cells in said flow cell unit comprises providing ligands the test surfaces of a plurality of said flow cells, wherein the type of ligands provided on the test surfaces differ between flow cells such that the test surfaces of said plurality of flow cells have different types of ligands.

27. A method according to claim 25, wherein the steps of providing ligands on the respective test surfaces of one or more of said flow cells in said flow cell unit, comprises, providing a first immobilization reagent in a first hollow needle of said needle unit;

providing r different types of ligands in respective r different hollow needles of the needle unit, wherein r is greater than one;

providing a second immobilization reagent in another hollow needle;

passing the first immobilization reagent in the first hollow needle though the two or more flow cells in the flow cell unit, so that the first immobilization reagent contacts the test surface of each flow cell;

for each of said r hollow needles, passing the ligands which are in those respective hollow needles through a respective flow cell, so that the test surfaces of respective two or more flow cells are provided with different types of ligands;

passing the second immobilization reagent in said other hollow needle though the plurality of flow cells in the flow cell unit, to passivate the test surface of each of said two or more flow cells.

28. A method according to claim 27, wherein each respective output of the first selector valve unit is fluidly connected to a respective input of the switching valve unit via a respective conduit, and wherein the step of passing the immobilization reagent in the hollow needle though the two or more flow cells in the flow cell unit, so that the immobilization reagent contacts the test surface of each flow cell, comprises, arranging the switching valve unit in its first configuration;

operating the pumping means to provide a negative pressure which simultaneously moves the first immobilization reagent in a first hollow needle of said needle unit into a first conduit, moves said r different types of ligands into respective r different conduits, and moves the second immobilization reagent in a first hollow needle of said needle unit into a another conduit;

arranging the switching valve unit in its second configuration;

arranging the first selector valve unit such that it fluidly connects its single input to its output which is fluidly connected to said first conduit;

operating the pumping means to provide a positive pressure so that the first immobilization reagent, which is in said first conduit, is forced to flow through all of said m flow cells;

for each one of the r different output of said switching valve unit, arranging the first selector valve unit such that it fluidly connects its single input to its output which is fluidly connected to said respective one of said conduits, and operating the pumping means to provide a positive pressure so that the ligand in that conduit is forced to flow through one of said flow cells, wherein each different ligand in the r different inputs is forced to flow through a different one of said m flow cells;

arranging the first selector valve unit such that it fluidly connects its single input to its output which is fluidly connected to said other conduit;

operating the pumping means to provide a positive pressure so that the second immobilization reagent, which is in said other conduit, is forced to flow through all of said m flow cells.

29. A method according to claim 28 wherein the method further comprises the steps of, providing a buffer fluid in at least one other hollow needle of said needle unit;

passing the buffer fluid in said at least one other hollow needle though said two or more flow cells in the flow cell unit.

30. A method according to claim 19, further comprising the step of rinsing the test surfaces of said flow cells using a buffer fluid.

31. A method according to claim 19, using the assembly of claim 8 the method comprising the steps of, (a) arranging the switching valve unit in its first configuration;

(b) operating the n pumping means to provide a negative pressure, so that each of said sample fluids in each of said needles are forced to flow out of the respective needles and through the switching valve unit, wherein the sample fluid in each respective needle is different;

(c) arranging the switching valve unit in its second configuration;

(d) consecutively operating each of said respective n pumping means to consecutively provide a positive pressure so that each of said sample fluids are forced consecutively to flow through said m flow cells.

* * * * *